US008971734B2

(12) United States Patent
Tsuchiya et al.

(10) Patent No.: US 8,971,734 B2
(45) Date of Patent: Mar. 3, 2015

(54) IMAGE FORMING APPARATUS

(75) Inventors: Toshikazu Tsuchiya, Susono (JP); Masafumi Monde, Yokohama (JP); Hidetoshi Hanamoto, Mishima (JP); Tsutomu Ishida, Suntou-gun (JP); Shinji Hosoya, Naka-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/982,839

(22) PCT Filed: Mar. 29, 2012

(86) PCT No.: PCT/JP2012/059303

§ 371 (c)(1),
(2), (4) Date: Jul. 31, 2013

(87) PCT Pub. No.: WO2012/144324

PCT Pub. Date: Oct. 26, 2012

(65) Prior Publication Data

US 2013/0308965 A1 Nov. 21, 2013

(30) Foreign Application Priority Data

Mar. 29, 2011 (JP) ..... 2011-072275
Apr. 6, 2011 (JP) ..... 2011-084508
Apr. 19, 2011 (JP) ..... 2011-093147

(51) Int. Cl.
*G03G 15/08* (2006.01)

(52) U.S. Cl.
CPC ..... *G03G 15/0831* (2013.01); *G03G 15/086* (2013.01); *G03G 2215/0888* (2013.01)
USPC ..... 399/27; 399/30

(58) Field of Classification Search
CPC combination set(s) only.
See application file for complete search history.

(56) References Cited

U.S. PATENT DOCUMENTS

| | | | |
|---|---|---|---|
| 6,208,816 | B1 | 3/2001 | Koizumi et al. |
| 6,314,250 | B1 | 11/2001 | Miyashiro |
| 2014/0023385 | A1 | 1/2014 | Hosoya et al. |
| 2014/0037305 | A1 | 2/2014 | Monde et al. |

FOREIGN PATENT DOCUMENTS

| | | | | |
|---|---|---|---|---|
| EP | 1055976 | A2 | 11/2000 | |
| JP | 2002-132036 | A | 5/2002 | |
| JP | 2004-354904 | A | 12/2004 | |
| JP | 2004-354904 | A * | 12/2004 | ..... G03G 15/08 |
| JP | 4137703 | B2 | 8/2008 | |
| WO | 2012/137972 | A4 | 1/2013 | |

OTHER PUBLICATIONS

International Search Report mailed Sep. 4, 2012, in PCT/JP2012/059303.

* cited by examiner

*Primary Examiner* — Clayton E Laballe
*Assistant Examiner* — Jas Sanghera
(74) *Attorney, Agent, or Firm* — Fitzpatrick, Cella, Harper & Scinto

(57) ABSTRACT

An image forming apparatus includes a rotatable member which is provided on and rotatable about a rotation shaft in a detachably mountable developing unit containing a developer and has flexibility so that it is flexed depending on a resistance of the developer; an electroconductive member to be detected which is provided on the rotatable member; a detecting electrode provided in a neighborhood of an outer wall surface of a bottom of the developing unit; a converting portion for detecting an electrostatic capacity between the member to be detected and the detecting electrode and for converting the electrostatic capacity into an electric signal; a measuring portion for measuring a time duration in which the electric signal converted by the converting portion exceeds a predetermined threshold; and a discriminating portion for discriminating an amount of the developer on the basis of the time duration measured by the measuring portion.

19 Claims, 30 Drawing Sheets

(a)

(b)

(c)

TABLE T

| TIME(msec) | AMOUNT(%) |
|---|---|
| 8.0 | 100 |
| 8.4 | 90 |
| 8.6 | 80 |
| 9.0 | 70 |
| 9.4 | 60 |
| 9.9 | 50 |
| 10.5 | 40 |
| 11.1 | 30 |
| 11.9 | 20 |
| 12.5 | 10 |
| 13.7 | 0 |

(a)

(b)

TABLE L

| SENSOR LEVEL | TONER AMOUNT(%) |
|---|---|
| 165 | 60 |
| 167 | 50 |
| 170 | 40 |
| 175 | 30 |
| 181 | 20 |
| 190 | 10 |
| 199 | 0 |

(a)

(b)

(c)

(a)

(b)

(a)

(b)

| TABLE T1 | |
|---|---|
| SENSOR LEVEL | TONER AMOUNT(%) |
| 135 | 100 |
| 137 | 90 |
| 138 | 80 |
| 144 | 70 |
| 155 | 60 |
| 172 | 50 |
| 188 | 40 |
| 213 | 30 |
| 237 | 20 |
| 249 | 10 |
| 253 | 0 |

(a)

| TABLE T1(SNS. 69) | |
|---|---|
| SENSOR LEVEL | TONER AMOUNT(%) |
| 135 | 100 |
| 137 | 90 |
| 138 | 80 |
| 144 | 70 |
| 155 | 60 |
| 172 | 50 |
| 188 | 40 |
| 213 | 30 |
| 237 | 20 |
| 249 | 10 |
| 253 | 0 |

(b)

| TABLE T2(SNS. 46) | |
|---|---|
| SENSOR LEVEL | TONER AMOUNT(%) |
| 133 | 50 |
| 135 | 45 |
| 139 | 40 |
| 147 | 35 |
| 160 | 30 |
| 178 | 25 |
| 197 | 20 |
| 221 | 15 |
| 240 | 10 |
| 248 | 5 |
| 252 | 0 |

(c)

| TABLE T3(SNS. 92) | |
|---|---|
| SENSOR LEVEL | TONER AMOUNT(%) |
| 148 | 100 |
| 151 | 95 |
| 153 | 90 |
| 157 | 85 |
| 161 | 80 |
| 166 | 75 |
| 173 | 70 |
| 181 | 65 |
| 191 | 60 |
| 202 | 55 |
| 211 | 50 |

FIG.17

| TABLE T4 | |
|---|---|
| SNS. | AMOUNT(%) |
| 92 | 100 |
| 85 | 90 |
| 78 | 80 |
| 71 | 70 |
| 64 | 60 |
| 57 | 50 |
| 50 | 40 |
| 43 | 30 |
| 36 | 20 |
| 29 | 10 |
| 22 | 0 |

(a)

(b)

(a)

(b)

(c)

TABLE T

| TIME (msec) | AMOUNT (%) |
|---|---|
| 411 | 100 |
| 405 | 90 |
| 400 | 80 |
| 394 | 70 |
| 390 | 60 |
| 381 | 50 |
| 375 | 40 |
| 372 | 30 |
| 369 | 20 |
| 365 | 10 |
| 360 | 0 |

(a)

(b)

(c)

TABLE N

| LEVEL DIFFERENCE | AMOUNT (%) |
|---|---|
| 2 | 100 |
| 3 | 90 |
| 4 | 80 |
| 5 | 70 |
| 6 | 60 |
| 7 | 50 |
| 8.5 | 40 |
| 10 | 30 |
| 12.5 | 20 |
| 15 | 10 |
| 17.5 | 0 |

IMAGE FORMING APPARATUS

TECHNICAL FIELD

The present invention relates to a remaining amount detection of a toner which is a developer in an electrophotographic image forming apparatus such as a laser printer, a copying machine or a facsimile machine.

BACKGROUND ART

In a convention image forming apparatus, there is an example in which the remaining amount of the toner in a toner container is detected by an electrostatic capacity detecting device. For example, in a remaining toner amount detecting device described in Japanese Patent No. 4137703, a flexible member including a member to be detected at its end is connected with a stirring member and is rotated by rotation of the stirring member, so that the flexible member enters the toner and rotates. At this time, when a connecting portion between the flexible member and the stirring member enters the toner, the entire flexible member continuously enters the toner at the same portion while being deformed with flexibility, so that the flexible member draws the same locus in the toner and is rotationally moved. Therefore, also a member to be detected provided at the end of the flexible member draws the same locus as that of the flexible member and is rotationally moved. Further, when the amount of the toner is decreased to less than a certain level and the connecting portion with the stirring member does not enter the toner, the neighborhood of the end of the flexible member slides on the toner surface and also the member to be detected slides and moves on the toner surface. Here, when the amount of the toner is decreased to less than the certain level and a height of the toner surface is gradually lowered, a position of the member to be detected which slides and moves on the toner surface is also gradually lowered. That is, when the toner amount is decreased to less than the certain level, depending on a remaining toner amount, the position of the member to be detected which moves on the toner surface is also lowered.

On the other hand, an electrostatic capacity sensor detects an electrostatic capacity between itself and the member to be detected which moves on the toner surface, and the electrostatic capacity changes depending on a distance between the both members. Further, the electrostatic capacity sensor is disposed at a lower portion of the toner container and therefore when the toner amount is decreased to less than the certain level and the position of the member to be detected which moves on the toner surface is lowered, the distance between the electric signal sensor and the member to be detected becomes short and thus the electrostatic capacity between the both members becomes large. That is, the electrostatic capacity between the electrostatic capacity sensor and the member to be detected changes depending on the remaining toner amount.

Further, in the conventional image forming apparatus, a permeability sensor is used in a device for detecting the amount of the toner in a developing unit. As an example of the device for detecting the amount of the toner by using the permeability sensor, e.g., there is the detecting device as disclosed in Japanese Laid-Open Patent Application (JP-A) 2002-132036. JP-A 2002-132036 discloses the toner amount detecting device which uses a flexible first stirring blade deformed toward a rear side with respect to a rotational direction by stirring the toner, a rigid second stirring blade provided at the rear side of the first stirring blade with respect to the rotational direction, and the permeability sensor provided outside the bottom of the developing unit. This device detects a state of a rotating operation of a metal material provided on each of the stirring blades by the permeability sensor provided outside the bottom of the developing unit. Further, this device is constituted so that in the case where the toner amount in the developing unit is large, the first stirring blade and the second stirring blade integrally perform the rotating operation and so that in the case where the toner amount in the developing unit is small, the first stirring blade and the second stirring blade separately perform the rotating operation without being deformed. In this case, when the toner amount is detected by using the permeability sensor, a change in permeability per rotation of a rotation shaft is detected once in the case where the toner amount in the developing unit is large and is detected twice in the case where the toner amount in the developing unit is small. The toner amount detecting device detects the toner amount in the developing unit on the basis of the change in number of this detection.

However, the above-described remaining toner amount detecting device is accompanied with the following problem. In the case where the toner is filled at the certain level or more, the connecting portion between the stirring member and the flexible member enters the toner and therefore the loci drawn by the flexible member and the member to be detected do not little change. That is, in the case where the toner is filled at the certain level or more, the detected electrostatic capacity also does not little change. Therefore, in the case where the toner is present in a certain amount or more, the remaining toner amount cannot be accurately detected in real time.

Further, the detecting device of JP-A 2002-132036 involves the following problem. In the case where the first and second stirring blades integrally perform the rotating operation and therefore a signal detected by the permeability sensor indicates one change of the permeability per rotation of the rotation shaft. On the other hand, in the case where the toner amount is small, the first stirring blade is little deformed and thus the first and second stirring blade do not integrally perform the rotating operation. At this time, the signal detected by the permeability sensor indicates two changes of the permeability per rotation of the rotation shaft. Thus, selective detection of the amount of the toner or the presence/absence of the toner is made depending on the number (once or twice) of the change in magnetic field detected by the permeability sensor. For this reason, it is difficult to detect the change in toner amount in real time.

DISCLOSURE OF THE INVENTION

The present invention has been accomplished in these circumstances. A principal object of the present invention is to provide an image forming apparatus capable of detecting a remaining toner amount in real time from a full state to an empty state and capable of detecting the remaining toner amount even when stirring member is operated at high speed.

According to an aspect of the present invention, there is provided an image forming apparatus comprising: a rotatable member which is provided on and rotatable about a rotation shaft in a detachably mountable developing unit containing a developer and has flexibility so that it is flexed depending on a physical resistance of the developer; an electroconductive member to be detected which is provided on the rotatable member; a detecting electrode provided in a neighborhood of an outer wall surface of a bottom of the developing unit; converting means for detecting an electrostatic capacity between the member to be detected and the detecting electrode and for converting the electrostatic capacity into an electric signal; measuring means for measuring a time duration in which the electric signal converted by the converting means exceeds a predetermined threshold; and discriminating means for discriminating an amount of the developer on the basis of the time duration measured by the measuring means.

According to another aspect of the present invention, there is provided an image forming apparatus comprising: a rotatable member which is provided on and rotatable about a rotation shaft in a detachably mountable developing unit containing a developer and has flexibility so that it is flexed depending on a resistance of the developer; an electroconductive member to be detected which is provided on the rotatable member; a detecting electrode provided in a neighborhood of an outer wall surface of a bottom of the developing unit; converting means for detecting an electrostatic capacity between the member to be detected and the detecting electrode and for converting the electrostatic capacity into an electric signal; measuring means for measuring a detection level of the electric signal converted by the converting means; and discriminating means for discriminating an amount of the developer on the basis of the detection level measured by the measuring means.

According to another aspect of the present invention, there is provided an image forming apparatus comprising: a rotatable member which is provided on and rotatable about a rotation shaft in a detachably mountable developing unit containing a developer and has flexibility so that it is flexed depending on a resistance of the developer; an electroconductive member to be detected which is provided on the rotatable member; a detecting electrode provided in a neighborhood of an outer wall surface of a bottom of the developing unit; converting means for detecting an electrostatic capacity between the member to be detected and the detecting electrode and for converting the electrostatic capacity into an electric signal; first measuring means for measuring a time duration in which the electric signal converted by the converting means exceeds a predetermined threshold; second measuring means for measuring a detection level of the electric signal converted by the converting means; discriminating means for discriminating an amount of the developer on the basis of the time duration measured by the first measuring means or the detection level measured by the second measuring means; and control means for effecting control so that the discriminating means discriminates, when the discriminating means discriminates that the amount of the developer is less than a predetermined amount on the basis of the time duration measured by the first measuring means, the amount of the developer on the basis of the detection level measured by the second measuring means and so that the discriminating means discriminates, when the discriminates that the amount of the developer is not less than the predetermined amount on the basis of the time duration measured by the first measuring means, the amount of the developer on the basis of the time duration measured by the first measuring means.

According to another aspect of the present invention, there is provided an image forming apparatus comprising: a detachably mountable developing unit for accommodating a developer; a first member which includes a first electrode and is rotatable about a rotation shaft in the developing unit; a second member which performs a rotating operation about the rotation shaft in the developing unit; a second electrode provided on an outer casing of the developing unit; outputting means for detecting an electrostatic capacity between the first electrode and the second electrode and for outputting data regarding the detected electrostatic capacity; and discriminating means for discriminating an amount of the developer in the developing unit on the basis of the data outputted from the outputting means.

According to another aspect of the present invention, there is provided an image forming apparatus comprising: a detachably mountable developing unit for accommodating a developer; a first member which comprises a first electrode and is rotatable about a rotation shaft in the developing unit; a second member which comprises a second electrode and is provided at a predetermined angle formed between itself and the first member with respect to the rotation shaft of the first member; a third electrode provided on an outer casing of the developing unit; outputting means for detecting an electrostatic capacity between the first electrode and the third electrode or between the second electrode and the third electrode and for outputting information on the detected electrostatic capacity; and discriminating means for discriminating an amount of the developer in the developing unit on the basis of the information outputted from the outputting means, wherein the discriminating means discriminates the amount of the developer on the basis of a difference between a time when the outputting means detects the electrostatic capacity between the first electrode and the third electrode and a time when the outputting means detects the electrostatic capacity between the second electrode and the third electrode.

According to a further aspect of the present invention, there is provided an image forming apparatus comprising: a detachably mountable developing unit for accommodating a developer; a first member which comprises a first electrode and is rotatable about a rotation shaft in the developing unit; a second member which comprises a second electrode and is provided at a predetermined angle formed between itself and the first member with respect to the rotation shaft of the first member; a third electrode provided on an outer casing of the developing unit; outputting means for detecting an electrostatic capacity between the first electrode and the third electrode or between the second electrode and the third electrode and for outputting information on the detected electrostatic capacity; and discriminating means for discriminating an amount of the developer in the developing unit on the basis of the information outputted from the outputting means, wherein the discriminating means discriminates the amount of the developer on the basis of a difference between the information on the electrostatic capacity between the first electrode and the third electrode outputted by the outputting means and the information on the electrostatic capacity between the second electrode and the third electrode outputted by the outputting means.

These and other objects, features and advantages of the present invention will become more apparent upon a consideration of the following description of the preferred embodiments of the present invention taken in conjunction with the accompanying drawings.

Figure 2:
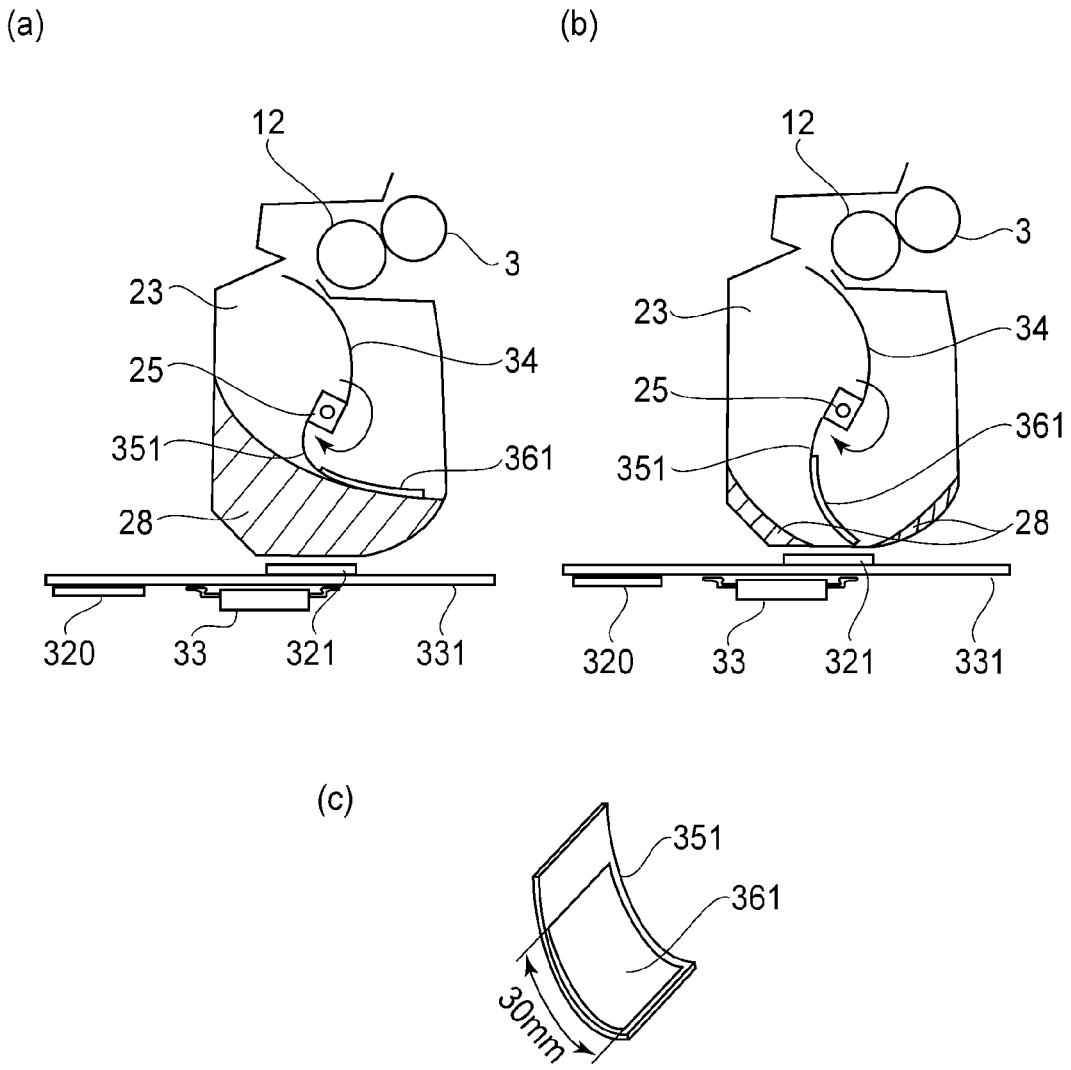

Parts (a) and (b) of FIG. 2 are sectional views of a developing unit in Embodiment 1, and (c) of FIG. 2 is a perspective view of a detecting Mylar and an electrode to be detected.

Figure 3:
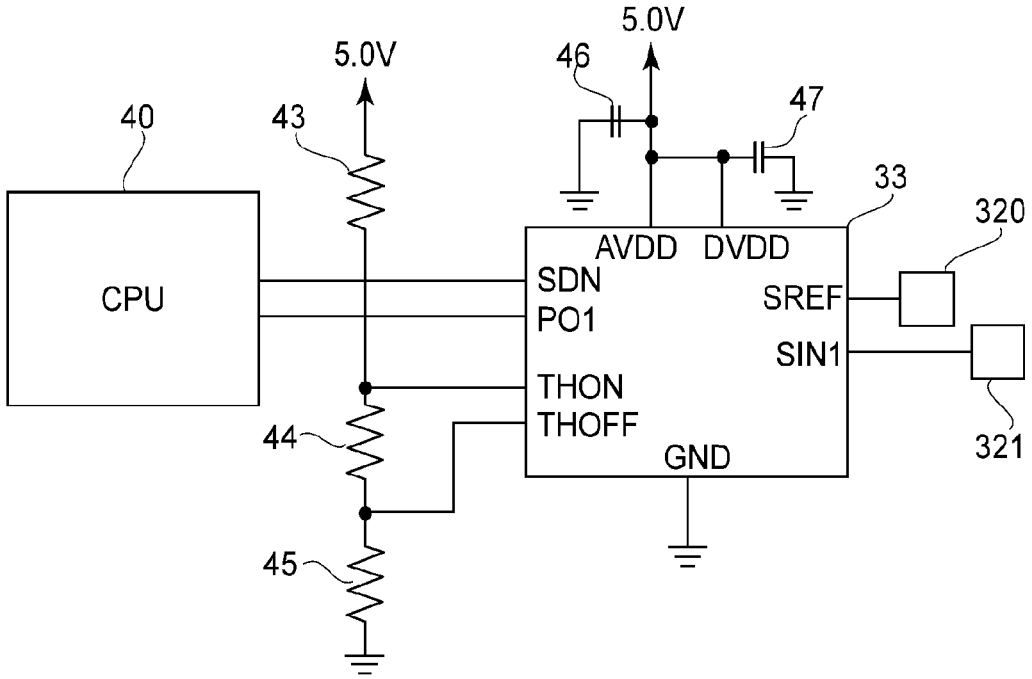

FIG. 3 is a circuit diagram of a remaining toner amount detection in Embodiment 1.

Figure 4:
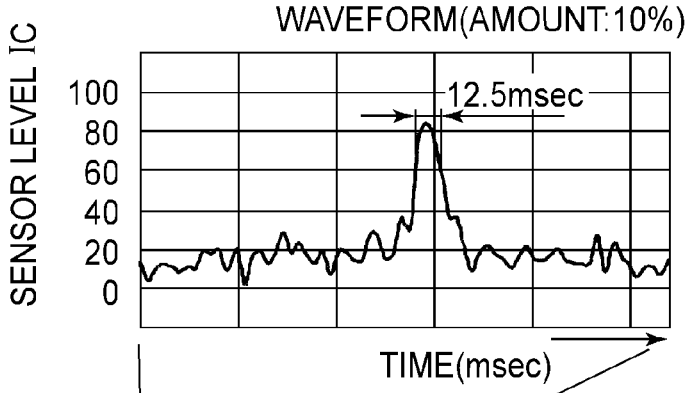
Figure 4:
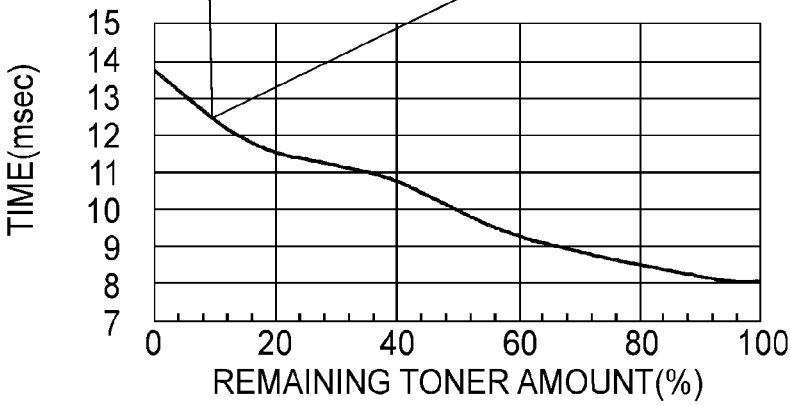

Parts (a) to (c) of FIG. 4 are a characteristic graph, a waveform and a table T, respectively, for the remaining toner amount detection in Embodiment 1.

Figure 5:
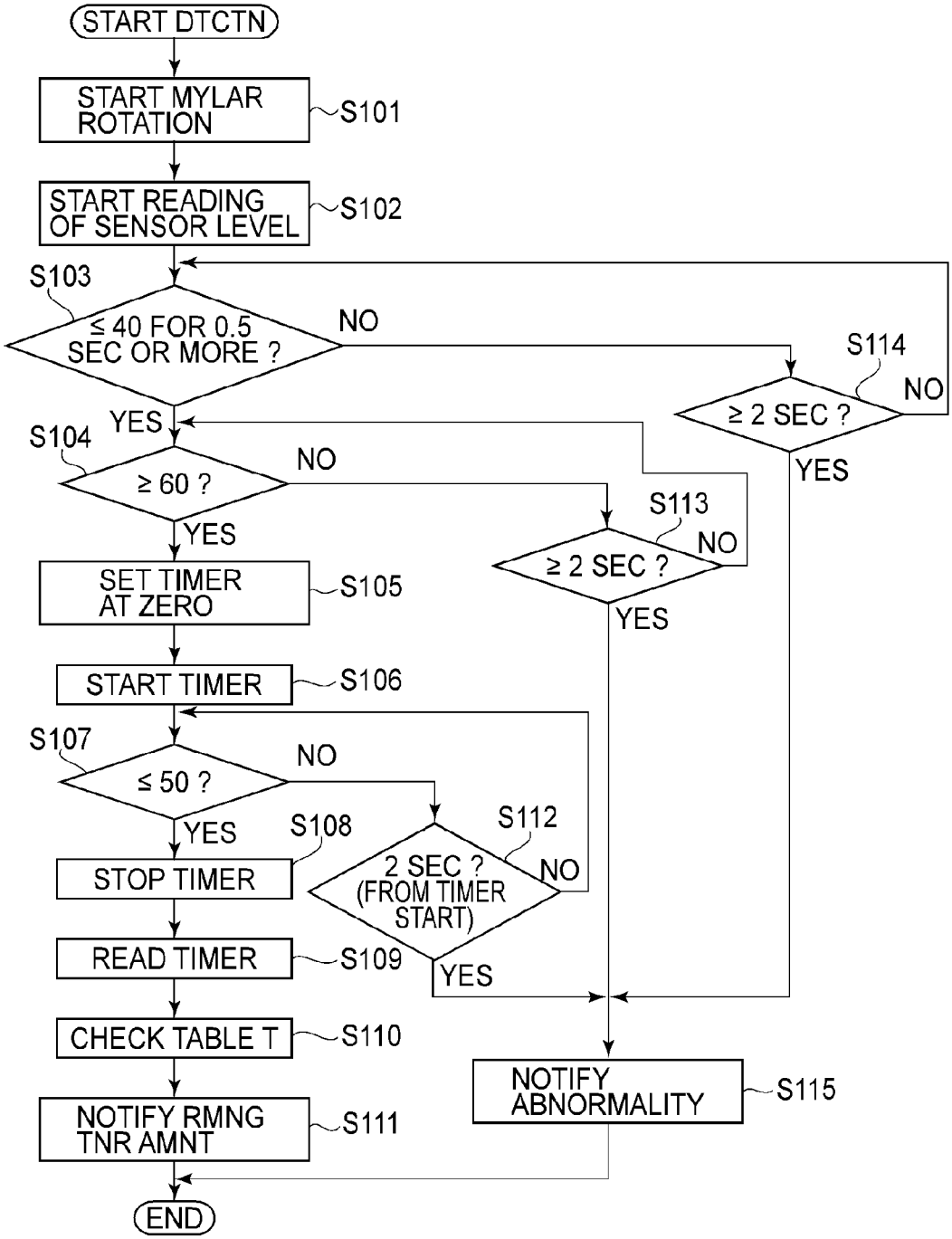

FIG. 5 is a flow chart of the remaining toner amount detection in Embodiment 1.

Figure 6:
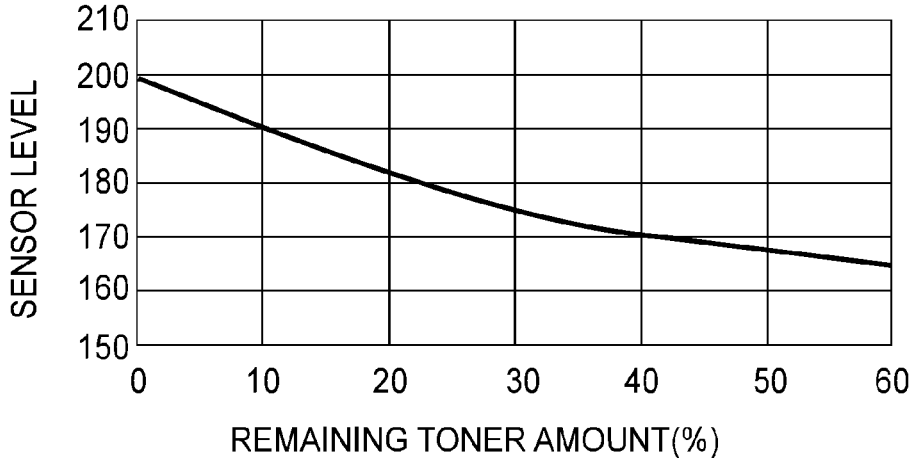

Parts (a) and (b) of FIG. 6 is a characteristic graph and a table L, respectively, for the remaining toner amount detection in Embodiment 2.

Figure 7:
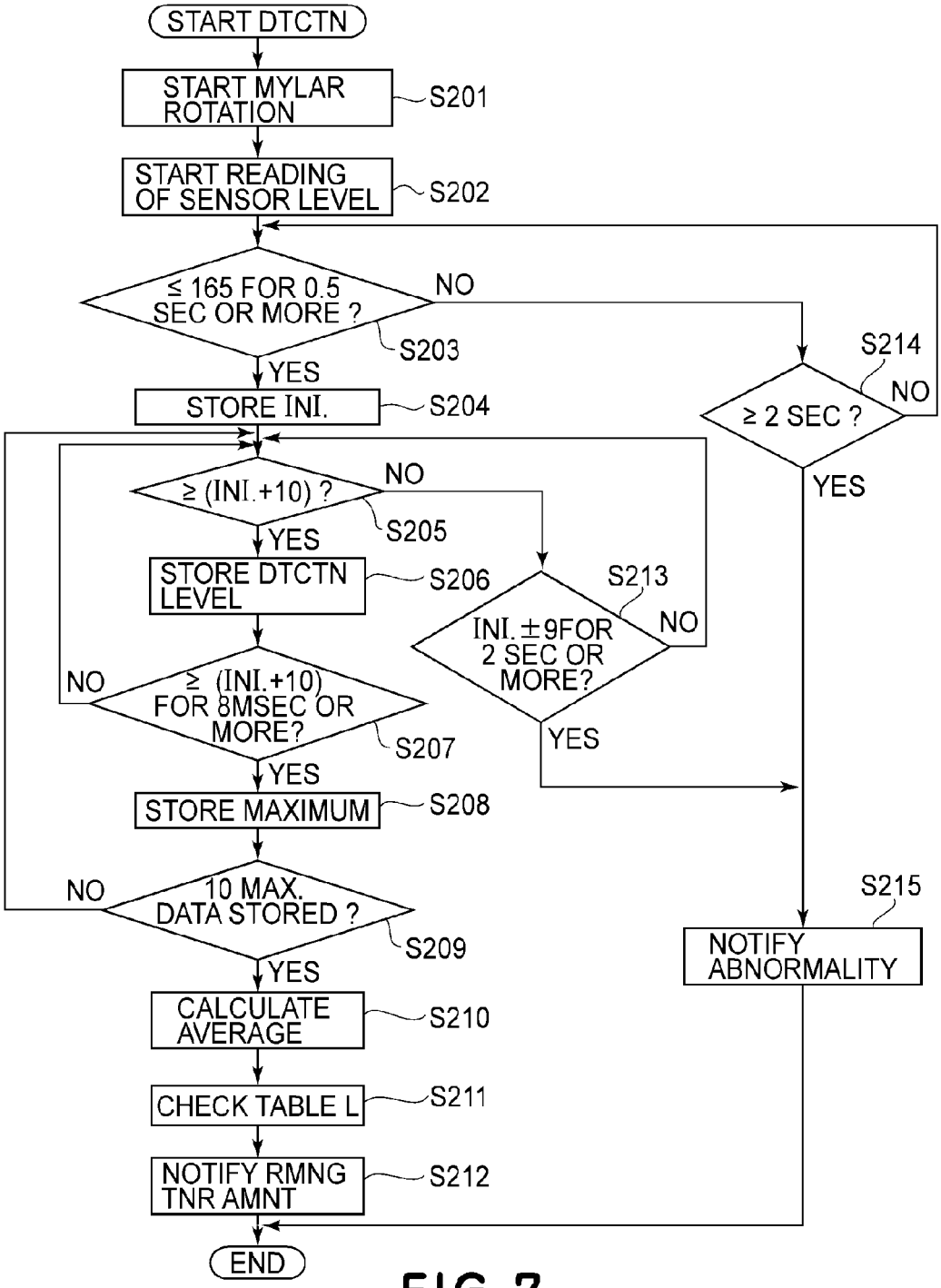

FIG. 7 is a flow chart of the remaining toner amount detection in Embodiment 2.

Figure 8:
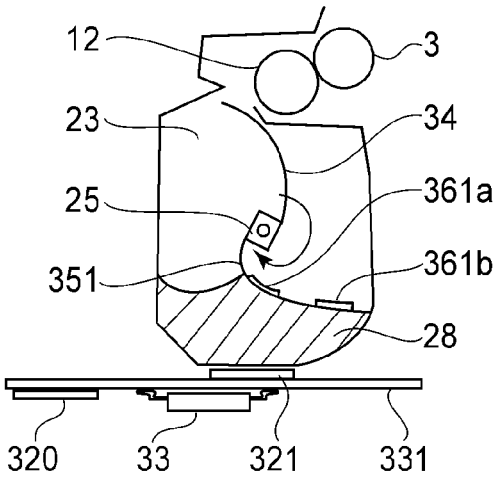
Figure 8:
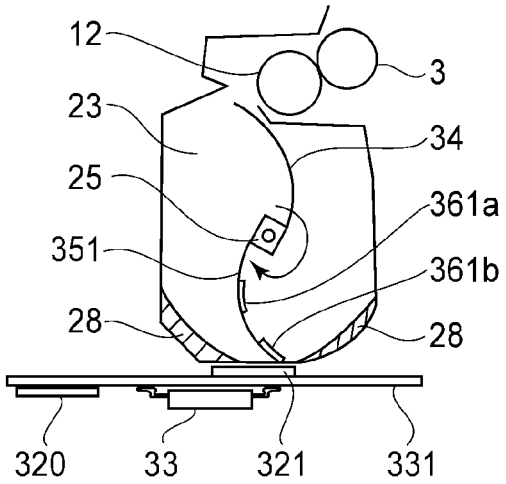
Figure 8:
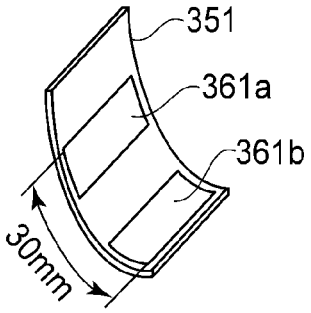

Parts (a) and (b) of FIG. 8 are sectional views of a developing unit in Embodiment 3, and (c) of FIG. 8 is a perspective view of a detecting Mylar and electrodes to be detected.

Figure 9:
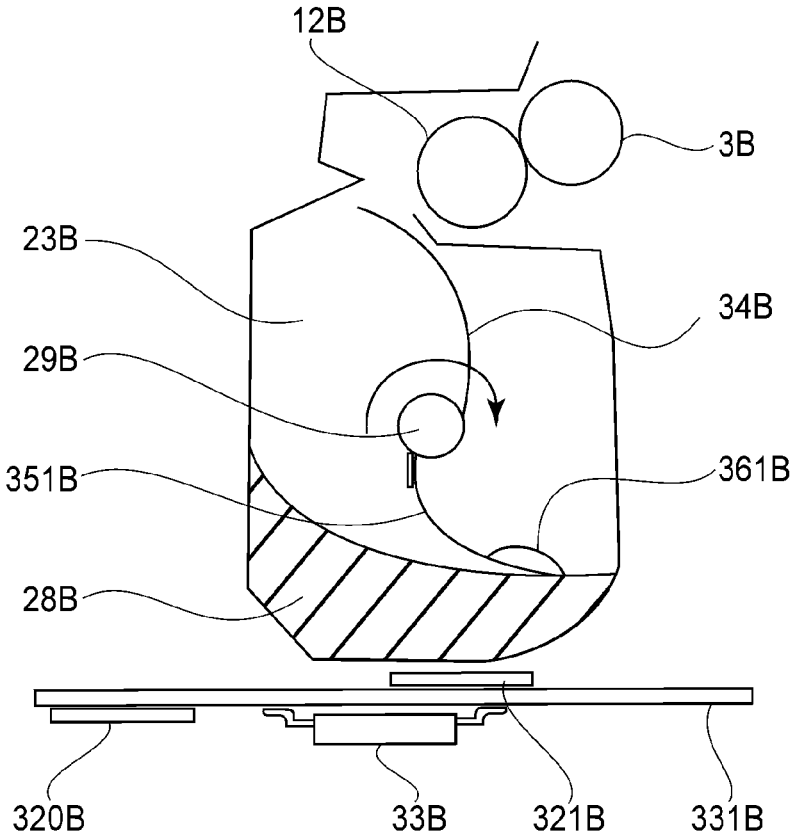

FIG. 9 is a sectional view of a developing unit and an electrostatic capacity sensor in Embodiments 4 to 6.

Figure 10:
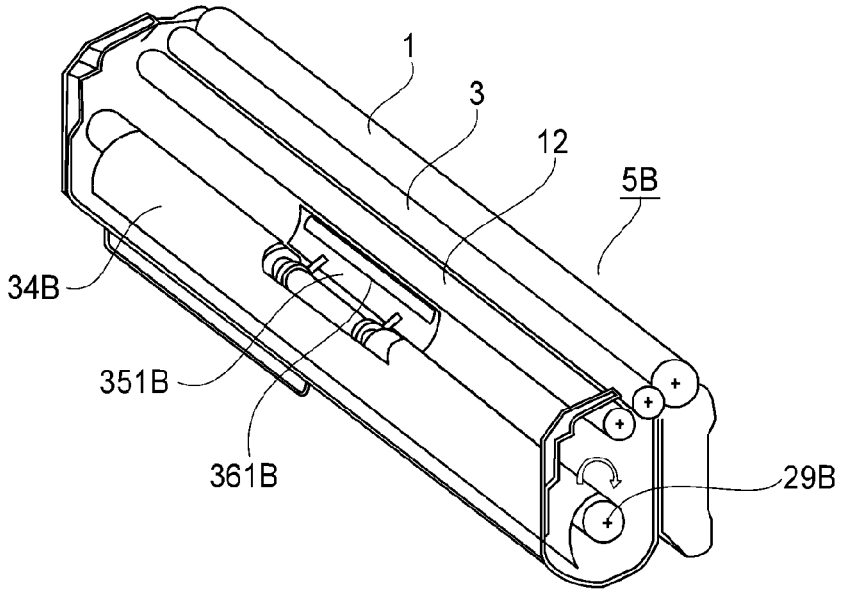
Figure 10:
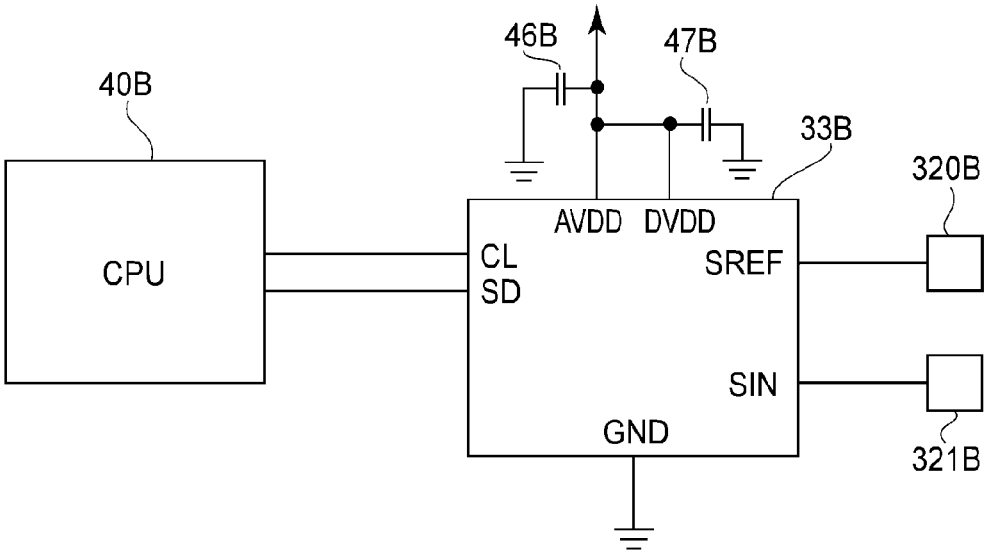

Parts (a) and (b) of FIG. 10 are a perspective view of a developing unit and a circuit diagram of an electrostatic capacity sensor and its peripheral portions, respectively, in Embodiments 4 to 6.

Figure 11:
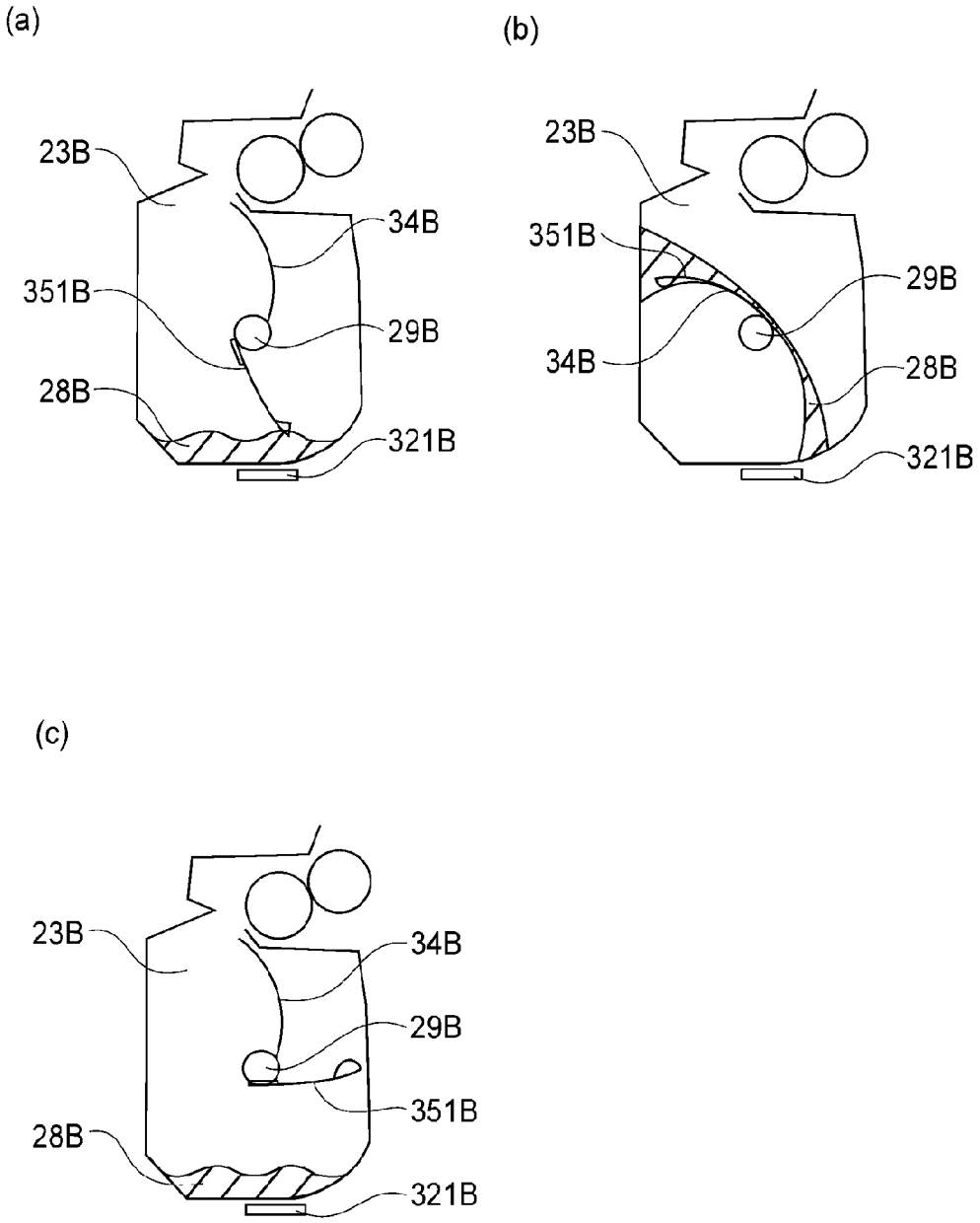

Parts (a) to (c) of FIG. 11 are sectional views showing operations of a stirring Mylar and a detecting Mylar of the developing unit in Embodiments 4 to 6.

Figure 12:
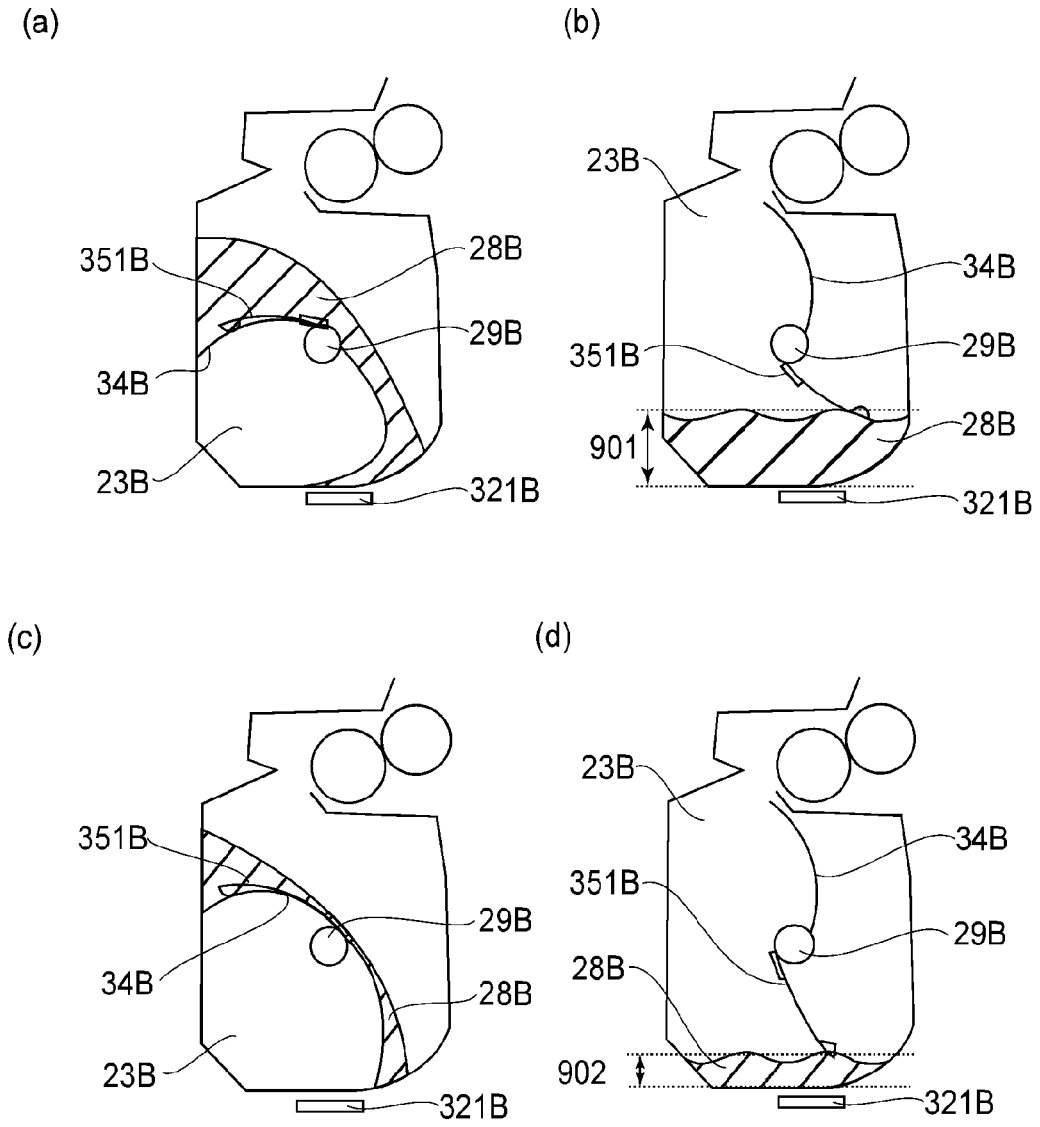

Parts (a) to (d) of FIG. 12 are sectional views each showing an operation of the detecting Mylar in Embodiments 4 to 6, wherein (a) and (b) show the case where the toner amount is large and (c) and (d) show the case where the toner amount is small.

Figure 13:
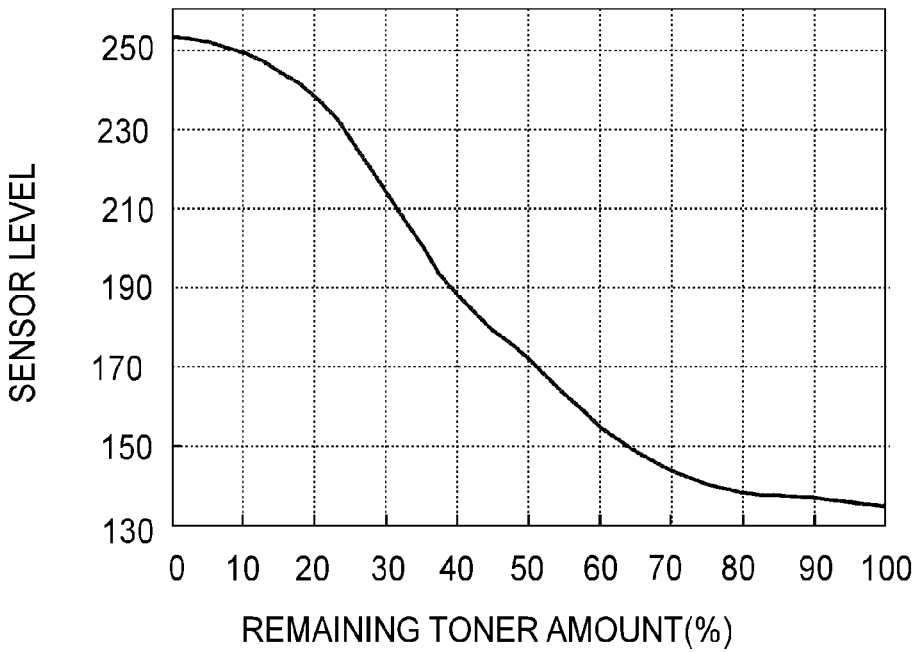

Parts (a) and (b) of FIG. 13 are a characteristic graph and a table T1, respectively, in Embodiment 4.

Figure 14:
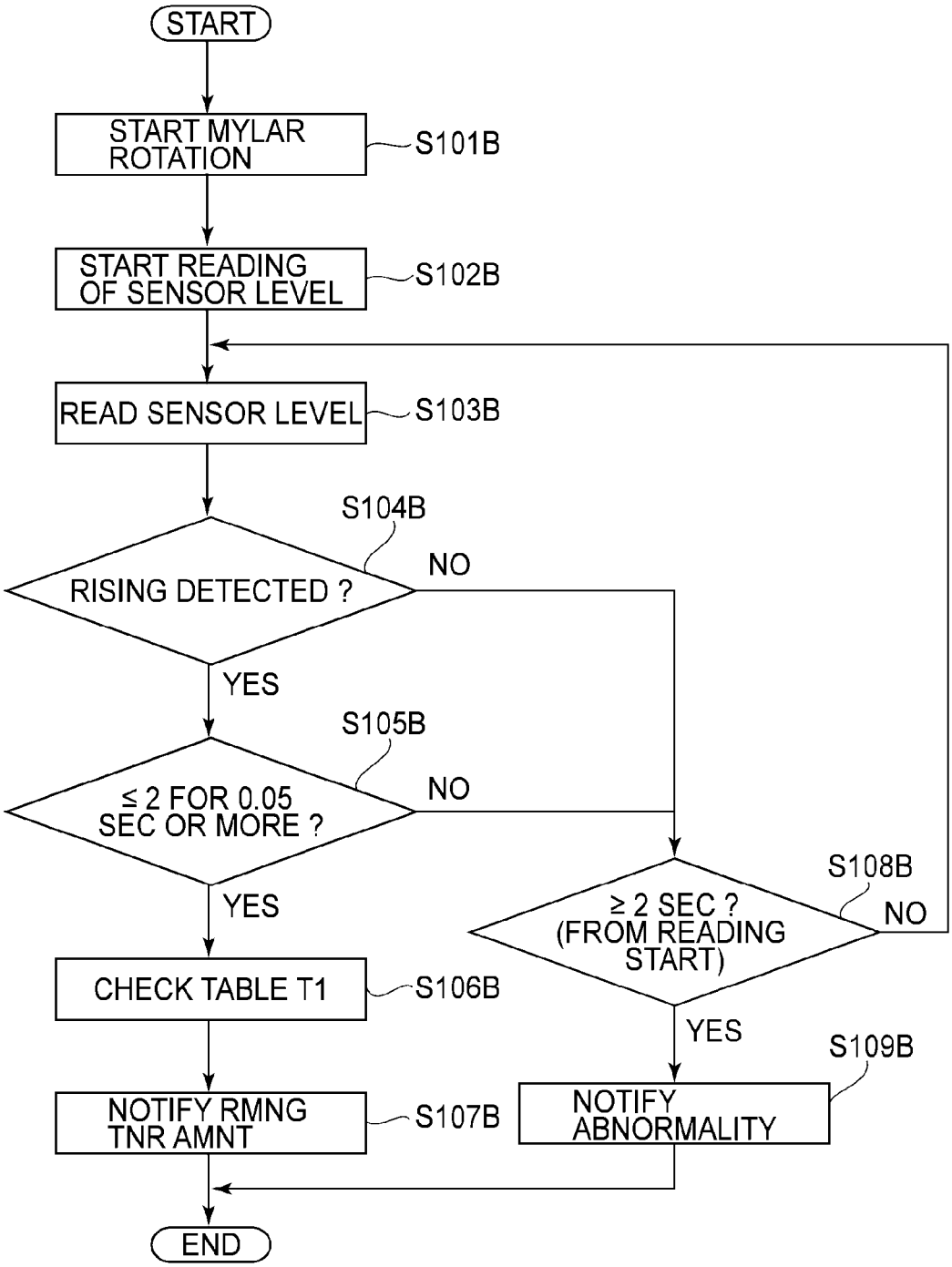

FIG. 14 is a flow chart showing a processing sequence of remaining toner amount detection in Embodiment 4.

Figure 15:
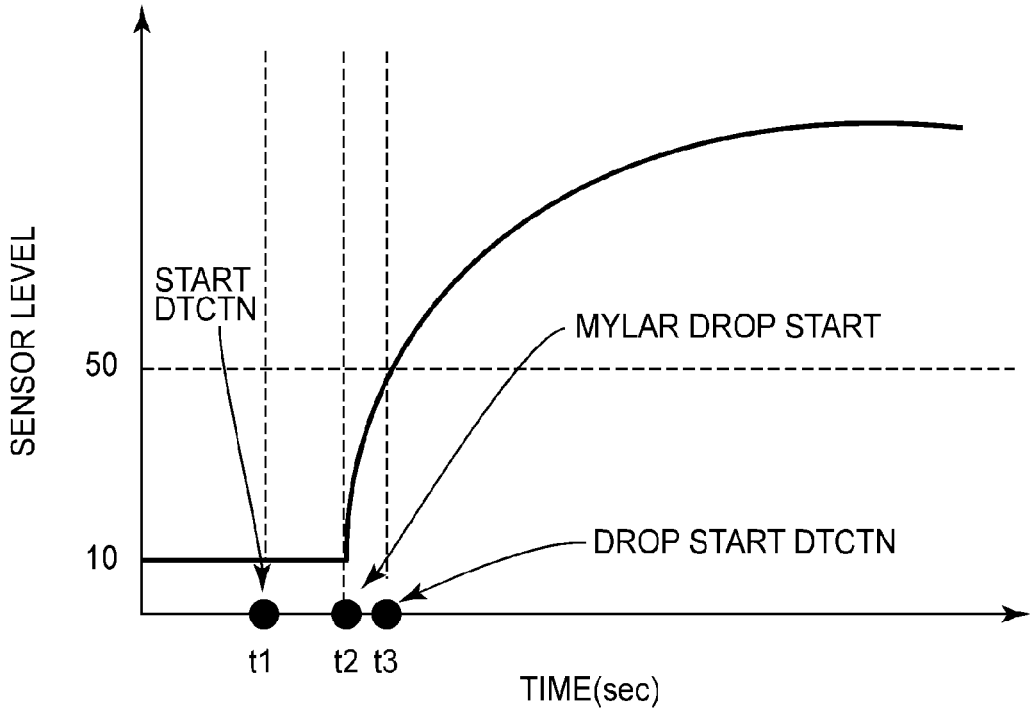

FIG. 15 is a graph showing a state in which a detection level of the electrostatic capacity sensor is changed by free fall of the detecting Mylar.

Figure 16:
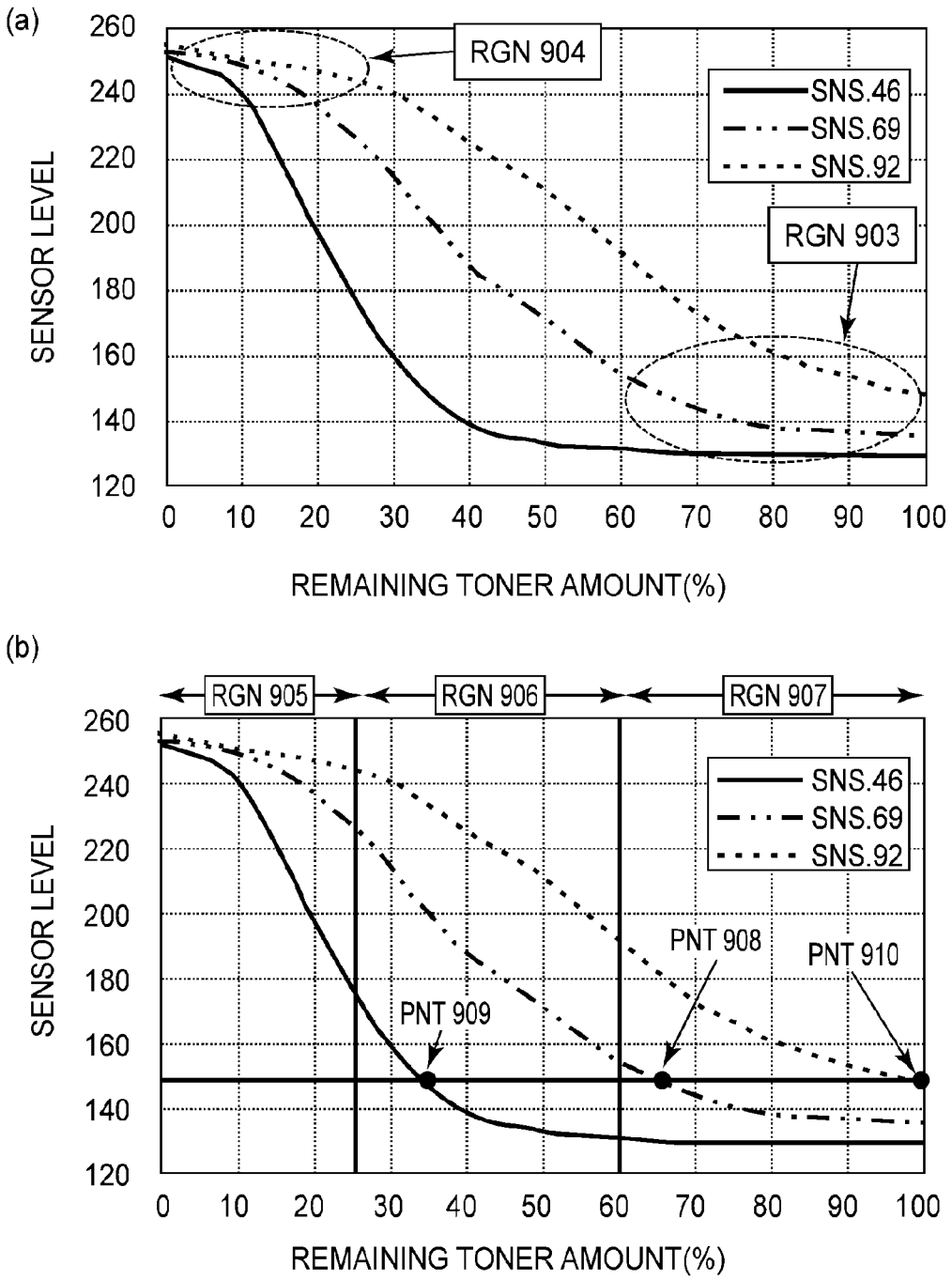

Parts (a) and (b) of FIG. 16 are a characteristic graph depending on sensor sensitivity and a characteristic graph in which the sensor sensitivity is changed depending on a remaining toner amount, respectively, in Embodiment 5.

Parts (a) to (c) of FIG. 17 are characteristic tables each showing the remaining toner amount depending on the sensor sensitivity in Embodiment 5.

Figure 18:
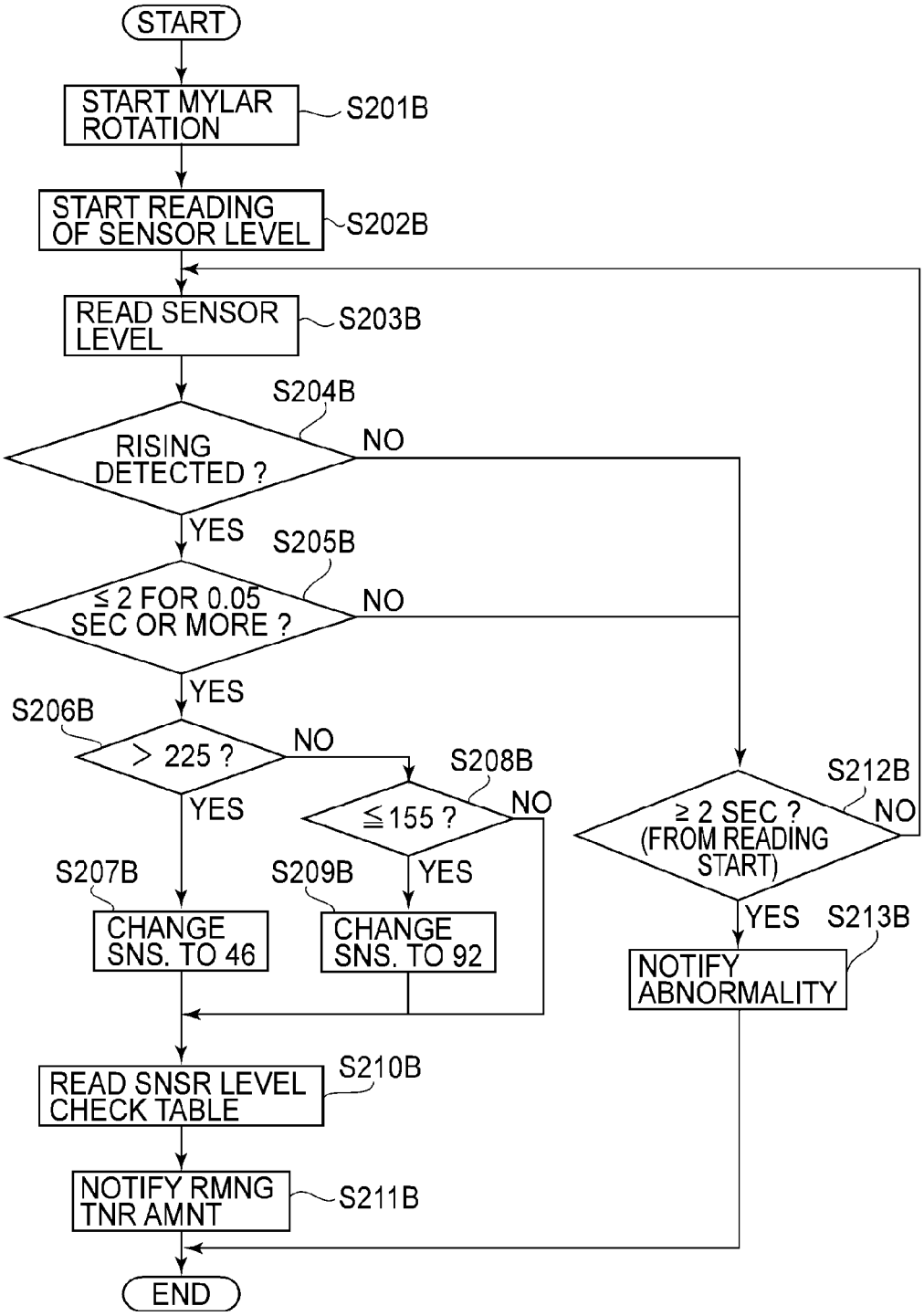

FIG. 18 is a flow chart showing a processing sequence of remaining toner amount detection in Embodiment 5.

Figure 19:
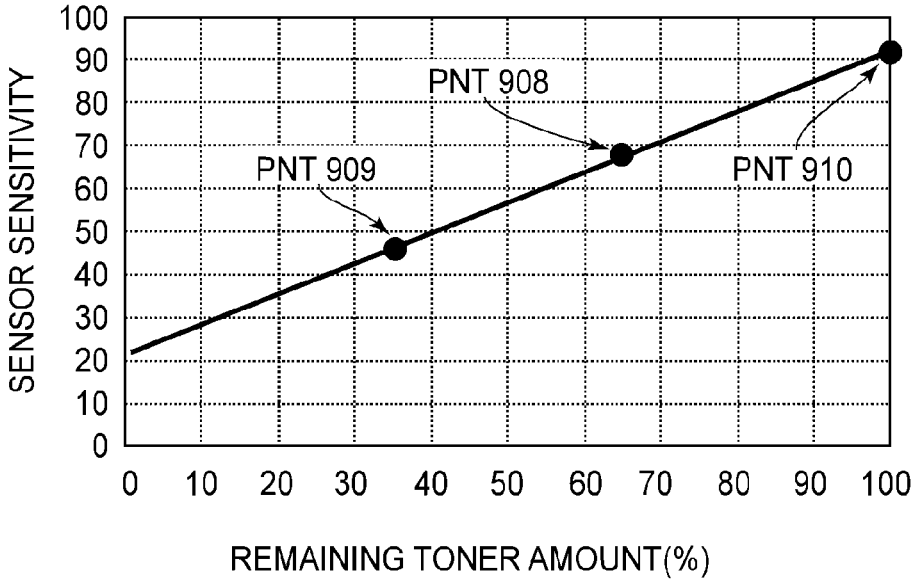

Parts (a) and (b) of FIG. 19 are a characteristic graph and a table T4, respectively, in Embodiment 6.

Figure 20:
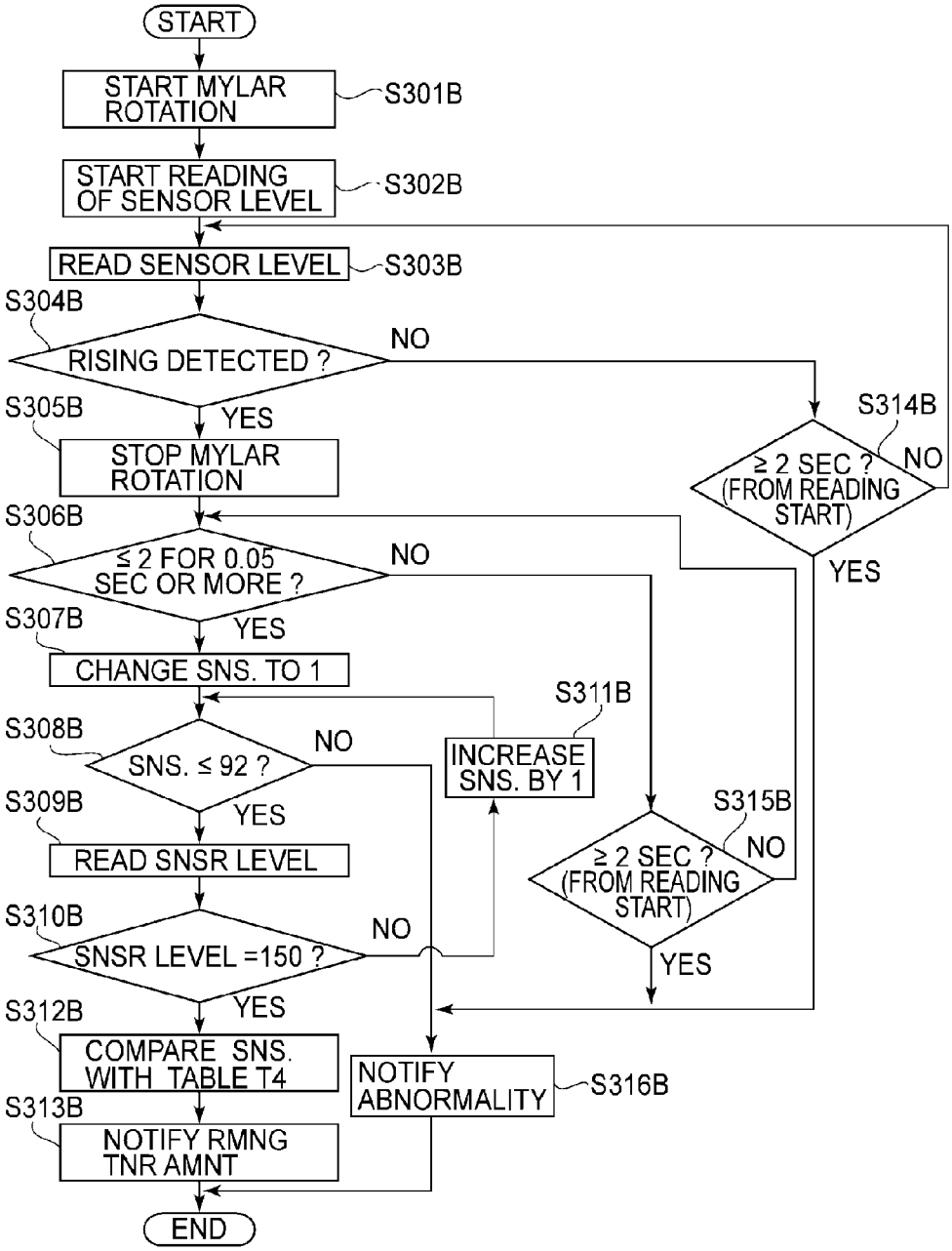

FIG. 20 is a flow chart showing a processing sequence of remaining toner amount detection in Embodiment 6.

Figure 21:
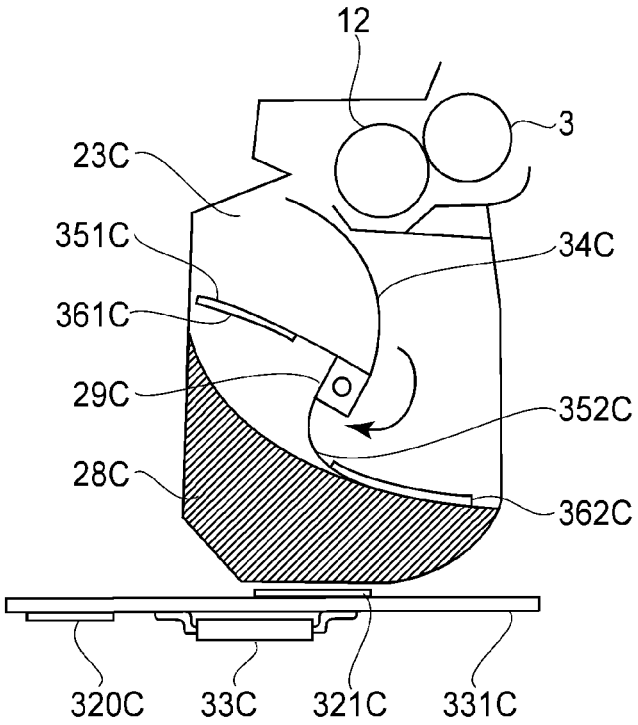
Figure 21:
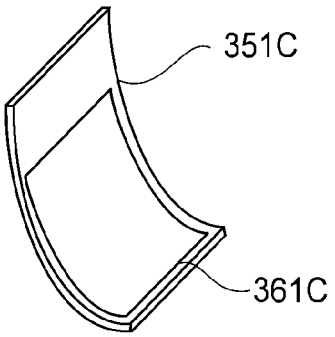

Part (a) of FIG. 21 is a sectional view of a developing unit and an electrostatic capacity sensor substrate in Embodiments 7 and 9, and (b) of FIG. 21 is a perspective view of a detecting Mylar and an electrode to be detected.

Figure 22:
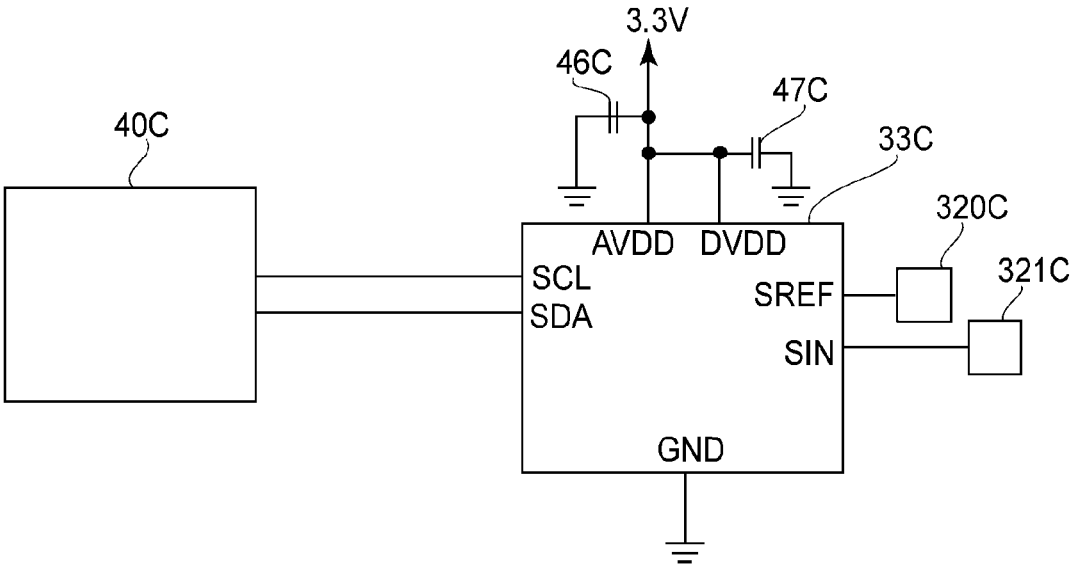

FIG. 22 is a circuit diagram of remaining toner amount detection in Embodiments 7 to 10.

Figure 23:
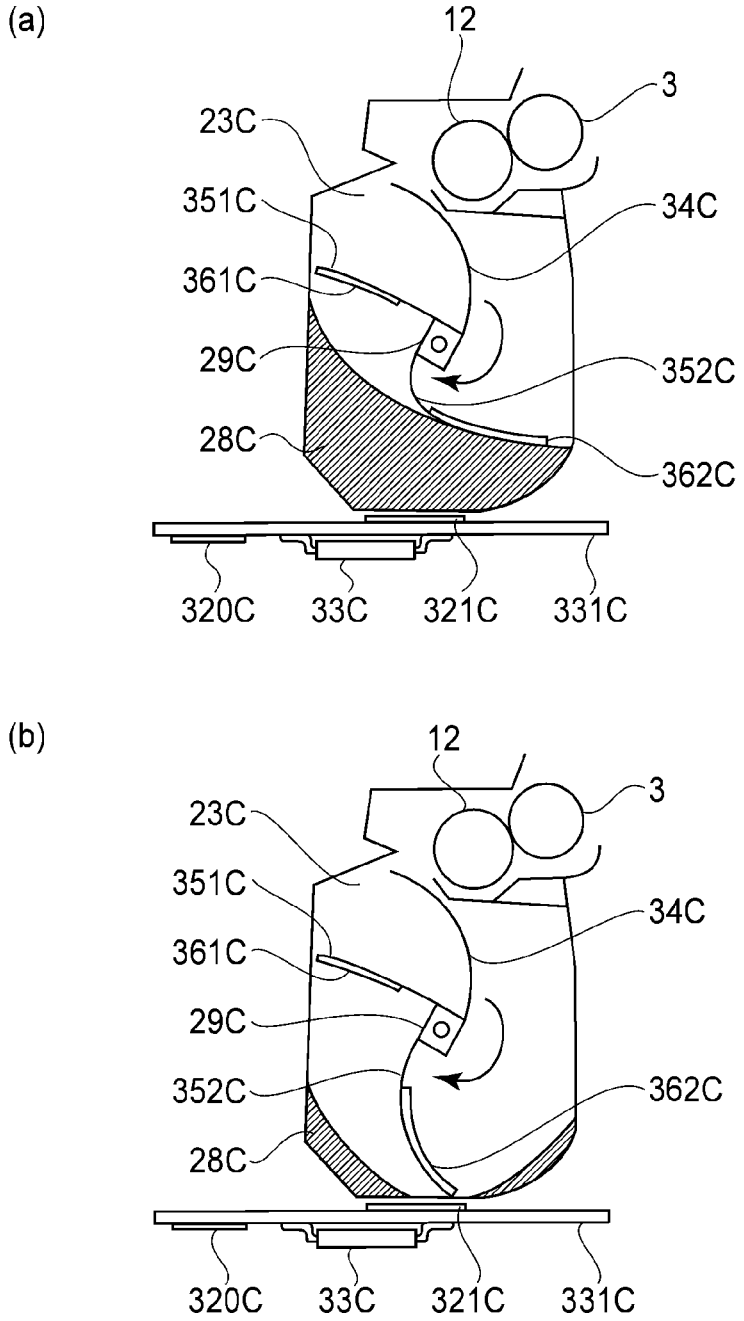

Parts (a) and (b) of FIG. 23 are sectional views each showing a developing unit and an electrostatic capacity sensor substrate in Embodiment 7.

Figure 24:
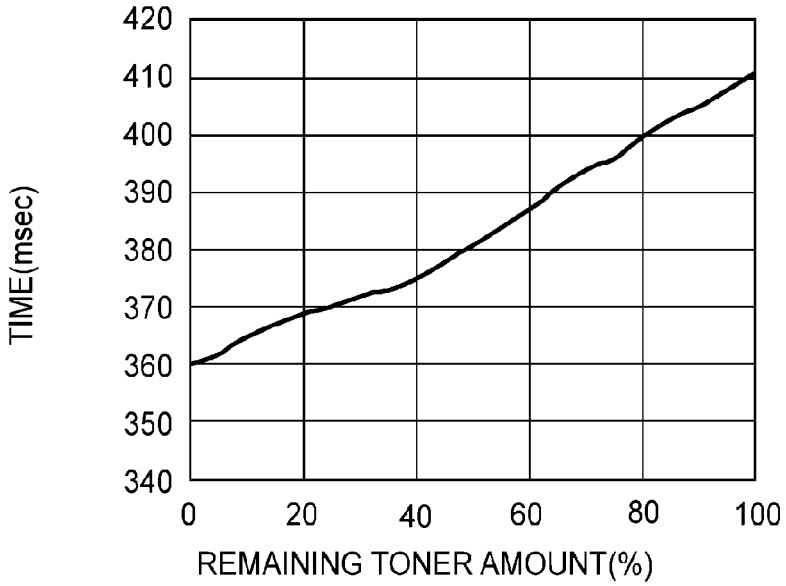
Figure 24:
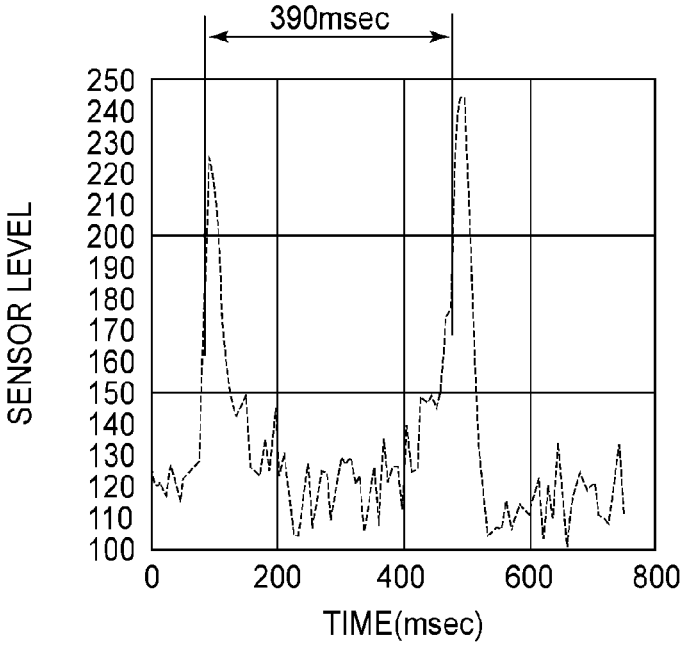

Parts (a) to (c) of FIG. 24 are a characteristic graph, a waveform and a table T, respectively, for remaining toner amount detection in Embodiments 7 and 8.

Figure 25A:
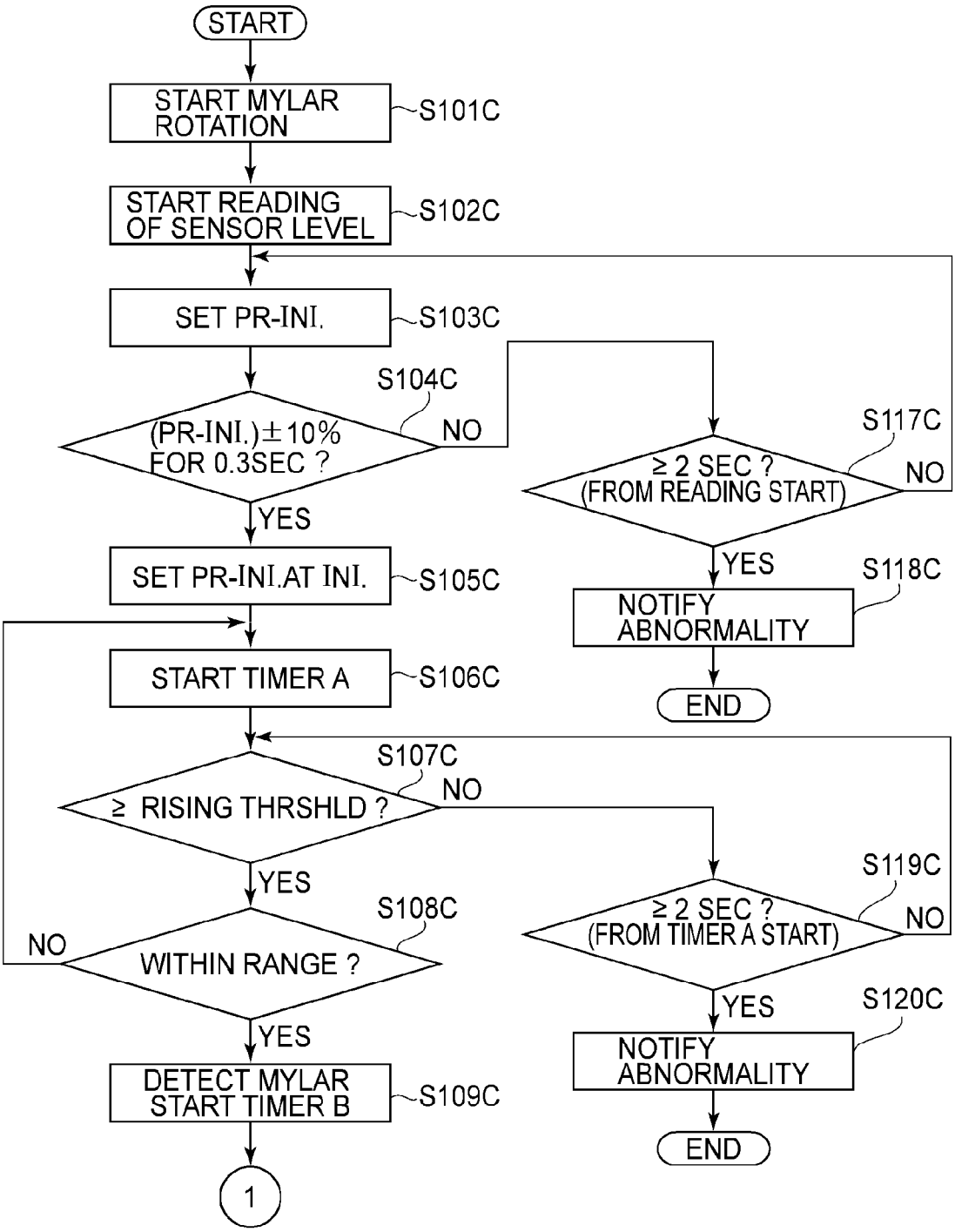
Figure 25B:
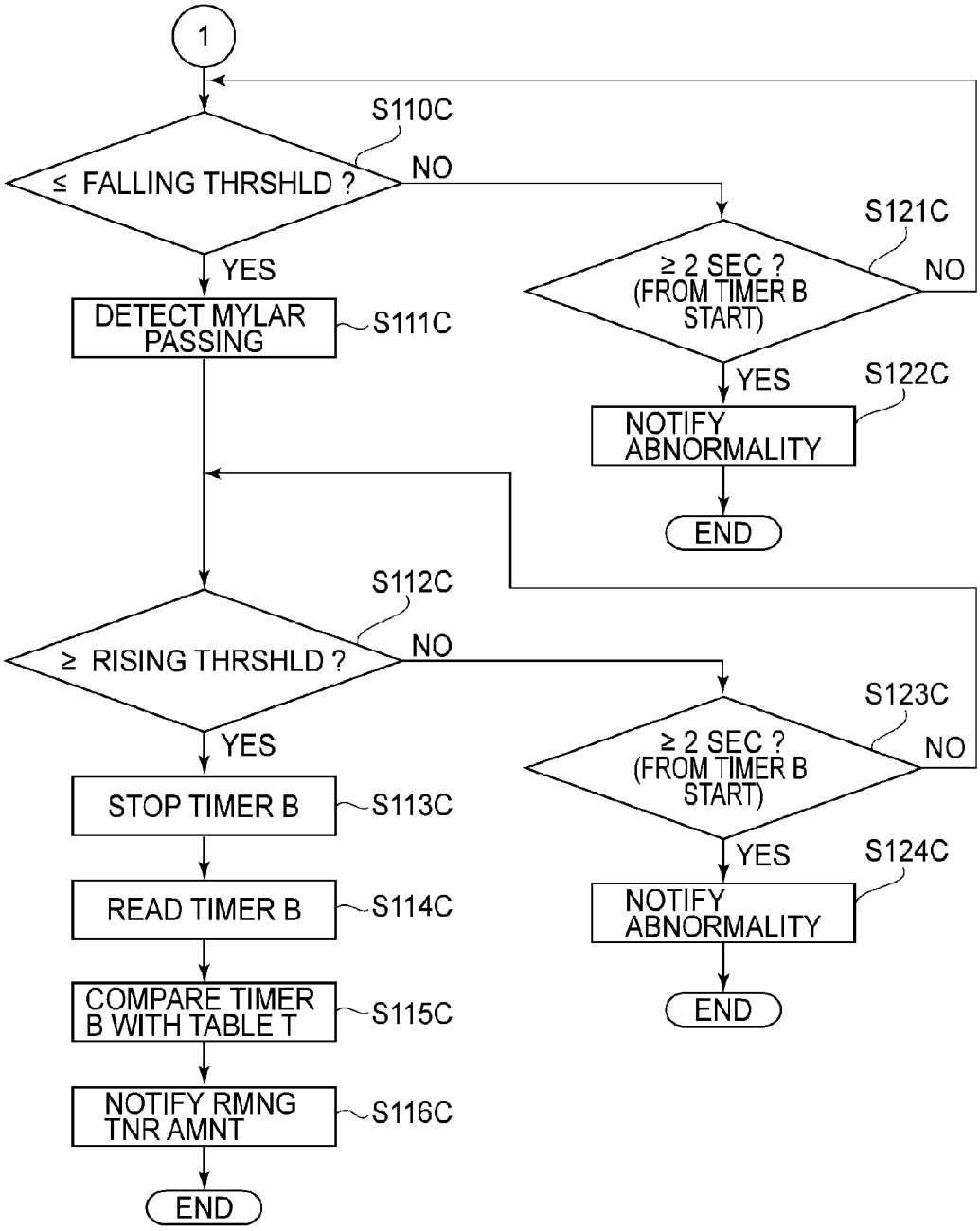

FIGS. 25A and 25B are a flow chart of the remaining toner amount detection in Embodiments 7 and 8.

Figure 26:
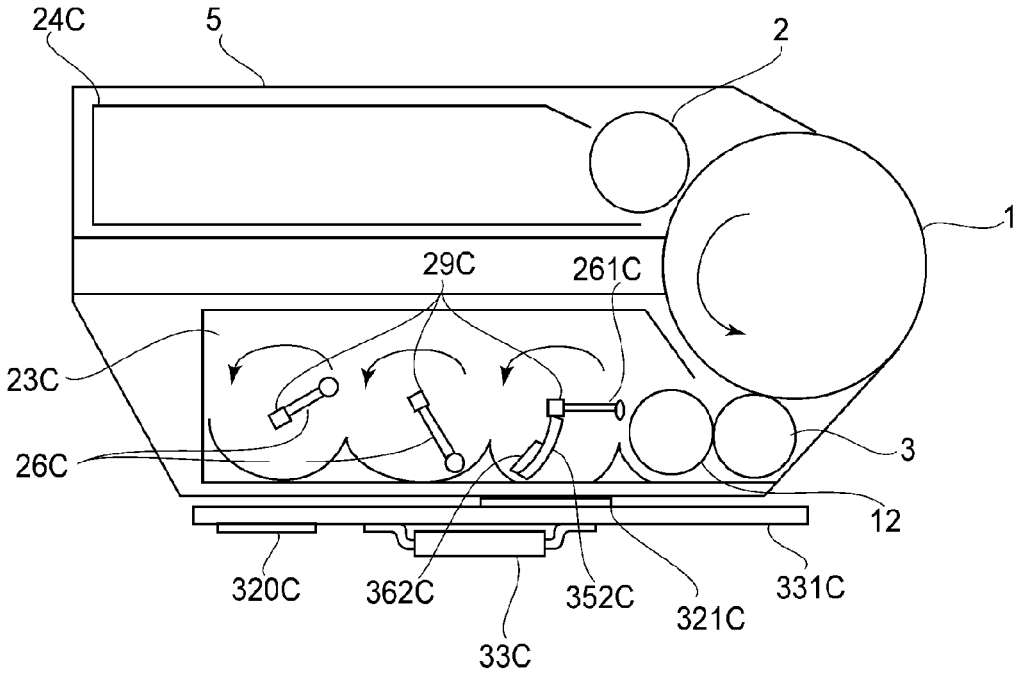

FIG. 26 is a sectional view of a developing unit and an electrostatic capacity sensor substrate in Embodiments 8 and 10.

Figure 27:
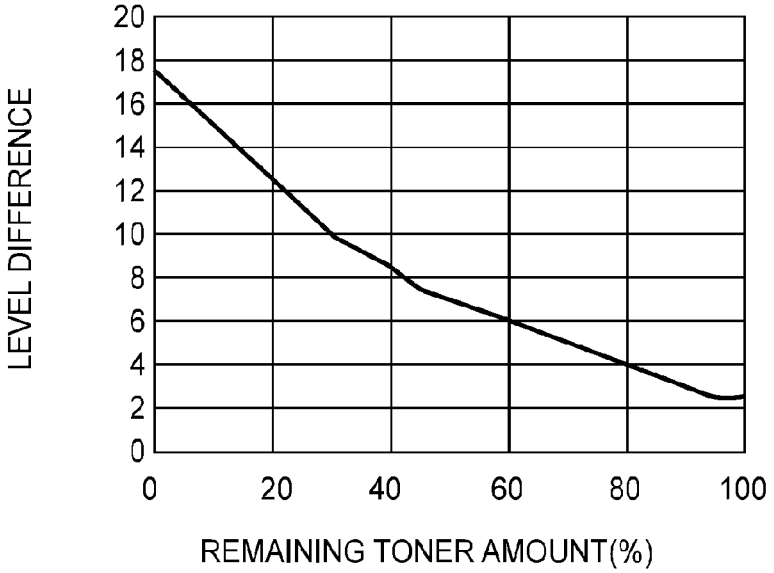
Figure 27:
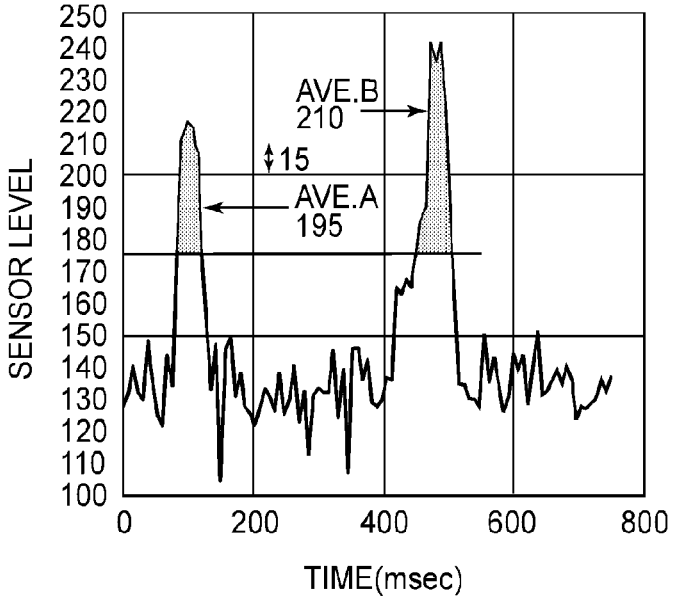

Parts (a) to (c) of FIG. 27 are a characteristic graph, a waveform and a table N, respectively, in Embodiments 9 and 10.

Figure 28A:
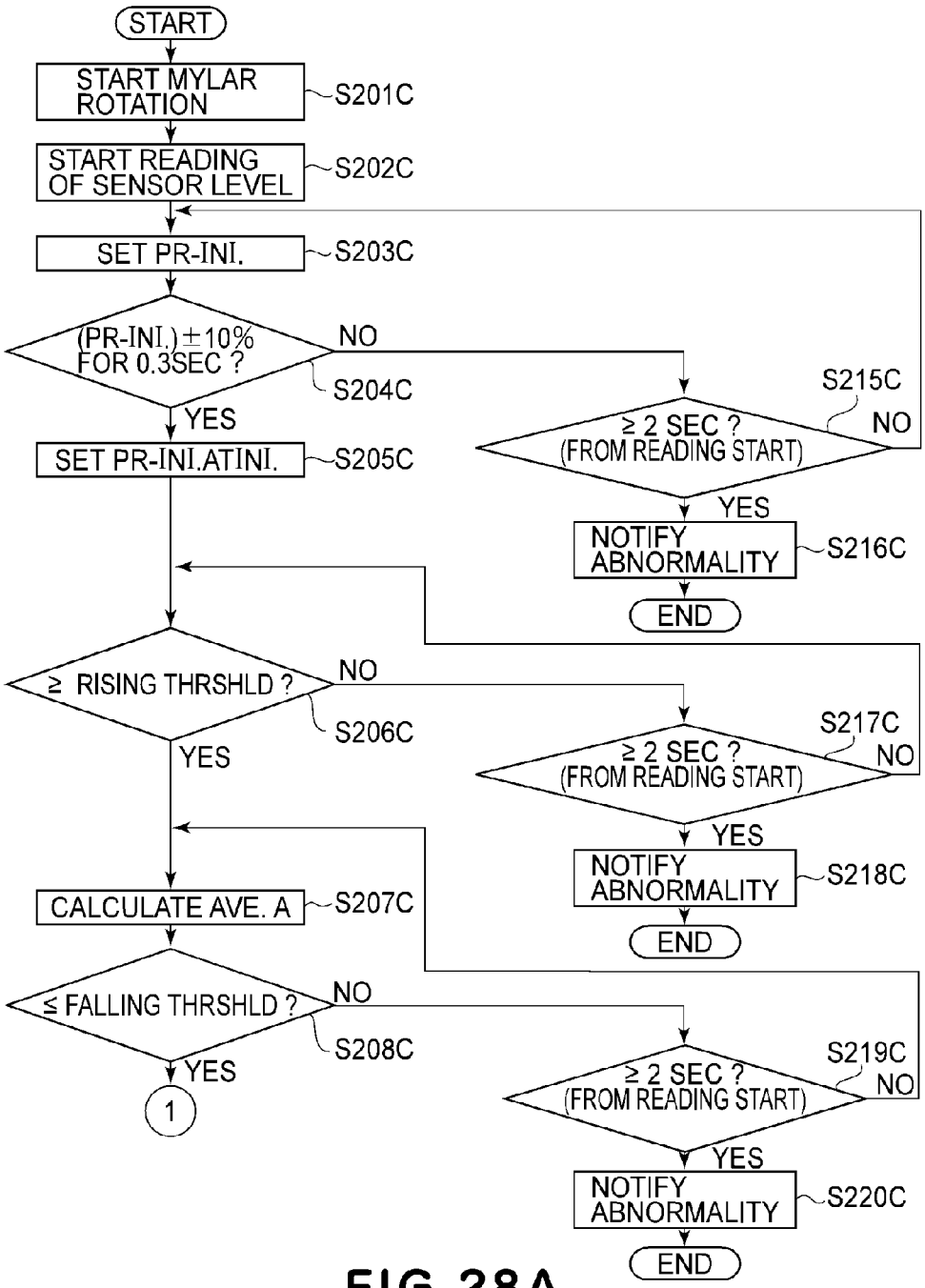
Figure 28B:
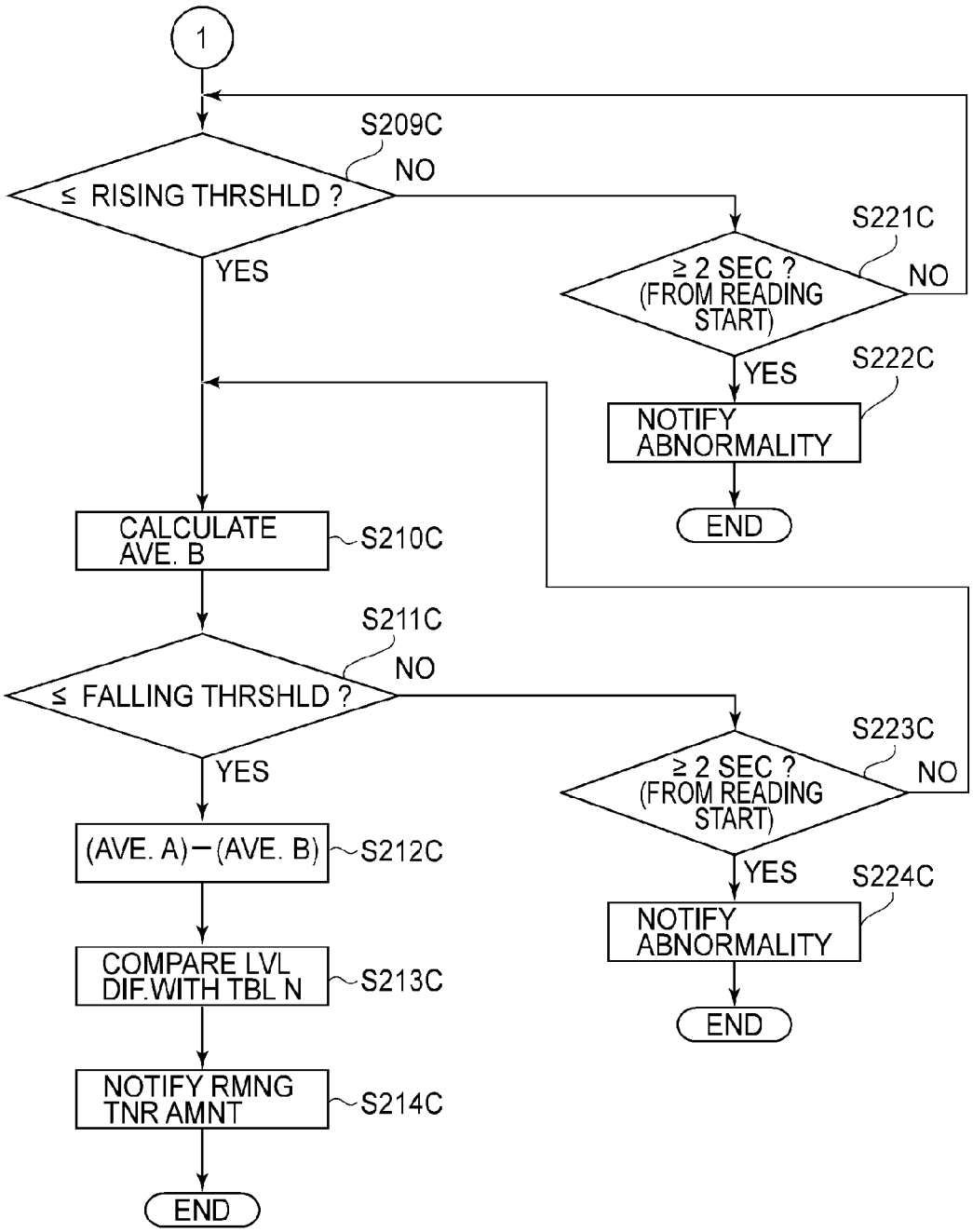

FIGS. 28A and 28B are a flow chart of remaining toner amount detection in Embodiments 9 and 10.

BEST MODE FOR CARRYING OUT THE INVENTION

Embodiment 1

[Image Forming Apparatus]

Figure 1:
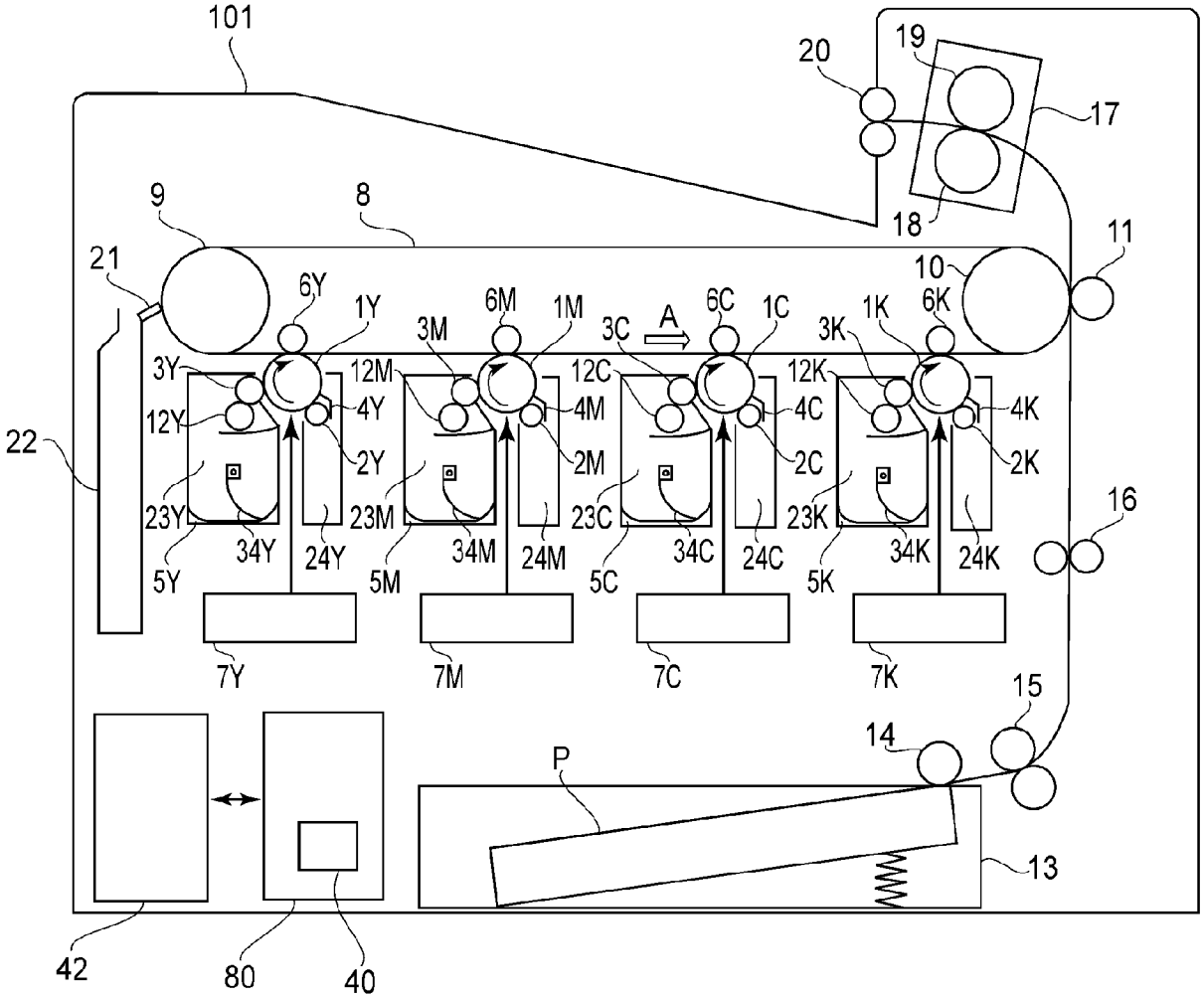
FIG. 1 is a sectional view showing a structure of an image forming apparatus in Embodiments 1 to 3.

FIG. 1 is a sectional view showing a general structure of a color laser printer which is an image forming apparatus in this embodiment. The color laser printer (hereinafter referred to as a main assembly 101) includes process cartridges 5Y, 5M, 5C and 5K which are detachably mountable to the main assembly 101. These four process cartridges 5Y, 5M, 5C and 5K have the same structure but are different in that they form images with developers (hereinafter referred to as toners) of yellow (Y), magenta (M), cyan (C) and black (K), respectively. Hereinafter, the suffixes Y, M, C and K will be omitted in some cases except to the case where the description is made with respect to a specific color. The process cartridge 5 is constituted by 3 units consisting of a developing unit, an image forming unit and a residual toner unit. The developing unit includes a developing roller 3, a toner supplying roller 12, a toner container 23 and a polyester (terephthalate) stirring film stirring (Mylar) 34. Further, the image forming unit includes a photosensitive drum 1 which is an image bearing member, and a charging roller 2. The residual toner unit includes a cleaning blade 4 and a residual toner collecting container 24.

Below the process cartridge 5, a laser unit 7 is provided and exposes the photosensitive drum 1 to light on the basis of an image signal. The photosensitive drum 1 is charged to a predetermined negative potential by the charging roller 2 and then an electrostatic latent image is formed thereon by the laser unit 7. The electrostatic latent image is reversely developed by deposition of the negative toner by the developing roller 3, so that toner images of Y, M, C and K are formed. An intermediary transfer belt unit is constituted by an intermediary transfer belt 8, a driving roller 9 and a secondary transfer opposite roller 10. Inside the intermediary transfer belt 8, a primary transfer roller 6 is provided opposed to an associated photosensitive drum 1, and a transfer bias is applied to the primary transfer roller 6 by a bias applying device (not shown).

The respective photosensitive drums 1 are rotated in arrow directions indicated in the photosensitive drums 1, and the intermediary transfer belt 8 is rotated in an arrow A direction. Then, a positive bias is applied to the primary rollers 6, so that the toner images on the photosensitive drums 1 are successively primary-transferred onto the intermediary transfer belt 8 from the toner image on the photosensitive drum 1Y and then are conveyed to a secondary transfer roller 11 in a superposition state of the four color toner images. A sheet feeding device includes a sheet (paper) feeding roller 14 for feeding a transfer(-receiving) material P from a sheet feeding cassette 13 which accommodates sheets of the transfer material P and a conveying roller pair 15 for conveying the fed transfer material P. The transfer material P fed from the sheet feeding device is conveyed to the secondary transfer roller 11 by a registration roller pair 16.

In the transfer of the toner images from the intermediary transfer belt 8 onto the transfer material P, by applying a positive bias to the primary transfer roller 11, the four color toner images on the intermediary transfer belt 8 are secondary-transferred onto the conveyed transfer material P. The transfer material P after the toner image transfer is conveyed into a fixing device 17 and is heated and pressed by a fixing film 18 and a pressing roller 19, so that the toner images are fixed on the surface of the transfer material P. The transfer material P on which the toner images are fixed is discharged by a discharging roller pair 20. On the other hand, the toner remaining on the surface of the photosensitive drum 1 after the toner image transfer is removed by the cleaning blade, so that the removed toner is collected in the residual toner collecting container 24. Further, the toner remaining on the intermediary transfer belt 8 after the secondary transfer onto the transfer material P is removed by a transfer belt cleaning blade 21, so that the removed toner is collected in a residual toner collecting container 22.

Further, a control board (substrate) 80 in FIG. 1 is a board for effecting control of the main assembly, and on the control board 80, a one-chip microcomputer 40 (hereinafter referred to as CPU) and a storing portion including RAM, ROM and the like for storing data or the like for tables are mounted. The CPU 40 effects integrated control of the operation of the main assembly, such as control of driving sources (not shown) relating to the conveyance of the transfer material P and driving sources (not shown) for the process cartridges 5, control relating to image formation, and control relating to failure detection. A video controller 42 controls light emission of a laser in the laser unit on the basis of image data. Further, the video controller 42 also interfaces with a user via a control panel (not shown). On the control panel, a remaining amount of the toner of each color is displayed in the form of a bar chart (graph).

[Constitution of Developing Unit]

Parts (a) and (b) of FIG. 2 are sectional views each showing a developing unit and an electrostatic capacity sensor substrate 331 which constitute the process cartridge 5, wherein (a) shows a state in which the remaining toner amount is about 50% and (b) shows a state in which the remaining toner amount is about 10%. The toner 28 of a color corresponding to each of Y, M, C and K is stirred by the polyester stirring film 34 accommodated in the developing unit. The polyester stirring film 34 is provided on a rotation shaft 25 and is rotated about the rotation shaft 25 in a direction indicated by an arrow in a toner container 23. Further, the rotation shaft 25 is provided with a polyester (terephthalate) detecting film (detecting Mylar) 351 which is a rotatable member, having flexibility, for detecting the remaining toner amount. As the polyester detecting film 351, a general-purpose Mylar film is used. A thickness of the polyester stirring film 34 was 150 μm, and a thickness of the polyester detecting film 351 was 75 μm. Therefore, the polyester detecting film 351 is larger in warp degree than the polyester stirring film 34. The polyester detecting film 351 is provided with an electroconductive electrode to be detected 361 (member to be detected). Further, an electrostatic capacity sensor electrode 321 for detecting electrostatic capacity functions as a remaining toner amount detecting sensor. The electrostatic capacity sensor electrode 321 is provided in the neighborhood of an outer wall surface of the bottom of the toner container 23 when the process cartridge 5 is mounted in the main assembly 101. On the electrostatic capacity sensor substrate 331, an electrostatic capacity sensor IC 33 is mounted, and the electrostatic capacity sensor electrode 321 and a reference electrode 320 are formed in a copper foil pattern. Further, on the electrostatic capacity sensor substrate 331, peripheral circuit parts of the electrostatic capacity IC 33 are mounted. The electrode to be detected 361 is used for moving electric charges from the electrostatic capacity sensor electrode 321.

As shown in (a) of FIG. 2, when the polyester detecting film 351 is rotated, in the case where the remaining toner amount is large, the polyester detecting film 351 is subjected to physical resistance of the toner to be deformed toward a rear side of a rotational direction, thus being largely flexed (bent). Thus, in the case where the remaining toner amount is large, the polyester detecting film 351 passes through a position remote from the electrostatic capacity sensor electrode 321 and therefore the electrostatic capacity is detected as a low level, so that a time duration in which a detection level exceeds a threshold, i.e., a detection time duration, becomes short. On the other hand, as shown in (b) of FIG. 2, in the case where the remaining toner amount is small, the polyester detecting film 351 is less deformed and passes through a position close to the electrostatic capacity sensor electrode 321 and therefore the electrostatic capacity is detected at a high level, so that the detection time duration also becomes long. In this embodiment, by using this principle, detection of the remaining toner amount is effected. Part (c) of FIG. 2 is a perspective view showing a positional relationship between the polyester detecting film 351 and the electrode to be detected 361. A radial length of the electrode to be detected 361 is 30 mm. The length of each of the polyester detecting film 351 and the electrode to be detected 361 with respect to the direction of the rotation shaft 35 may only be required that the polyester detecting film 351 or the electrode to be detected 361 covers at least the detection surface of the electrostatic capacity sensor electrode 321. The radial length of each of the polyester detecting film 351 and the electrode to be detected 361 is required to be to the extent that an end of the polyester detecting film 351 or the electrode to be detected 361 is contacted to the bottom (surface) of the toner container 23 and is flexed in a state in which there is no toner 28. Further, the polyester detecting film 351 is a member which is softer than that of the polyester stirring film 34 but its material and thickness are not limited to those described above.

[Circuit Diagram of Remaining Toner Amount Detection]

FIG. 3 is a circuit view of the remaining toner amount detection. A bypass capacitor 46 removes noise of an analog power source terminal AVDD of the electrostatic capacity sensor IC 33. Further, a bypass capacitor 47 removes noise of a digital power source terminal DVDD of the electrostatic capacity sensor IC 33. Each of fixed resistors 43 to 45 divides a DC power source voltage of 5.0 and is connected with a THON input terminal or a THOFF input terminal of the electrostatic capacity sensor IC 33, and constants are set so that a voltage of the THON input terminal is 1.4 V and a voltage of the THOFF input terminal is 0.8 V. To an SREF terminal, the reference electrode 320 is connected, and to an SIN 1 terminal, the electrostatic capacity sensor electrode 321 is connected. The reference electrode 320 is a copper foil pattern having the same area as that of the electrostatic capacity sensor electrode 321. The electrode sensor IC 33 outputs level data, which is electric signals obtained by converting a detected electrostatic capacity, from a P01 output terminal and an SDN output terminal to the CPU 40 via a serial communication line.

[Characteristic of Remaining Toner Amount Detection]

Next, a remaining toner amount detection characteristic in this embodiment will be described with reference to (a) to (c) of FIG. 4. Part (a) of FIG. 4 is a waveform data showing a relationship between a detection level of the electrostatic capacity sensor IC 33 and a time (msec) when the remaining toner amount is 10%. The CPU 40 (first measuring means) measures the time duration in which the detection level of the electrostatic capacity sensor IC 33 is 60 or more, so that the time duration is 12.5 msec. Part (b) of FIG. 4 is a characteristic graph showing a relationship between the remaining toner amount (%) and the time duration (msec) in which the detection level of the electrostatic capacity sensor IC 33 is 60 or more. When the remaining toner amount is 0%, the time duration in which the detection level of the electrostatic capacity sensor IC 33 or 60 or more is 13.7 msec. On the other hand, when the remaining toner amount is 100%, the time duration in which the detection level of the electrostatic capacity sensor IC 33 is 60 or more is 8.0 msec. Part (c) of FIG. 4 is a table T showing a relationship between the remaining toner amount (%) and the time duration (msec) in which the detection level of the electrostatic capacity sensor IC 33 is 60 or more. The data of this table T are stored in a storing portion of the control board 80. The remaining toner amount between numerical values in the table is obtained by linear interpolation of known remaining toner amounts. Here, the calculated detection levels are values in this embodiment and therefore when a condition is changed, the calculated detection level is also changed. This is true for the numerical values in the table T for calculating the remaining toner amount.

[Flow Chart of Remaining Toner Amount Detection]

Then, flow of the remaining toner amount detection will be described with reference to a flow chart of FIG. 5. Similarly as in the flow chart of FIG. 5, processing in flow charts in subsequent Embodiments is performed by the CPU 40. However, the present invention is not limited thereto but in the case where e.g., an application-specific integrated circuit (ASIC) is mounted in the image forming apparatus, the ASIC may have a function of any of steps. First, the CPU 40 rotates the polyester stirring film 34 and the polyester detecting film 351 (S101). The CPU 40 performs serial communication with the electrostatic capacity sensor IC 33 to set an initial value and then starts reading of the detection level of the electrostatic capacity sensor IC 33 (S102). In the case where the CPU 40 discriminates that the detection level is 40 or less for 0.5 sec or more (S103, YES), the CPU 40 discriminates that the detection level is an initial state level at a position where there is no electrode to be detected 361. The CPU 40 then discriminates, when the detection level of the electrostatic capacity sensor IC 33 is 60 or more (S104, YES), that a sensor signal rises and sets a timer at zero (S105). The value of 60 used for the discrimination in S104 is a so-called rising threshold. Then, the CPU 40 starts the timer for measuring the time duration (S106). The CPU 40 discriminates, when the detection level of the electrostatic capacity sensor IC 33 is 50 or less (S107, YES) that the sensor signal falls (S108). The value of 50 used for the discrimination in S107 is a so-called falling threshold. Then, the CPU 40 stops the timer (S108). Here, the reason why the detection level rising threshold is 60 and the detection level falling threshold is 50 is that hysteresis is provided and thus a malfunction due to noise is prevented. Next, the CPU 40 reads the timer value (S109) and checks the value against a table T (S110). Then, the CPU 40 notifies a video controller 42 of a remaining toner amount corresponding to the checked value (S111) and then ends the remaining toner amount detection.

Here, a period of the polyester detecting film 351 is about 1 sec in this embodiment. The CPU 40 makes, when it discriminates that a state in which the detection level of is not 40 or less for 0.5 sec or more is continued for 2.0 sec or more (S103, NO and S114, YES), the following discrimination. That is, the CPU 40 discriminates that the electrostatic capacity sensor IC 33 fails, that the electrode to be detected 361 is in a state in which it stops at the detection position or that abnormal communication between the CPU 40 and the electrostatic capacity sensor IC 33 occurs (S115). In this case, the CPU 40 notifies the video controller of the failure, the state or the abnormality (S115) and then ends the remaining toner amount detection. Incidentally, in the case where the CPU 40 discriminates that the state in which the detection level is not 40 or less for 0.5 sec or more is not continued for 2.0 sec or more (S103, NO and S114, NO), the CPU 40 continues the processing of S103. Further, in the case where the CPU 40 discriminates that the detection level is less than 60 in S104 and then 2.0 sec or more elapses (S104, NO and S113, YES), the electrode to be detected 361 cannot be detected and therefore the CPU 50 discriminates that the abnormality occurs, and notifies the video controller 42 of the abnormality (S115) and then ends the remaining toner amount detection. In the case where the CPU 40 discriminates that the detection level is less than 60 in S104 and then 2.0 sec or more do not elapse (S104, NO and S113, NO), the CPU 40 continues the processing of S104. In the case where the CPU 40 discriminates that the detection level is not 50 or less and 2.0 sec or more elapses after the start of the timer (S107, NO and S112, YES), the CPU 40 discriminates that the electrode to be detected 361 is stagnated at the detection position or that the electrostatic capacity sensor IC 33 causes abnormality, and then notifies the video controller 42 of the stagnation or the abnormality (S115) and ends the remaining toner amount detection. Incidentally, in the case where the CPU 40 discriminates that 2.0 sec or more does not elapse from the timer start (S112, NO), the CPU 40 continues the processing of S107.

Incidentally, in the sequence in this embodiment, an example in which the time duration was measured on the basis of an absolute value of the detection level was described. However, a sequence in which a stable initial level is detected and the rising and falling times are measured with the detected level $+\alpha$ as the threshold to detect the time duration and thereafter the measured time duration is checked against the table T may also be employed. Thus, the CPU 40 can detect the remaining toner amount in real time by measuring the time duration in which the electrostatic capacity sensor IC 33 detects the electrode to be detected 361 and then by checking the measured time duration against the table T.

According to this embodiment, by the above-described constitution and operation, the following effects are achieved. First, the time duration in which the electrode to be detected 361 is detected in the remaining toner amount from 100% to 0% is monotonically increased, so that it is possible to detect the remaining toner amount in real time from the full state of the toner to the empty state of the toner. Further, in the electrostatic capacity sensor type, a reaction speed is fast and therefore speed-up of the detection time and the image forming operation can be performed simultaneously. Further, the warpage of the polyester detecting film 351 is stable depending on the remaining toner amount even when the polyester detecting film 351 is rotated at high speed and therefore the remaining toner amount detection can be effected in real time.

As described above, according to this embodiment, the remaining toner amount can be detected in real time from the full state of the toner to the empty state of the toner, and even when the stirring member is operated at high speed, the remaining toner amount can be detect with high accuracy.

Embodiment 2

In Embodiment 1, the remaining toner amount was measured with the time duration in which the electrostatic capacity sensor IC 33 detected the electrode to be detected 361. In this embodiment, the remaining toner amount is measured in a range of e.g., 30% or more (predetermined amount or more), i.e., from 30% to 100% in the type in Embodiment 1 and thereafter in a range of, e.g., less than 30% (less than the predetermined amount), a detection again (sensitivity) of the electrostatic capacity sensor IC 33 is switched and then the level of the electrostatic capacity is detected. Then, on the basis of the detected level of the electrostatic capacity, the CPU (second measuring means) measures the remaining toner amount. Incidentally, the constitutions in FIGS. 1, 2 and 3 described in Embodiment 1 are also applicable to a color laser printer in this embodiment. Further, constituent elements identical to those in Embodiment 1 are represented by the same reference numerals or symbols and will be omitted from detailed description.

[Characteristic of Remaining Toner Amount Detection]

Next, a remaining toner amount detection characteristic in this embodiment will be described with reference to (a) and (b) of FIG. 6. Part (a) of FIG. 6 is a characteristic graph showing a relationship between the remaining toner amount (%) and the detection level of the electrostatic capacity sensor IC 33. When the remaining toner amount is large, the polyester detecting film 351 is subjected to the resistance of the toner 28 and is largely warped, and the electrode to be detected 361 passes through a position remote from the electrostatic capacity sensor electrode 321 and therefore the electrostatic capacity between the electrode to be detected 361 and the electrostatic capacity sensor electrode 321 becomes small. On the other hand, when the amount of the toner 28 is small, the electrode to be detected 361 passes through a position close to the electrostatic capacity sensor electrode 321 and therefore the electrostatic capacity between the electrode to be detected 361 and the electrostatic capacity sensor electrode 321 becomes large. Part (b) of FIG. 6 is a table L showing a relationship between the remaining toner amount (%) and the detection level of the electrostatic capacity sensor IC 33. The data of this table L are stored in a storing portion of the control board 80. Incidentally, the sensitivity of the electrostatic capacity sensor IC 33 for the table L and the sensitivity of the electrostatic capacity sensor IC 33 for the table T in Embodiment 1 are different from each other. For example, the detection level of the electrostatic capacity sensor IC 33 corresponding to the remaining toner amount of 10% in the table L is 190 but the detection level of the electrostatic capacity sensor IC 33 corresponding to the remaining toner amount of 10% in the table T is about 80 which is a different value. The remaining toner amount between numerical values in the table is obtained by linear interpolation of known remaining toner amounts. Here, the calculated detection levels are values in this embodiment and therefore when a condition is changed, the calculated detection level is also changed. This is true for the numerical values in the table L for calculating the remaining toner amount.

[Flow Chart of Remaining Toner Amount Detection]

Then, flow of the remaining toner amount detection in this embodiment after the remaining toner amount becomes less than 30% will be described with reference to a flow chart of FIG. 7.

Here, a period of the polyester detecting film 351 is one turn per about 1 sec also in this embodiment similarly as in Embodiment 1. The processing operations in S201 and S202 are the same as those in S101 and S102 in FIG. 5 and therefore will be omitted from description. In the case where the CPU 40 discriminates that the detection level is 165 or less for 0.5 sec or more, the CPU 40 discriminates that the detection level is the initial state level at the position where there is no electrode to be detected 361 and stores an average of the values during 0.5 sec or more as an initial value (S203, YES and S204). The CPU 40 makes, when it discriminates that the detection level of is not 165 or less for 0.5 sec or more and 2.0 sec or more elapses (S203, NO and S214, YES), the following discrimination. That is, the CPU 40 discriminates that any of the electrostatic capacity sensor IC 33 abnormal and notifies the video controller of the abnormality (S215) and then ends the remaining toner amount detection. Incidentally, in the case where the CPU 40 discriminates that 2.0 sec or more does not elapse from the start of reading of the electrostatic capacity detection level (S214, NO), the CPU 40 continues the processing of SO203.

Next, in order to detect that the electrode to be detected 361 reaches the detection position, the CPU 40 monitors the detection level whether or not the detection level is (initial value)+10 or more (S205). In the case where the CPU 40 discriminates that the detection level is not (initial value)+10 or more and (initial value)±9 is continued for 2.0 sec or more (S213, YES), the CPU 40 discriminates that the polyester detecting film 351 or the electrode to be detected 361 is abnormal and then notifies the video controller 42 of the abnormality (S215) and ends the remaining toner amount detection. Incidentally, in the case where the CPU 40 discriminates that the detection level of (initial value) ±9 does not continued for 2.0 sec or more (S213, NO), the CPU 40 continues the processing of S205. In the case where the CPU 40 discriminates that the detection level is (initial value)+10 or more during the monitoring (S205, YES), the CPU discriminates that the electrode to be detected 361 reaches the detection position, and starts continued reading and then stores a read detection level value (S206). Further, in the case where the CPU 40 discriminates that the detection level of (initial value)+10 or more is continued for 8 msec (S207, YES), the CPU 40 discriminates that the detection level as a normal value and stores its maximum (S208). Incidentally, in the case where the CPU 40 discriminates that the detection level of (initial value)+10 or more is not continued for 8 msec (S207, NO), the CPU 40 continues the processing of S105. In the case where the CPU 40 discriminates that data of the maximum do not correspond to 10 data (S209, NO), the sequence is returned to the processing of S205 (S209).

The CPU 40 calculates, when the data of maximum correspond to 10 data (S209, YES), an average (remaining toner amount detection value) of the 10 data of the maximum (S210) and checks the average against the table L (S211). The CPU 40 obtains the remaining toner amount between numerical values in the table by linear interpolation of known remaining toner amounts. Thereafter, the CPU 40 notifies the video controller 42 of the checked remaining toner amount (S212) and then ends the remaining toner amount detection.

According to this embodiment, by the above-described constitution and operation, the following effects are achieved. First, in the electrostatic capacity sensor type, a reaction speed is fast and therefore speed-up of the detection time and the image forming operation can be performed simultaneously. Further, the warpage of the polyester stirring film 34 is stable depending on the remaining toner amount even when the polyester detecting film 351 is rotated at high speed and therefore the remaining toner amount detection can be effected. Further, by combining the sequence of the time duration detection with timing when the electrostatic capacity is changed in Embodiment 1 with the sequence of the electrostatic capacity level detection in this embodiment, the present invention can meet process cartridges having various constitutions. Incidentally, the remaining toner amount of 0% to 100% may also be detected by only the sequence of the electrostatic capacity level detection.

As described above, according to this embodiment, the remaining toner amount can be detected in real time from the full state of the toner to the empty state of the toner, and even when the stirring member is operated at high speed, the remaining toner amount can be detect with high accuracy.

Embodiment 3

In Embodiments 1 and 2, the process cartridge 5 in which the electrode to be detected 361 was provided with the single polyester detecting film 351 was described as an example. In this embodiment, an example in which the electrode to be detected 361 is divided will be described. With respect to a color laser printer in this embodiment, the constitutions and flow charts in FIGS. 1 and 2 to 7 described in Embodiments 1 and 2 are applied. Further, constituent elements identical to those in Embodiments 1 and 2 are represented by the same reference numerals or symbols and will be omitted from detailed description.

Parts (a) and (b) of FIG. 8 are sectional views each showing a developing unit and an electrostatic capacity sensor substrate 331 which constitute the process cartridge 5 in this embodiment, wherein (a) shows a state in which the remaining toner amount is about 50% and (b) shows a state in which the remaining toner amount is about 10%. The electrode to be detected 361 is divided into two electrodes consisting of an electrode to be detected 361*a* and an electrode to be detected 361*b*. The electrode to be detected 361*a* is provided in the neighborhood of the rotation shaft 25 and the electrode to be detected 361*b* is provided in the neighborhood of an end of the polyester detecting film 351. A length from an edge of the electrode to be detected 361*a* at the rotation shaft 25 side to an edge of the electrode to be detected 361*b* at the polyester detecting film 351 end side is the same as that in Embodiments 1 and 2, i.e., 30 mm ((c) of FIG. 8). By using such a constitution, the electrostatic capacity of the electrode to be detected 361*a* and the electrode to be detected 361*b* in total is detected and therefore the maximum of the detection levels is lowered but the above constitution is applicable in the case where the sensitivity of the electrostatic capacity sensor IC 33 can be ensured.

According to this embodiment, by the above-described constitution and operation, the following effects are achieved. The area of the electrode to be detected 361 becomes small and correspondingly a cost is lowered. Further, in the case where the warp degree of the polyester detecting film 351 is reduced by rigidity of the electrode to be detected 361 when the large electrode to be detected 361 is used as in Embodiments 1 and 2, by employing the electrode to be detected 361*a* and the electrode to be detected 361*a* in this embodiment, a sufficient warp degree can be ensured. Incidentally, in Embodiments 1 and 3, for easy understanding, an example in which reference to the table T was made in one detecting operation was shown. However, by effecting control such that data for plural times of the detection is averaged and thereafter reference to an associated table T is made, further enhancement of the detection accuracy can be expected.

Further, in Embodiments 1 to 3, an example in which the developing unit was integrally constituted was described. However, in a toner container of a supply type in which the developing roller and the toner container is separately provided, by providing the electrode to be detected and the polyester detecting film, the present invention is applicable.

As described above, according to this embodiment, the remaining toner amount can be detected in real time from the full state of the toner to the empty state of the toner, and even when the stirring member is operated at high speed, the remaining toner amount can be detect with high accuracy.

Embodiment 4

A constitution of an image forming apparatus in this embodiment is the same as that described in Embodiment 1 and therefore will be omitted from description.

[Constitution of Developing Unit and Electrostatic Capacity Sensor]

FIG. 9 is a sectional view of a developing unit and an electrostatic capacity sensor, provided in the neighborhood of the bottom of the developing unit, which constitute a process cartridge 5B. Inside the process cartridge 5B shown in FIG. 9, a developing roller 3B and a toner supply roller 12B are provided, and in a toner container 23B, a toner 28B of an associated color and a polyester stirring film 34B for stirring the toner 28B are present. The polyester stirring film 34B (second member) is provided on a rotation shaft 29B in the toner container 23B and performs a circulation operation around the rotation shaft 29B which performs a rotating operation by an unshown motor. Further, the rotation shaft 29B is also provided with a polyester detecting film 351B (first member), having flexibility, for detecting a remaining amount of the toner 28B, and the polyester detecting film 351B is rotatable around the rotation shaft 28B. Further, the polyester detecting film 351B is provided with an electroconductive electrode to be detected 361B (first electrode) in the neighborhood of its circumferential end.

Further, an electrostatic capacity sensor substrate 331B provided in the neighborhood of the bottom of the process cartridge 5B is provided in the main assembly 101 and thereon, an electrostatic capacity sensor 33B and its peripheral circuit parts (not shown) are mounted. The electrostatic capacity sensor 33B detects a change in electrostatic capacity by an electrostatic capacity sensor electrode 321B by using a difference between the electrostatic capacity by the electrostatic capacity sensor electrode 321B and the electrostatic capacity by a reference electrode 320B. On the electrostatic capacity sensor substrate 331B, the electrostatic capacity sensor electrode 321B and the reference electrode 320B are formed in a copper foil pattern. The bottom of an outer casing of the developing unit approaches the electrostatic capacity sensor electrode 321B (second electrode) when the process cartridge 5B is mounted in the main assembly 101. The electrostatic capacity sensor 33B detects, in this state, the electrostatic capacity generated by the approach of the electrode to be detected 361B, provided on the polyester detecting film 351B, toward the electrostatic capacity sensor electrode 321B.

Part (a) of FIG. 10 is a perspective view of the process cartridge 5B. The polyester detecting film 351B is rotatable around the rotation shaft 29B. For that reason, in the case where the polyester detecting film 351B performs the rotating operation in a direction (upward direction) opposite to the gravitation direction, the polyester detecting film 351B is rotated together with the toner 28B by the rotation of the rotation shaft 29B while being raised by the polyester stirring film 34B. On the other hand, in the case where the polyester detecting film 351B performs the rotating operation in the gravitation direction (downward direction), the polyester detecting film 351B falls freely by its own weight, after the toner 28B falls, in advance of the polyester stirring film 34B. Incidentally, a constitution of the polyester detecting film 351B may only be required that the polyester detecting film 351B falls onto the toner 28B after the toner 28B stirred by the polyester stirring film 34B falls and thus is not limited to that shown in (a) of FIG. 10.

Further, the electrostatic capacity sensor 33B and its peripheral circuit parts may also be required to be capable of detecting the electrostatic capacity and thus can be replaced with analog integrated circuit parts. In this embodiment, the electrostatic capacity sensor electrode 321B is formed on the electrostatic capacity sensor substrate 331B provided in the main assembly 101 but may only be required to be provided in the neighborhood of the bottom of the developing unit and may also be directly molded on, e.g., the bottom of the developing unit. In that case, it is preferable that electrical contacts are provided on the electrostatic capacity sensor substrate 331B and the electrostatic capacity sensor electrode 321B so as to electrically connect the electrostatic capacity sensor substrate 331B and the electrostatic capacity sensor electrode 321B when the process cartridge 5B is mounted in the main assembly 101.

[Circuit Constitution of Electrostatic Capacity Sensor]

Part (b) of FIG. 10 is a circuit diagram showing a connection relationship among the electrostatic capacity sensor 33B, the CPU 40, the reference electrode 320B and the electrostatic capacity sensor electrode 321B. In (b) of FIG. 10, AVDD of the electrostatic capacity sensor 33B is an analog power source terminal and DVDD of the electrostatic capacity sensor 33B is a digital power source terminal and in order to remove noise of these power source terminals, bypass capacitors 46B and 47B are provided respectively. To an SREF terminal, the reference electrode 320B is connected, and to an SIN terminal, the electrostatic capacity sensor electrode 321B is connected. Further, between the CPU 40B and the electrostatic capacity sensor 33B, data transfer by serial communication is effected. From the CPU 40B, a clock signal for communication synchronization is supplied to a CL terminal of the electrostatic capacity sensor 33B. Via an SD terminal, from the electrostatic capacity sensor 33B, 8-bit detection data corresponding to a detected value of the electrostatic capacity is outputted. On the other hand, setting data for controlling the electrostatic capacity sensor 33B is inputted from the CPU 40B to the electrostatic capacity sensor 33B via the SD terminal.

As described above, the electrostatic capacity 33B detects the change in electrostatic capacity of the electrostatic capacity sensor 33B by detecting a difference between the electrostatic capacity by the electrode to be detected 361B and the electrostatic capacity sensor electrode 321B and the electrostatic capacity by the reference electrode 320B. The electrostatic capacity sensor 33B is provided with an amplifier circuit for amplifying the detected difference of the electrostatic capacity. The sensitivity of the electrostatic capacity sensor 33B indicating an amplification factor of the amplifier circuit can be set from the CPU 40B to the electrostatic capacity sensor 33B and can be set at 92 levels from 1 to 92. In the case where the sensitivity of the electrostatic capacity sensor 33B is set at 92 which is high, the electrostatic capacity sensor 33B can grasp a more minute change in electrostatic capacity and therefore can detect the electrostatic capacity even when the electrode to be detected 361B is remote from the electrostatic capacity sensor electrode 321B. On the other hand, in the case where the sensitivity of the electrostatic capacity sensor 33B is set at 1 which is low, the electrostatic capacity sensor 33B cannot grasp the change in electrostatic capacity when the change in electrostatic capacity is small and therefore cannot detect the change in electrostatic capacity when the electrode to be detected 361B is remote from the electrostatic capacity sensor electrode 321B. In the electrostatic capacity sensor electrode 321B in this embodiment, a circuit for adjusting the sensitivity is mounted. The electrostatic capacity sensor may only be required to have a constitution capable of changing the sensitivity when the electrostatic capacity between the electrostatic capacity sensor electrode 321B and the electrode to be detected 361B is detected and is not limited to the electrostatic capacity sensor used in this embodiment.

[Operation of Polyester Stirring Film and Polyester Detecting Film]

Parts (a) to (d) of FIG. 11 are sectional views each showing an operation of the polyester stirring film 34B and the polyester detecting film 351B which are used for detecting the remaining amount of the toner 28B in the toner container 23B. Part (a) of FIG. 11 shows an initial state of the rotating operation. The polyester stirring film 34B is in a state in which its end portion is located at a highest point, and the polyester detecting film 351B is rotatable around the rotation shaft 29B and therefore is in a state in which it falls freely and rests on the toner 28B. Part (b) of FIG. 11 shows an intermediate state in which the polyester stirring film 34B performs the rotating operation together with the polyester detecting film 351B. From the state of (a) of FIG. 11, the rotation shaft 29 is rotated and with the rotation, the polyester stirring film 34B is rotated to contact the polyester detecting film 351B which rests on the toner 28B. Then the polyester stirring film 34B performs the upward rotating operation with the polyester detecting film 351B and at the same time the toner 28B is also pushed upward. The toner 28B has flowability and therefore before the polyester stirring film 34B reaches the highest point, the toner 28B start falling from the polyester stirring film 34B onto the bottom of the toner container 23B by its own weight and is gradually accumulated on the bottom of the toner container. Part (c) of FIG. 11 shows a state in which the polyester stirring film 34B reaches the highest point. When the polyester stirring film 34B reaches the highest point together with the polyester detecting film 351B and then the rotation shaft 29B is further rotated, the polyester detecting film 351B is rotatable around the rotation shaft 29B and therefore is spaced from the polyester stirring film 34B to start falling (free fall) onto the surface of the toner 28B accumulated by its own weight. On the other hand, the polyester stirring film 34B is connected with the rotation shaft 29B and therefore follows the polyester detecting film 351B to be gradually lowered while following the rotating operation of the rotation shaft 29B.

Next, (a) to (d) of FIG. 12 are sectional views each showing the state of the polyester stirring film 34B in the case where the remaining amount of the toner 28B is large and in the case where the remaining amount of the toner 28B is small. Parts (a) and (b) of FIG. 12 show an operation state of the polyester stirring film 34B in the case where the remaining amount of the toner 28B is relatively large, wherein (a) corresponds to the state of (b) of FIG. 11 and (b) corresponds to the state of (a) of FIG. 11. In the state of (a) of FIG. 12, the polyester stirring film 34B pushes upward the toner 28B while contacting the polyester detecting film 351B in synchronism with the rotation of the rotation shaft 29B. Then, the toner 28B has flowability and therefore as shown in (a) of FIG. 12, before the polyester stirring film 34B reaches the highest point, the toner 28B starts falling from the polyester stirring film 34B onto the bottom of the toner container 23B by its own weight, thus being gradually accumulated on the bottom of the toner container 23B. Thereafter, when the rotation shaft 29B is rotated and the polyester stirring film 34B reaches the highest point, the polyester detecting film 351B is rotatable around the rotation shaft 29B and therefore starts falling by its own weight. Thus, the polyester detecting film 351B falls after the toner 28B is accumulated on the bottom of the toner container 23B and stops on the surface of the toner 28B. The state of the polyester detecting film 351B at that time is shown in (b) of FIG. 12. In the case where the remaining amount of the toner 28 is large, a height from the bottom of the toner container 23 to the surface of the toner 28B becomes high and therefore a stop position of the polyester detecting film 351B is a position with a height 901.

Next, (c) and (d) of FIG. 12 show an operation state of the polyester stirring film 34B in the case where the remaining amount of the toner 28B is relatively small, wherein (c) corresponds to the state of (b) of FIG. 11 and (d) corresponds to the state of (a) of FIG. 11. In the state of (c) of FIG. 12 as described above, the polyester stirring film 34B pushes upward the toner 28B while contacting the polyester detecting film 351B in synchronism with the rotation of the rotation shaft 29B. In the case where the remaining amount of the toner 28B is large, with later time, i.e., compared with the case where the remaining amount of the toner 28B is large, at a higher position of the end portion of the polyester stirring film 34B, the toner 28B starts falling from the polyester stirring film 34B onto the bottom of the toner container 23B by its own weight, thus being gradually accumulated on the bottom of the toner container 23B. Thereafter, when the rotation shaft 29B is rotated and the polyester stirring film 34B reaches the highest point, the polyester detecting film 351B is rotatable around the rotation shaft 29B and therefore starts falling by its own weight. Thus, the polyester detecting film 351B falls after the toner 28B is accumulated on the bottom of the toner container 23B and stops on the surface of the toner 28B. The state of the polyester detecting film 351B at that time is shown in (d) of FIG. 12. In the case where the remaining amount of the toner 28 is small, a height from the bottom of the toner container 23 to the surface of the toner 28B becomes low and therefore a stop position of the polyester detecting film 351B is a position with a height 902.

Depending on the remaining amount of the toner 28B in the toner container 23B, the surface height of the toner 28B accumulated on the bottom of the toner container 23B is changed and therefore there arises a difference in height of the position where the polyester detecting film 351B] falls by its own eight and stops. As a result, there also arises a difference in electrostatic capacity between the electrostatic capacity sensor electrode 321B and the electrode to be detected 361B provided on the polyester detecting film 351B. Then, the electrostatic capacity 33B detect sensors the difference in electrostatic capacity, so that the CPU 40 can detect a distance between the polyester detecting film 351B and the electrostatic capacity sensor electrode 321B by the detection level from the electrostatic capacity sensor 33B, with the result that the CPU 40 can calculate the remaining amount of the toner 28B.

[Detection Characteristic of Remaining Toner Amount]

Next, with reference to (a) and (b) of FIG. 10, a detection characteristic of the remaining toner amount in this embodiment will be described. Incidentally, in this embodiment, the detection level of the electrostatic capacity sensor 33B is outputted to the CPU 40B as 8-bit data. In the following description, the detection level is represented by decimal number.

Part (a) of FIG. 13 is a characteristic graph showing a relationship between the remaining amount of the toner 28B in the toner container 23B and the detection level of the electrostatic capacity sensor 33B, wherein the ordinate represents the detection level and the abscissa represents the remaining toner amount (%). The sensitivity of the electrostatic capacity sensor 33B in (a) of FIG. 13 is set at 69 from the CPU 40 by using the serial communication. As shown in the characteristic graph of (a) of FIG. 13, in this embodiment, when the remaining amount of the toner 28B in the toner container 23B is 100%, the detection level of the electrostatic capacity sensor 33B is 135. On the other hands, when the remaining amount of the toner 28B is 0%, the detection level of the electrostatic capacity sensor 33B is 253.

Part (b) of FIG. 13 is a table T1 obtained by tabulating a corresponding relation between the detection level of the electrostatic capacity sensor 33B and the remaining toner amount (%) from the characteristic graph of (a) of FIG. 13. The remaining amount of the toner 28B corresponding to the detection level which is not explicitly shown in the table T1 can be obtained by linear interpolation of known remaining amounts of the toner 28B shown in the table T1. Here, the measured detection levels are values in this embodiment and therefore vary when a measuring condition is changed. This is also true for the numerical values in the table T1 for discriminating the remaining amount of the toner 28B. The information of the table T1 is written in advance in ROM of a storing portion or ROM provided in the process cartridge 5B at a factory and then is shipped. Then, the information written in ROM provided in the process cartridge 5B is read by the CPU 40B when the process cartridge 5B is mounted in the main assembly 101, thus being stored in RAM of the storing portion of the control board 80. Also in Embodiments 5 and 7 described later, the table information is stored (recorded) in ROM or RAM of the storing portion by these methods. Incidentally, the above method of recording the table information during the shipping is an example and therefore the present invention is not limited to the above-described methods.

[Processing Sequence of Remaining Toner Amount Detection]

Next, a processing sequence of the remaining toner amount detection in this embodiment will be described by using a flow chart of FIG. 14. The processing shown in FIG. 14 is executed by the CPU 40B on the basis of a control program stored in ROM of the storing portion and also in subsequent Embodiments, processing in each flow chart is similarly executed by the CPU 40B. Incidentally, in the case where all the processing operations shown in the flow chart are not performed by the CPU 40B but, e.g., an application-specific integrated circuit (ASIC) is mounted in the image forming apparatus, a function of executing any of the processing operations in the flow chart may also be performed by the ASIC.

In step 101B (S101B), the CPU 40B causes the polyester stirring film 34B to perform the rotating operation. In this embodiment, a time required for the polyester stirring film 34B to rotate one turn is about 1 sec. In S102B, the CPU 40B makes the serial communication with the electrostatic capacity sensor 33B to set the sensitivity of the electrostatic capacity sensor 33B at 69. Then the CPU 40B resets the timer and then starts the timer and at the same time starts reading of the detection level.

In S103B, the CPU 40B receives reading data of the detection level from the electrostatic capacity sensor 33B through the serial communication. In S104B, the CPU 40B discriminates whether or not the polyester detecting film 351B starts the free fall by its own weight from the detection level depending on the electrostatic capacity between the electrostatic capacity sensor electrode 321B and the electrode to be detected 361B provided on the polyester detecting film 351B. Here, with reference to FIG. 15, a state in which the detection level of the electrostatic capacity sensor 33B is changed by the free fall of the polyester detecting film 351B by its own weight will be described. FIG. 15 is a graph showing a state of progression of the detection level of the electrostatic capacity sensor 33B with the lapse of time by the free fall of the polyester detecting film 351B, wherein the ordinate represents the electrostatic capacity sensor detection level and the abscissa represents the time (sec). In FIG. 15, t1 represents timing when the polyester stirring film 34B is rotated to start a detecting operation by the electrostatic capacity sensor 33B, and t2 represents timing when the polyester detecting film 351B raised to the highest point by the polyester stirring film 34B starts the free fall by its own weight. Until t2, the electrode to be detected 361B provided on the polyester detecting film 351B is remote from the electrostatic capacity sensor electrode 321B and therefore the detection level outputted from the electrostatic capacity sensor 33B to the CPU 40B is a low level (10 or less). However, when the polyester detecting film 351B starts the free fall, the distance between the electrode to be detected 361B and the electrostatic capacity sensor electrode 321B is quickly shortened and therefore the detection level outputted from the electrostatic capacity sensor 33B to the CPU 40B is correspondingly increased. Then, when the polyester detecting film 351B falls onto the toner 28B and stops on the toner 28B, the distance between the electrode to be detected 361B and the electrostatic capacity sensor electrode 321B becomes constant and therefore the detection level of the electrostatic capacity sensor 33B is also stabilized at a certain value. In this embodiment, as shown at t3 in FIG. 15, a rising threshold which indicates the start of the free fall of the polyester detecting film 351B is set at 50 by the CPU 40B. Further, from the low level (10 or less), by the detection of the timing (t3) when the detection level exceeds the rising threshold, the CPU 40B detects that the polyester detecting film 351B starts the free fall by its own weight.

In S104B, in the case where the CPU 40B discriminates that the electrostatic capacity between the electrode to be detected 361B and the electrostatic capacity sensor electrode 321B is not a certain value or more and thus discriminates that the rising of the detection level is not detected, the sequence goes to S108B. In S104B, in the case where the CPU 40B discriminates that the detection level rising is detected, the sequence goes to S105B. In S105B, the CPU 40B discriminates whether or not the polyester detecting film 351B which starts the free fall falls onto the toner 28B and stops on the toner surface. In this embodiment, when a fluctuation of the detection level outputted from the electrostatic capacity sensor 33B is 2 or less for 0.05 sec (50 milliseconds) or more, the CPU 40B discriminates that the polyester detecting film 351B stops on the toner surface. Incidentally, setting of a width and time of the fluctuation of the detection level of the electrostatic capacity sensor 33B for detecting the timing when the polyester detecting film 351B stops on the toner surface varies depending on the developing unit constitution, the electrostatic capacity sensor and the peripheral circuit and therefore is not limited to the above-described setting. In S105B, in the case where a state in which the fluctuation width, of the detection level outputted from the electrostatic capacity sensor 33B to the CPU 40B, of 2 or less is continued for 0.05 sec or more, the sequence by the CPU 40 goes to S106B, and in the case where the fluctuation width is not continued for 0.05 sec or more, the sequence goes to S108B.

In S108B, the CPU 40B reads a timer value from the timer and discriminates whether or not 2 sec or more elapses from the start of the reading of the detection level by the electrostatic capacity sensor 33B. When the lapse of time is less than 2 sec, the sequence returns to S103B. In the case where 2 sec or more elapses, the sequence by the CPU 40 goes to S109B. In S109B, from the fact that the detection level of the electrostatic capacity sensor 33B does not exceed the rising threshold for 2 sec or more, the CPU 40B discriminates that the electrostatic capacity sensor 33B is abnormal, and then notifies the video controller 42 of the abnormality of the electrostatic capacity sensor 33B.

In S106B, the CPU 40B checks the detection level outputted from the electrostatic capacity sensor 33B in S103B against the detection level of the table T1 stored in ROM of the storing portion, thus calculating a corresponding remaining amount of the toner 28B. In S107B, the CPU 40B notifies the video controller 42 of the remaining amount of the toner 28B calculated in S106B.

As described above, according to this embodiment, the remaining amount can be detected in real time with high accuracy and with a simple constitution irrespective of the magnitude of the toner amount. In this embodiment, by detecting the electrostatic capacity between the electrode to be detected of the polyester detecting film and the electrostatic capacity sensor electrode provided in the neighborhood of the bottom of the developing unit, the remaining toner amount corresponding to the electrostatic capacity can be calculated, with the result that the remaining amount can be detected from the full state of the toner to the empty state of the toner.

Embodiment 5

In Embodiment 4, the remaining toner amount was calculated by detecting the electrostatic capacity between the electrode to be detected of the polyester detecting film and the electrostatic capacity sensor electrode in the neighborhood of the bottom of the developing unit in a state in which the sensitivity of the electrostatic capacity sensor was constant. On the other hand, in this embodiment, an example in which the detection accuracy of the remaining toner amount is further improved more than Embodiment 4 by changing the sensitivity of the electrostatic capacity sensor depending on the remaining toner amount will be described. Incidentally, the constitution in FIG. 1, the constitutions in FIGS. 9 and 10 described in Embodiment 4 and the detecting operation in FIGS. 11 and 12 are also applied in this embodiment. Further, constituent elements identical to those in Embodiment 4 are represented by the same reference numerals or symbols and will be omitted from description since detailed description thereof is made in Embodiment 4.

[Detection Characteristic of Remaining Toner Amount]

Part (a) of FIG. 16 is a characteristic graph showing a relationship between the remaining amount of the toner 28B and the detection level of the electrostatic capacity sensor 33B for each of values of the sensitivity set for the electrostatic capacity sensor 33B, wherein the ordinate represents the detection level and the abscissa represents the remaining toner amount (%). In (a) of FIG. 16, plotted curves indicated by a solid line, a chain double-dashed line and a broken line show characteristics, between the remaining amount of the toner 28B and the detection level of the electrostatic capacity sensor 33B, at sensitivity values of 46, 69 and 92, respectively.

When the characteristic graph in the case of the sensitivity of 69 in (a) of FIG. 16 is viewed, it is understood that in a region where the remaining amount of the toner 28B is 25% or less and in a region where the remaining amount of the toner 28B is 60% or more, a proportion of a change in detection level of the electrostatic capacity sensor 33B to a change in remaining toner amount becomes small and thus it is difficult to discriminate the remaining toner amount with high accuracy.

When the characteristic graph in the case of the sensitivity of 92 is viewed, compared with the characteristic graph of the sensitivity of 69, in a region 903 where the remaining amount of the toner 28B is large (60% to 100%), the proportion of the change in detection level of the electrostatic capacity sensor 33B to the change in remaining toner amount is large. On the other hand, when the characteristic graph in the case of the sensitivity of 46, compared with the characteristic graph of the sensitivity of 69, in a region 904 where the remaining amount of the toner 28B is small (0% to 25%), the proportion of the change in detection level of the electrostatic capacity sensor 33B to the change in remaining toner amount is large. Therefore, when the electrostatic capacity is detected by setting the sensitivity so that large sensitivity is set for the electrostatic capacity sensor 33B in the region 903 and so that smaller sensitivity is set for the electrostatic capacity sensor 33B in the region 904, it is possible to improve the detection accuracy of the remaining amount of the toner 28B more than the case of Embodiment 4.

Part (b) of FIG. 16 is a characteristic graph obtained by dividing the region of the characteristic graph of (a) of FIG. 16 into three regions depending on the sensitivity set during the electrostatic capacity detection. In this embodiment, the sensitivity set for the electrostatic capacity sensor 33B is set so that the sensitivity in a region 905 where the remaining toner amount is less than 25% is 46, the sensitivity in a region 906 where the remaining toner amount is 25% or more and less than 60% is 69 and the sensitivity in a region 907 where the remaining toner amount is 60% or more is 92. Incidentally, the sensitivity set depending on the remaining toner amount varies depending on the developing unit constitution, the electrostatic capacity sensor 33B and the peripheral circuit and therefore is not limited to the numerical values set in this embodiment.

Each of tables T1 to T3 of (a) to (c) of FIG. 17 is a table obtained by tabulating a corresponding relation between the detection level of the electrostatic capacity sensor 33B and the remaining toner amount (%) from the characteristic graph of (a) of FIG. 16. The tables T1, T2 and T3 of (a), (b) and (c) of FIG. 17, respectively are obtained by tabulating the characteristic graphs of the sensitivity values of 69, 46 and 92, respectively. The remaining amount of the toner 28B corresponding to the detection level which is not explicitly shown in each table can be obtained by linear interpolation of known remaining amounts of the toner 28B shown in the table. Here, the measured detection levels are values in this embodiment and therefore vary when a measuring condition is changed. This is also true for the numerical values in each table for discriminating the remaining amount of the toner 28B.

[Processing Sequence of Remaining Toner Amount Detection]

Next, a processing sequence of the remaining toner amount detection in this embodiment will be described by using a flow chart of FIG. 18. The processing operations in S201B to S205B, S212B and S213B in FIG. 18 are the same as S101B to S105B, S108B and S109B in FIG. 14 in Embodiment 4 and therefore will be omitted from description.

The S206B, as described above, in order to set the sensitivity of the electrostatic capacity sensor 33B depending on the remaining amount of the toner 28B, the CPU 40B discriminate the remaining toner amount at the sensitivity of 69 from the detection level outputted from the electrostatic capacity sensor 33B in S203B. In the case where the CPU 40B discriminates that the detection level is more than 225 and thus the remaining amount of the toner 28B at the sensitivity of 69 is less than 25%, the sequence by the CPU 40B goes to S 207B. In S207B, the sensitivity of the electrostatic capacity sensor 33B is switched to 46 and then the sequence goes to S210B. In S206B, in the case where the CPU 40B discriminates that the detection level is 225 or less, the sequence by the CPU 40B goes to S208B. In S208B, the CPU 40B discriminates whether or not the detection level is larger than 155. In the case where the detection level is larger than 155, the remaining amount of the toner 28B is 25% or more and less than 60% and therefore the CPU 40B does not perform the sensitivity switching operation while keeping the sensitivity of the electrostatic capacity sensor 33B at 69, so that the sequence goes to S210B. In the case where the detection level is 155 or less, the CPU 40B discriminates that the remaining amount of the toner 28B is 60% or more, and the sequence by the CPU 40B goes to S209B. In S209B, the sensitivity of the electrostatic capacity sensor 33B is switched to 92, and the sequence goes to S210B.

In S210B, by using the sensitivity depending on the remaining amount of the toner 28B determined by the processing operations from S206B to S209B, the CPU 40B reads again the detection level from the electrostatic capacity sensor 33B.

Then, the CPU 40B checks the read detection level against the detection level of the table corresponding to the sensitivity stored in ROM of the storing portion, thus calculating a corresponding remaining amount of the toner 28B. In S211B, the CPU 40B notifies the video controller 42 of the remaining amount of the toner 28B calculated in S210B.

As described above, according to this embodiment, the remaining amount can be detected in real time with high accuracy and with a simple constitution irrespective of the magnitude of the toner amount. That is, the sensitivity of the electrostatic capacity sensor is switched depending on the remaining toner amount and then the remaining toner amount is calculated from the table depending on the sensitivity and from the detection level of the electrostatic capacity sensor, so that the remaining toner amount detection accuracy can be further improved more than the case of Embodiment 4.

Embodiment 6

In Embodiment 4, the remaining toner amount was calculated by detecting the electrostatic capacity between the electrode to be detected of the polyester detecting film and the electrostatic capacity sensor electrode in the neighborhood of the bottom of the developing unit in a state in which the sensitivity of the electrostatic capacity sensor was constant. Further, in Embodiment 5, the detection accuracy of the remaining toner amount was improved more than Embodiment 4 by changing the sensitivity of the electrostatic capacity sensor depending on the remaining toner amount. In this embodiment, an example wherein in a state in which the polyester detecting film stops on the toner surface, the sensitivity of the electrostatic capacity sensor is swept and then the remaining toner amount is calculated from a value of the sensitivity when a target value of the detection level coincides with a measure value of the detection value, thus further improving the remaining toner amount detection accuracy will be described. Further, in Embodiments 4 and 5, in the state in which the polyester detecting film performed the rotating operation, the remaining toner amount detection was performed in real time. However, in this embodiment, it takes much time to sweep the sensitivity of the electrostatic capacity sensor and therefore in the state in which the polyester detecting film stops on the toner surface, the rotating operation of the polyester detecting film is stopped and then the remaining amount detection is performed. Incidentally, the constitution in FIG. 1, the constitutions in FIGS. 9 and 10 described in Embodiment 4 and the detecting operation in FIGS. 11 and 12 are also applied in this embodiment. Further, constituent elements identical to those in Embodiment 4 are represented by the same reference numerals or symbols and will be omitted from description.

[Detection Characteristic of Remaining Toner Amount]

Part (a) of FIG. 19 is a characteristic graph showing a relationship between the sensitivity of the electrostatic capacity sensor and the remaining amount of the toner 28B for which the target value and the measured value of the detection level of the electrostatic capacity sensor 33B coincide with each other when the sensitivity is swept, wherein the ordinate represents the sensitivity and the abscissa represents the remaining toner amount (%). In this embodiment, the detection level target value of the electrostatic capacity sensor 33B is set at 150. For example, a point 908 in (a) of FIG. 19 shows that the sensitivity of the electrostatic capacity sensor 33B is swept when the remaining amount of the toner 28B is 66%, and the sensitivity of the electrostatic capacity sensor 33B is 69 when the electrostatic capacity sensor detection level is the target value of 150. Also points 909 and 910 show similar results. The point 909 shows that the sensitivity of the electrostatic capacity sensor 33B is 46 when the remaining amount of the toner 28B is 35%, and the point 910 shows that the sensitivity of the electrostatic capacity sensor 33B is 92 when the remaining amount of the toner 28B is 100%. As a result, when the relationship between the remaining toner amount and the electrostatic capacity sensor sensitivity when the detection level of the electrostatic capacity sensor 33B is 150 is plotted depending on the respective remaining amounts of the toner 28B, the characteristic graph of (a) of FIG. 19 is obtained. This characteristic graph shows linearity with respect to the relationship between the remaining amount of the toner 28B and the detected sensitivity of the electrostatic capacity sensor 33B and therefore it becomes possible to detect the remaining toner amount in real time with accuracy higher than those in Embodiments 4 and 5 from the full state of the toner to the empty state of the toner. Incidentally, the used detection level target value of the electrostatic capacity sensor 33B and the used relationship between the remaining toner amount and the sensitivity in this embodiment vary depending on the developing unit constitution, the electrostatic capacity sensor and the peripheral circuit and therefore are not limited to the above-described numerical values and the characteristic graphs.

Part (b) of FIG. 19 is a table T4 obtained by tabulating a corresponding relation between the sensitivity level of the electrostatic capacity sensor 33B and the remaining toner amount (%) from the characteristic graph of (a) of FIG. 19. The remaining amount of the toner 28B corresponding to the sensitivity which is not explicitly shown in each table T4 can be obtained by linear interpolation of known remaining amounts of the toner 28B shown in the table T4. Here, the measured values of the sensitivity of the electrostatic capacity sensor 33B are values in this embodiment and therefore vary when a condition of the electrostatic capacity sensor 33B, the peripheral circuit or the like is changed. This is also true for the numerical values in the table T4 for discriminating the remaining amount of the toner 28B.

[Processing Sequence of Remaining Toner Amount Detection]

Next, a processing sequence of the remaining toner amount detection in this embodiment will be described by using a flow chart of FIG. 20. The processing operations in S301B to S304B, S314B and S316B in FIG. 20 are the same as S101B to S104B, S108B and S109B in FIG. 14 in Embodiment 4 and therefore will be omitted from description.

In S304B, in the case where the CPU 40B discriminates that the detection level rising is detected, the sequence goes to S305B. In S305B, the CPU 40B stops the rotation of the polyester stirring film 34B before the polyester stirring film 34B rotates and contacts the polyester detecting film 351B. The reason why the rotation of the polyester stirring film 34B is stopped in that a time is required for the CPU 40B to sweep the sensitivity of the electrostatic capacity sensor 33B from 1 to 92 thereby to read the detection level in the state in which the polyester detecting film 351B stops on the toner surface in the toner container 23B. Incidentally, in the case where the time required for the CPU 40B to sweep the sensitivity of the electrostatic capacity sensor 33B thereby to read the detection level is shorter than a time for which the polyester detecting film 351B stops on the toner surface, the remaining amount detection may also be effected while rotating the polyester stirring film 34B. In S396B, the CPU 40B discriminates whether or not the polyester detecting film 351B which starts the free fall falls onto the toner 28B and stops on the toner surface. Also in this embodiment, similarly as in Embodiments 4 and 5, when a fluctuation of the detection level outputted from the electrostatic capacity sensor 33B is 2 or less for 0.05 sec (50 milliseconds) or more, the CPU 40B discriminates that the polyester detecting film 351B stops on the toner surface. Incidentally, setting of a width and time of the fluctuation of the detection level of the electrostatic capacity sensor 33B for detecting the timing when the polyester detecting film 351B stops on the toner surface varies depending on the developing unit constitution, the electrostatic capacity sensor and the peripheral circuit and therefore is not limited to the above-described setting. In the case where a state in which the fluctuation width, of the detection level outputted from the electrostatic capacity sensor 33B to the CPU 40B, of 2 or less is continued for 0.05 sec or more, the sequence by the CPU 40 goes to S307B, and in the case where the fluctuation width is not continued for 0.05 sec or more, the sequence goes to S315B. In S315B, the CPU 40B reads a timer value from the timer and discriminates whether or not 2 sec or more elapses from the start of the reading of the detection level by the electrostatic capacity sensor 33B. When the lapse of time is less than 2 sec, the sequence returns to S306B. In the case where 2 sec or more elapses, the sequence by the CPU 40 goes to S316B. In S316B, from the fact that the detection level of the electrostatic capacity sensor 33B does not exceed the rising threshold for 2 sec or more, the CPU 40B discriminates that the electrostatic capacity sensor 33B is abnormal, and then notifies the video controller 42 of the abnormality of the electrostatic capacity sensor 33B.

In S307B, in order to continuously read the electrostatic capacity sensor detection level by sweeping the sensitivity of the electrostatic capacity sensor 33B, the CPU 140B makes the serial communication with the electrostatic capacity sensor 33B, thus setting the electrostatic capacity sensor sensitivity at 1 as an initial value.

In S308B, the CPU 40B discriminates whether or not the sensitivity set for the electrostatic capacity sensor 33B through the serial communication is 92 or less. In the case where the set sensitivity of the electrostatic capacity sensor 33B is larger than 92, the sequence goes to S316B, in which the CPU 40B notifies the video controller 42 of the abnormality of the electrostatic capacity sensor 33B. In the case where the sensitivity is 92 or less, the sequence goes to S309B, in which the CPU 40B reads again the detection level and in S310B, comparison with the detection level target value of 150 is made. Here, in the case where the measured value and the target value of the detection level of the electrostatic capacity sensor 33B coincide with each other, the sequence by the CPU 40B goes to S312B. In S310B, the detection level measured value and target value do not coincide, the sequence by the CPU 40B goes to S311B, in which the CPU 40B makes the serial communication with the electrostatic capacity sensor 33B and increments the sensitivity of the electrostatic capacity sensor 33B by 1 and then the sequence returns to S308B.

In S312B, the CPU 40B checks the value of the sensitivity of the electrostatic capacity sensor 33B set at that time against the sensitivity of the table T1 stored in ROM of the storing portion, thus calculating a corresponding remaining amount of the toner 28B. In S313B, the CPU 40B notifies the video controller 42 of the remaining amount of the toner 28B calculated in S312B.

As described above, according to this embodiment, the remaining amount can be detected in real time with high accuracy and with a simple constitution irrespective of the magnitude of the toner amount. That is, in the state in which the polyester detecting film stops on the toner surface, the electrostatic capacity sensor sensitivity is swept and then the remaining toner amount is detected from the sensitivity when the detection level target value and measured value coincide with each other, so that the remaining toner amount detection accuracy can be improved more than Embodiments 4 and 5.

Incidentally, in Embodiments 4 to 6, for easy understanding, description such that the electrostatic capacity sensor detection level obtained by a single detecting operation was checked against the table was made. However, by effecting control such that data for plural times of the detection is averaged and thereafter reference to an associated table is made, further enhancement of the detection accuracy can be expected.

Further, in Embodiments 4 to 6, an example in which the developing unit was integrally constituted was described. However, in a toner container of a supply type in which the developing roller and the toner container is separately provided, by providing the electrode to be detected and the polyester detecting film, the present invention is applicable.

Embodiment 7

A constitution of an image forming apparatus in this embodiment is the same as that described in Embodiment 1 and therefore will be omitted from description.

[Constitution of Developing Unit and Electrostatic Capacity Sensor]

Part (a) of FIG. 21 is a sectional view of a developing unit and an electrostatic capacity sensor substrate 331B which constitute a process cartridge 5C. Inside the process cartridge 5C shown in (a) of FIG. 21, a toner container 23C, a toner 28C of an associated color and a polyester stirring film 34C for stirring the toner 28C in the toner container 23C are provided. The polyester stirring film 34C (stirring) is provided on a rotation shaft 29C in the toner container 23C and performs a circulation rotation (circulation operation). The rotation shaft 29C is also provided with a polyester detecting film 351C (first member), having flexibility, for detecting a remaining amount of the toner 28B, and a polyester detecting film 352C (second member). The polyester detecting film 352C is provided 90 degrees (predetermined angle) behind the polyester detecting film 351C with respect to the rotational direction. Incidentally, this angle is not limited to 90 degrees. That is, the angle may only be required to cause a difference between a time difference between detection times of the polyester detecting film 351C and 352C by an electrostatic capacity sensor IC 33C described later and a time difference between detection times of the polyester detecting films 352C and 351C by the electrostatic capacity sensor IC 33C. Details will be described in processing along a flow chart of FIG. 25 described later. Further, the angle may be an angle at which the polyester detecting films 351C and 352C do not contact each other.

As the polyester detecting films 351C and 352C, a general-purpose Mylar film is used. In this embodiment, thickness of the polyester detecting films 351C and 352C are 150 μm and 75 μm, respectively. A difference in warp degree is realized by changing the thicknesses of the polyester detecting films 351C and 352C and therefore the polyester detecting film 352C has a larger warp degree than the polyester detecting film 351C. Incidentally, such a constitution that the warp degree of the polyester detecting film 352C is made larger than the warp degree of the polyester detecting film 351C by, e.g., changing the material for the polyester detecting films 351C and 352C so that the warp degree of the polyester detecting film 352C is larger than that of the polyester detecting film 351C may be employed. Further, the polyester detecting films 351C and 352C are provided with an electroconductive electrode to be detected 361C (first electrode) and an electroconductive electrode to be detected 361C (second electrode), respectively, in the neighborhood of their ends with respect to their circumferential directions (perpendicular to their rotational axis directions).

Further, the electrostatic capacity sensor substrate 331C shown in (a) of FIG. 21 is provided with the following members.

On the electrostatic capacity sensor substrate 331C provided in the main assembly 101, the electrostatic capacity sensor IC 33C (output means) and its peripheral circuit parts (not shown) are mounted. The electrostatic capacity sensor IC 33C in this embodiment, e.g., detects a change in electrostatic capacity by an electrostatic capacity sensor electrode by using a difference between the electrostatic capacity by the electrostatic capacity sensor electrode and the electrostatic capacity by a reference electrode. On the electrostatic capacity sensor substrate 331C, the electrostatic capacity sensor electrode 321C (third electrode) and the reference electrode 320C are formed in a copper foil pattern. The bottom of an outer casing of the developing unit approaches the electrostatic capacity sensor electrode 321C when the process cartridge 5C is mounted in the main assembly 101. The electrostatic capacity sensor IC 33C detects, in this state, a change in electrostatic capacity generated by the approach of the electrodes to be detected 361C and 362C, provided on the polyester detecting films 351C and 352C, toward the electrostatic capacity sensor electrode 321C.

Incidentally, the electrostatic capacity sensor IC 33C and its peripheral circuit parts may also be required to be capable of detecting the electrostatic capacity and thus can be replaced with analog integrated circuit parts. Further, in this embodiment, the electrostatic capacity sensor electrode 321C is formed on the electrostatic capacity sensor substrate 331C provided in the main assembly 101 but may only be required to be provided in the neighborhood of a wall surface of the developing unit and may also be directly molded on, e.g., the wall surface of the developing unit. In that case, it is preferable that electrical contacts are provided on the electrostatic capacity sensor substrate 331C and the electrostatic capacity sensor electrode 321C so as to be electrically connected when the process cartridge 5C is mounted in the main assembly 101.

Part (b) of FIG. 21 is a perspective view showing a positional relationship between the polyester detecting film 351C and the electrode to be detected 361C. A similar constitution is also employed for the polyester detecting film 352C and the electrode to be detected 362C. A length of each of the electrodes to be detected 361C and 362C in the circumferential direction (perpendicular to the rotation shaft 29C) is 30 mm.

A length of each of the polyester detecting films 351C and 352C and the electrodes to be detected 361C and 362C in the axial direction (longitudinal direction) of the rotation shaft 29C may be at least a length in which the detection surface of the electrostatic capacity sensor IC 33C is covered. Incidentally, with respect to the length in the circumferential direction, in this embodiment, the polyester detecting film 352C is longer than the polyester detecting film 351C. The circumferential length of the polyester detecting film 351C is set at a length to the extent that the polyester detecting film 351C contacts the side wall surface of the toner container 23C and on the other hand, the circumferential length of the polyester detecting film 352C is set at a length in which the polyester detecting film 352C contacts the bottom of the process cartridge 5C. However, the lengths of the polyester detecting films 351C and 352C are set so that the polyester detecting films do not contact each other during stirring of the toner. A length of the polyester stirring film 34C is set so as to sufficiently stir the toner in the process cartridge 5C. Further, the polyester stirring film 34C and the polyester detecting film 352C are disposed at an angle of about 180 degrees in (a) of FIG. 21 and are constituted so that after the toner is stirred by the polyester stirring film 34C, the polyester detecting film 352C is detected after the state of the toner is stabilized to some extent. That is, their arrangement may only be required that the detection of the electrode to be detected 362C of the polyester detecting film 352C can be effected in a state in which the toner is stabilized to some extent after the toner stirring by the polyester stirring film 34C, and the angle is not limited to 180 degrees. The polyester detecting film 352C is disposed 90 degrees behind the polyester detecting film 351C with respect to the rotational direction and is formed with a member softer than that for the polyester detecting film 351C but the present invention is not limited to this arrangement, material and thickness.

[Circuit Diagram of Remaining Toner Amount Detection]

FIG. 22 is a circuit view of the remaining toner amount detection in this embodiment. A bypass capacitor 46*c* is used for removing noise of an analog power source terminal AVDD of the electrostatic capacity sensor IC 33C. Further, a bypass capacitor 47C is used for removing noise of a digital power source terminal DVDD of the electrostatic capacity sensor IC 33C. To an SREF terminal of the electrostatic capacity sensor IC 33C, the reference electrode 320C is connected, and to an SIN 1 terminal, the electrostatic capacity sensor electrode 321C is connected. The reference electrode 320C is a copper foil pattern having the same area as that of the electrostatic capacity sensor electrode 321C. The electrode sensor IC 33C effects data transfer between itself and the CPU 40C through the serial communication. The CPU 40C outputs a clock signal, for communication synchronization, to an SCL terminal of the electrostatic capacity sensor IC 33C. On the other hand, the electrostatic capacity sensor IC 33 outputs data (information on the electrostatic capacity) of 8 bit-detection level corresponding to a detected value of the electrostatic capacity, to the CPU 40C via an SDA terminal. Incidentally, a detailed operation principle of the electrostatic capacity sensor IC 33 is a known art and therefore will be omitted.

[Operation of Polyester Detecting Film]

With reference to (a) and (b) of FIG. 23, operations of the polyester detecting films 351C and 352C in the case where the remaining toner amount is relatively large and in the case where the remaining toner amount is relatively small will be described. When the polyester detecting films 351C and 352C perform the rotating operation, as shown in (a) of FIG. 23, in the case where the remaining toner amount is relatively large, each of the polyester detecting films 351C and 352C is subjected to the resistance of the toner and is deformed toward a rear side with respect to the rotational direction which is an arrow direction in the figure, thus performing the rotating operation while being warped. In this case, the warp degree of the polyester detecting film 352C is larger than that of the polyester detecting film 351C, so that the polyester detecting film 352C is largely deformed toward the rotational direction rear side. In this state a difference between a time when the polyester detecting film 351C reaches above the detection surface of the electrostatic capacity sensor electrode 321C and a time when the polyester detecting film 352C reaches above the detection surface of the electrostatic capacity sensor electrode 321C (hereinafter, the difference is referred to as a time difference) is long (large). On the other hand, as shown in (b) of FIG. 23, when the remaining toner amount is relatively small, compared with a decrease in warp degree of the polyester detecting film 351C, a degree of a decrease in warp degree of the polyester detecting film 352C is large. As a result, a time difference from the time when the polyester detecting film 351C reaches above the detection surface of the electrostatic capacity sensor electrode 321C until the time when the polyester detecting film 352C reaches above the detection surface of the electrostatic capacity sensor electrode 321C is short (small). By using this principle, the remaining toner amount is detected.

[Characteristic of Remaining Toner Amount Detection]

With reference to (a) to (c) of FIG. 24, a remaining toner amount detection characteristic will be described. As described above, the electrostatic capacity sensor IC 33C outputs, to the CPU 40, the 8 bit data corresponding to the detected value of the electrostatic capacity. In this embodiment, description will be made by representing the 8 bit data outputted from the electrostatic capacity sensor IC 33C to the CPU 40C as decimal number-detection levels. Part (a) of FIG. 24 is a characteristic graph between the remaining toner amount (%) and the time difference (msec) between the polyester detecting films 351C and 352C detected by the electrostatic capacity sensor IC 33C. As described above with reference to FIG. 23, the time difference is longer (larger) with a larger remaining toner amount, and the time difference is shorter (smaller) with a smaller remaining toner amount. As a result, the remaining toner amount can be detected by measuring the time difference. Part (b) of FIG. 24 is waveform data when the remaining toner amount is 65%, wherein the abscissa represents the time (msec) and the ordinate represents the detection level of the electrostatic capacity sensor IC 33C. It is understood that the time difference (msec) between the time when the polyester detecting film 351C is detected and the time when the polyester detecting film 352C is detected is 390 msec.

Part (c) of FIG. 24 is a table T in which the time difference and the remaining toner amount are associated with each other. The remaining toner amount between numerical values in the table T can be obtained by linear interpolation of known remaining toner amounts. Here, the measured times are values in this embodiment and therefore vary when a measuring condition is changed. This is also true for the numerical values in the table T. The information of the table T is written in advance in ROM of a storing portion or ROM provided in the process cartridge 5C at a factory and then is shipped. Then, the information written in ROM provided in the process cartridge 5C is read by the CPU 40C when the process cartridge 5C is mounted in the main assembly 101, thus being stored in RAM of the storing portion of the control board 80. Also in Embodiments 8 and 9 described later, the table information is stored (recorded) in ROM or RAM of the storing portion by these methods. Incidentally, the above method of recording the table information during the shipping is an example and therefore the present invention is not limited to the above-described methods.

[Flow Chart of Remaining Toner Amount Detection]

Next, processing for detecting the remaining toner amount in this embodiment will be described by using a flow chart of FIGS. 25A and 25B. Also in subsequent Embodiments, processing in each flow chart is similarly executed by the CPU 40C. However, the present invention is not limited thereto but in the case where, e.g., an application-specific integrated circuit (ASIC) is mounted in the image forming apparatus, a function of any of steps may also be performed by the ASIC.

In step 101C (S101C), the CPU 40C causes the polyester detecting films 351C and 352C to perform the rotating operation. In this embodiment, a time required for each polyester detecting film to rotate one turn is about 1 sec. In S102C, the CPU 40C serial-communicates with the electrostatic capacity sensor IC 33C by using the circuit shown in FIG. 22, thus starting reading of the detection level of the electrostatic capacity sensor IC 33C. Further, the CPU 40C resets an unshown timer α together with the detection level reading and then starts measuring of a time from the start of the reading of the detection level of the electrostatic capacity sensor IC 33C.

In S103C to S105C, the CPU 40C calculates an initial value of the detection level of the electrostatic capacity sensor IC 33C. First, in S103C, the CPU 40C makes setting of a provisional (temporary) initial value of the detection level of the electrostatic capacity sensor IC 33C (hereinafter referred to as a provisional initial value). The CPU 40C measures plural points of the detection level from the start of the reading of the detection level of the electrostatic capacity sensor IC 33C (hereinafter also referred to as monitoring), and then stores plural measured data values in, e.g., an unshown memory such as RAM. The CPU 40C calculates an average of the detection level of the electrostatic capacity sensor IC 33C from the plural data values stored in the memory, and takes this average as a provisional initial value. In this embodiment, the measurement is effected at, e.g., 10 points and the average thereof is calculated. However, the 10 point-measurement average is an example and therefore the average is not limited thereto. Further, the CPU 40C resets an unshown timer β together with the provisional initial value calculation and then starts the measurement of the time with the timer β.

In S104C, the CPU 40C discriminates whether or not the provisional initial value calculated in S103C is a relative value, i.e., whether or not the provisional initial value is a stable reference level and is qualified as an initial value. The CPU 40C continues the monitoring of the detection level of the electrostatic capacity sensor IC 33C in succession to S103C. For example, the CPU 40C discriminates that the calculated provisional initial value is the stable reference level from the fact that the resultant detection level of the electrostatic capacity sensor IC 33C falls within a certain range. In this embodiment, e.g., a discrimination criterion is such that the monitored detection level of the electrostatic capacity sensor IC 33C falls within ±10% of the provisional initial value for 0.3 sec by making reference to the timer β. In S104C, in the case where the CPU 40C discriminates that the monitored detection level of the electrostatic capacity sensor IC 33C is within ±10% of the provisional initial value for 0.3 sec, the CPU 40C sets, in S105C, the provisional initial value calculated in S103C as the initial value. The initial value set in S105C is used for calculating thresholds of other timers described hereinafter.

On the other hand, in the case where the CPU 40C discriminates that the monitored detection level of the electrostatic capacity sensor IC 33C is not within ±10% of the provisional initial value for 0.3 sec, the CPU 40C discriminates in S117C that an error (abnormality) occurs. In this embodiment, the error discrimination is made based on whether or not 2.0 sec or more elapses from the start of the monitoring of the detection level of the electrostatic capacity sensor IC 33C, i.e., from the start of the reading by making reference to the timer α. In S117C, in the case where the CPU 40C discriminates that the lapse of the time from the start of the reading of the detection level of the electrostatic capacity sensor IC 33C is less than 2.0 sec, the CPU 40C resets the provisional initial value calculated in S103C and then effects the processing operations of S103C to S105C, thus calculating the provisional initial value again. On the other hand, in S117C, in the case where the CPU 40C discriminates that, 2.0 sec or more elapses from the start of the reading of the detection level of the electrostatic capacity sensor IC 33C, the CPU 40C discriminates in S118C that any abnormality occurs, and then notifies the video controller 42 of the abnormality.

Next, in S106C to S109C, the CPU 40C discriminates whether or not the polyester detecting film 351C of the two polyester detecting films is detected. This is because the table T used for discriminating the remaining toner amount is based on the time (difference) from the time when the polyester detecting film 351C is detected to the time when the polyester detecting film 352C is detected. As a method of always detecting the polyester detecting film 351C, in one period of the polyester detecting film, the time (difference) from the time when a first rising threshold is detected to the time when a second rising threshold is detected and the time (difference) from the time when the second rising threshold is detected to the time when a third rising threshold is detected are compared. In the constitution in this embodiment, a longer (larger) time difference corresponds to the time (difference) from the time when the polyester detecting film 352C is detected to the time when the polyester detecting film 351C is detected. The CPU 40C measures the time (difference) between the detection times of the rising thresholds by using an unshown timer A and then compares the measured time differences as the whether or not they are a desired time (difference), so that it is possible to detect the polyester detecting film 351C.

In S106C, the CPU 40C resets the timer A and then starts the timer A, thus starting the time measurement. In S107C, the CPU 40C detects timing when the electrostatic capacity between the electrostatic capacity sensor electrode 321C and the electrode to be detected (either one of the electrodes to be detected 361C and 362C) provided on the polyester detecting film (either one of the polyester detecting films 351C and 352C) starts a change to the extent that the detection level is not less than the rising threshold. However, at this stage, the CPU 40 cannot discriminate whether the detected timing is that for the polyester detecting film 351C or that for the polyester detecting film 352C. In this embodiment, the rising threshold of the detection level of the electrostatic capacity sensor IC 33C is set at (initial value determined in S105C +30%). The CPU 40C discriminates the timing when the detection level exceeds this rising threshold is timing when either one of the polyester detecting films reaches above the detection surface of the electrostatic capacity sensor IC 33C. In S107C, in the case where the CPU 40C discriminates that the detection level of the electrostatic capacity sensor IC 33C is the rising threshold (initial value +30%) or more, the CPU 40C stops the timer A.

On the other hand, in S107C, in the case where the CPU 40C discriminate that the detection level is less than the rising threshold, the CPU 40 discriminates in S119C whether or not the error occurs. In this embodiment, the discrimination of the error is made based on whether or not 2.0 sec or more elapses from the start of the timer A. In S119C, in the case where the CPU 40C discriminates that 2.0 sec or more does not elapse from the start of the timer A, the sequence returns to the processing of S107C, in which the monitoring of the detection level of the electrostatic capacity sensor IC 33C is continued. On the other hands, in S119B, in the case where the CPU 40C discriminates that 2.0 sec or more elapses from the start of the timer A, the sequence goes to processing of S120C. In S120C, the CPU 40C discriminates that some abnormality (error) such as non-detection of the electrode to be detected 361C, failure of the electrostatic capacity sensor IC 33C or communication abnormality between the CPU 40C and the electrostatic capacity sensor IC 33C, and then notifies the video controller 42 of the abnormality.

In S108C, the CPU 40C discriminates whether or not the timing detected in S107C is the timing when the polyester detecting film 351C reaches above the detection surface of the electric signal sensor electrode 321C. The CPU 40C reads a value of the stopped timer A and discriminate whether or not the value of the timer A falls within a specific range determined in advance. In this embodiment, the specific range (time) was 450 msec or more and 650 msec or less. For example, in the case where the timer A value is less than 450 msec, the CPU 40C cannot discriminates whether the detection level by the electrostatic capacity sensor IC 33C is that for the polyester detecting film 351C or that for the polyester detecting film 352C. The predetermined specific range (time) is required to be a value which is not less than a value obtained by dividing an arrangement distance from the polyester detecting film 351C to the polyester detecting film 352 by a rotation speed for one turn and is also required to be a value which is not more than a value smaller than a time of one turn. In S108C, in the case where the CPU 40C discriminates that the timer A value is within the specific range, the CPU discriminates that the polyester detecting film 351C reaches the detection surface of the electrostatic capacity sensor electrode 321C, i.e., that the polyester detecting film 351C is detected.

On the other hand, in S108C, when the CPU 40C discriminates that the timer A value is not within the specific range, the CPU 40C discriminates that the polyester detecting film 351C cannot be detected. In this case, the CPU 40 resets, after the sequence returns to the processing of S106C, the timer A and then starts the monitoring of the detection level of the electrostatic capacity sensor IC 33C in order to detect the polyester detecting film 351 again. In S109C, the CPU 40C starts a timer B from timing when the electrostatic capacity between the electrostatic capacity sensor electrode 321C and the electrode to be detected 361C of the polyester detecting film 351C changes to the extent that the detection level is not less than the rising threshold, thus starting the measurement of the time. The timer B is a timer for measuring the time difference between the timing when the polyester detecting film 351C is detected and the timing when the polyester detecting film 352C is detected.

Next, in S110C and S11C, the CPU 40 detects that the polyester detecting film 351C passes. In S110C, the CPU 40C detects timing when the electrostatic capacity between the electrostatic capacity sensor electrode 321C and the electrode to be detected provided on the polyester detecting film changes to the extent that the detection level is not more than the falling threshold. In this embodiment, the falling threshold of the detection level is set at (initial value determined in S105C +20%). Further, the CPU 40C discriminates the timing when the detection level is below this falling threshold is timing when either one of the polyester detecting films passes the detection surface of the electrostatic capacity sensor IC 33C. In S110C, in the case where the CPU 40C discriminate that the detection level of the electrostatic capacity sensor IC 33C is not less than the falling threshold (initial value +20%), the CPU 40 discriminates in S121C whether or not the error occurs. In this embodiment, in S121C, in the case where the CPU 40C discriminates that the lapse of the time from the start of the timer B is less than 2.0 sec, the sequence returns to the processing of S110C, in which the monitoring of the detection level of the electrostatic capacity sensor IC 33C is continued. On the other hands, in S121C, in the case where the CPU 40C discriminates that 2.0 sec or more elapses from the start of the timer B, the sequence goes to processing of S122C. In S122C, the CPU 40C discriminates that some abnormality (error) such as failure of the electrode to be detected 361C, failure of the electrostatic capacity sensor IC 33C or communication abnormality between the CPU 40C and the electrostatic capacity sensor IC 33C, and then notifies the video controller 42 of the abnormality. Here, the reason why the rising threshold is (initial value +30%) and the falling threshold is (initial value +20%) is that hysteresis is provided and a malfunction due to noise is prevented. In S111C, the CPU 40C detects that the polyester detecting film 351C passes through above the detection surface of the electrostatic capacity sensor electrode 321C.

Next, in S112C and S113, the CPU 40C detects the timing when the polyester detecting film 351C reaches above the detection surface of the polyester detecting film 351C. In S112C, the CPU 40C detects the timing when the electrostatic capacity between the electrostatic capacity sensor electrode 321C and the electrode to be detected 362C of the polyester detecting film 352C changes to the extent that the detection level is not less than the rising threshold.

In this embodiment, the detection level rising threshold is (initial value +30%). The CPU 40C discriminate that this timing when the detection level is not less than the rising threshold is the timing when the polyester detecting film 352C reaches above the detection surface of the electrostatic capacity sensor electrode 321C. In S112C, in the case where the CPU 40C discriminates that the detection level of the electrostatic capacity sensor IC 33C is not less than the rising threshold, the sequence goes to processing of S113C. In S112C, in the case where the CPU 40C discriminates that the detection level of the electrostatic capacity sensor IC 33C is less than the rising threshold, the CPU 40C discriminates in S123C whether or not the error occurs. The processing operations in S123C and S124C are the same as those in S121C and S122C and therefore will be omitted from description. In S113C, the CPU 40C stops the timer B with timing when the electrostatic capacity between the electrostatic capacity sensor electrode 321C and the electrode to be detected 362C of the polyester detecting film 352C changes to the extent that the detection level is not less than the rising threshold.

IN S114C, the CPU 40C reads the value of the timer B. In S115C, the CPU 40C compares the timer B and the table T to check the value. The table T is, as shown in (c) of FIG. 24, such a table that pairs of the time differences (msec) and corresponding remaining toner amounts (%) are listed. For example, in the case of (b) of FIG. 24, the time difference is 390 msec, so that it is possible to detect that the remaining toner amount is 60% from the table T. The CPU 40C discriminates, as described above, the remaining toner amount with respect to the value between numerical values in the table by checking the time difference against a value calculated by linear interpolation of the numerical values on the basis of the table T. In S116C, the CPU 40C notifies the video controller 42 of the main assembly of the remaining toner amount (%) discriminated in S115C.

In this embodiment, the rotating operation of the polyester detecting film performed in the remaining toner amount detection sequence is described but if the polyester detecting film is rotated during the image forming operation or the like, the remaining amount can be detected. Further, the remaining toner amount detection may also be started from a state in which the rotation state of the polyester detecting film is stabilized by rotating the polyester detecting film several turns before the remaining toner amount detection. Further, in this embodiment, on the basis of a result of a single (one) measurement (the timer B value in S114C), the remaining toner amount is calculated but it is possible to further improve the accuracy by effecting the measurement plural times and then by discriminating the remaining toner amount from an average of the measured values. Here, the above-defined falling threshold and rising threshold, the timer A value and the error discrimination time are an example in the constitution in this embodiment. These constitutions are determined in total consideration of the arrangement of the polyester detecting films 351C and 352C, the rotation speed of the polyester detecting films, the circuit constant, the detection level of the electrostatic capacity sensor, and the like and therefore are not limited to those described above.

In this embodiment, in the processing operations of S106C to S109C, the sequence for detecting the polyester detecting film 351C and then detecting the polyester detecting film 352C was shown.

However, it is also possible to use the following method in place of the sequence. Three values of the timing when the detection level of the electrostatic capacity sensor IC 33C changes to the extent that it is not less than the rising threshold are detected. A time difference from the image timing to the second timing and a time difference from the second timing to the third timing are calculated. In this case, it is possible to discriminate that a smaller value of the two time differences is a time difference from the detection of the polyester detecting film 351C to the detection of the polyester detecting film 352C. This time difference is checked against the table T to discriminate the remaining toner amount. As a result, the sequence can be simplified.

Further, the remaining toner amount was discriminated on the basis of the difference between the time when the electrostatic capacity between the electrostatic capacity sensor electrode 321C and the electrode to be detected 361C provided on the polyester detecting film 351C starts to change to the extent that the detection level is not less than the rising threshold and the time when the electrostatic capacity between the electrostatic capacity sensor electrode 321C and the electrode to be detected 362C provided on the polyester detecting film 352C starts to change to the extent that the detection level is not less than the rising threshold. However, the remaining toner amount may also be discriminated on the basis of the difference between the time when the electrostatic capacity between the electrostatic capacity sensor electrode 321C and the electrode to be detected 361C provided on the polyester detecting film 351C starts to change to the extent that the detection level is not more than the falling threshold and the time when the electrostatic capacity between the electrostatic capacity sensor electrode 321C and the electrode to be detected 362C provided on the polyester detecting film 352C starts to change to the extent that the detection level is not more than the falling threshold. Further, the remaining toner amount may also be discriminated on the basis of the difference between the time when the electrostatic capacity between the electrostatic capacity sensor electrode 321C and the electrode to be detected 361C starts to change to the extent that the detection level is not less than the rising threshold and the time when the electrostatic capacity between the electrostatic capacity sensor electrode 321C and the electrode to be detected 362C starts to change to the extent that the detection level is not more than the falling threshold. As a result, also the time when the polyester detecting film 352C completely passes through over the electrostatic capacity sensor electrode 321C can be considered and therefore the remaining toner amount can be detected with higher accuracy.

Further, in this embodiment, the electrode to be detected 361C provided on the polyester detecting film 351C was disposed in the neighborhood of the end of the polyester detecting film 351C with respect to the circumferential direction. However, by disposing the electrode to be detected 361C in the neighborhood of the rotation shaft 29C (rotation shaft side), the polyester detecting film 351C can be detected at a certain interval irrespective of the remaining toner amount while the polyester detecting film 351C has flexibility. By calculating the difference from the time detected by the polyester detecting film 352C, the warp degree of the polyester detecting film 352C can be detected with high accuracy and therefore the remaining toner amount can be detected with higher accuracy.

Thus, the remaining toner amount is discriminated on the basis of the time difference from the timing when the polyester detecting film 351C reaches above the detection surface of the electrostatic capacity sensor electrode 321C to the timing when the polyester detecting film 352C reaches above the detection surface of the electrostatic capacity sensor electrode 321C. As a result, it is possible to detect the remaining toner amount in real time from the full state of the toner to the empty state of the toner. Further, the electrostatic capacity sensor changes its electrostatic capacity depending on the approach of the polyester detecting film and therefore speed-up of the detection time and the image forming operation can be performed simultaneously. Further, the warpage of the polyester detecting film is stable depending on the remaining toner amount even when the polyester detecting film is rotated at high speed and therefore the remaining toner amount can be detected in real time.

As described above, according to this embodiment, the remaining toner amount can be detected in real time from the full state of the toner to the empty state of the toner, and even when the stirring member is operated at high speed, the remaining toner amount can be detect with high accuracy.

Embodiment 8

In Embodiment 7, the polyester detecting film 351C has flexibility and is warped by the resistance of the toner 28C. In this embodiment, a stirring rod 261C is provided. The stirring rod 261C has high rigidity and also has a function of stirring the toner 28C. Incidentally, the constitution of the image forming apparatus in this embodiment is the same as that described in Embodiment 7 except for the process cartridge 5C and therefore will be omitted from detailed description.

A process cartridge in this embodiment will be described with reference to FIG. 26. FIG. 26 is a sectional view of a process cartridge and an electrostatic capacity sensor 26 substrate in this embodiment. Inside the toner container 23C of the process cartridge 5C in this embodiment, the toner (not shown) of an associated color and a stirring rod 261C for supplying the toner to a toner supply roller 121C are provided. The stirring rod 261C performs rotating motion around a rotation shaft 29C, thus stirring the toner. Another rotation shaft 29C is provided with the stirring rod 261C for detecting the remaining toner amount, and a polyester detecting film 352C. The stirring rod 261C has high rigidity and performs a certain rotating operation irrespective of the resistance of the toner. The polyester detecting film 352C is disposed 90 degrees behind the stirring rod 261C with respect to the rotational direction and has flexibility. Further, as the stirring rod 261C, a member having electroconductivity is used. In the neighborhood of the circumferential end of the polyester detecting film 352C, an electroconductive electrode to be detected 362C is provided.

The electrostatic capacity sensor substrate 331C provided with the electrostatic capacity sensor IC 33C, for detecting the remaining toner amount in the toner container 23C, and the like is provided in the neighborhood of an outer wall of the developing unit with respect to the circumferential direction of the stirring rod and the polyester detecting film 352C. The electrostatic capacity sensor electrode 321C approaches the outer casing of the toner container 23C when the process cartridge 5 is mounted in the main assembly 101. In this state, the electrostatic capacity generated by the stirring rod 261C or the electrode to be detected 362C, which are provided in the developing unit, is detected by the electrostatic capacity sensor IC 33C. The circuit diagram in this embodiment is the same as that of FIG. 13 described in Embodiment 1 and will be omitted from detailed description in this embodiment.

The detection characteristic and the flow chart are similar to those of (a) to (c) of FIG. 24 and FIGS. 25A and 25B in Embodiment 7. Incidentally, the stirring rod 261C in this embodiment corresponds to the polyester detecting film 351C and the electrode to be detected 361C in Embodiment 7. For this reason, the 351C in S109C in the flow chart of FIG. 25A is read as the stirring rod 261C in this embodiment. The stirring rod 261C has high rigidity and therefore rotates constantly irrespective of the resistance of the toner. For that reason, the stirring rod 261C constantly rotates irrespective of the remaining toner amount and therefore the time detected by the electrostatic capacity sensor IC 33C is always a certain interval. Therefore, by calculating the difference between the time detected by the stirring rod 261C and the time detected by the polyester detecting film 352C, i.e., the time difference, the warp degree of the polyester detecting film 352C can be detected with high accuracy and therefore the remaining toner amount can be detected with higher accuracy.

As described above, according to this embodiment, the remaining toner amount can be detected in real time from the full state of the toner to the empty state of the toner, and even when the stirring member is operated at high speed, the remaining toner amount can be detected with high accuracy.

Embodiment 9

In Embodiment 7, the remaining toner amount is detected on the basis of the time difference between the values of timing when the electrostatic capacity sensor IC 33C detects the two polyester detecting films. On the other hand, in this embodiment, the remaining toner amount is detected by detecting a change in electrostatic capacity detected by the electrostatic capacity sensor IC 33C. First, a color laser printer in this embodiment will be described. The image forming apparatus, the process cartridge and the circuit diagram in this embodiment are the same as those described in Embodiment 7 with reference to FIGS. 21 and 22 and thus will be omitted from detailed description in this embodiment.

[Characteristic of Remaining Toner Amount Detection]

With reference to (a) to (c) of FIG. 27, a remaining toner amount detection characteristic will be described. Part (a) of FIG. 27 is a characteristic graph between the remaining toner amount (%) and the difference in detection level (detection level difference) between the polyester detecting films 351C and 352C detected by the electrostatic capacity sensor IC 33C. The detection level difference is smaller with a larger remaining toner amount, and the detection level difference is larger with a smaller remaining toner amount. As a result, the remaining toner amount can be detected by calculating the detection level difference. Part (b) of FIG. 27 is waveform data when the remaining toner amount is 10%. In this embodiment, the electrostatic capacity sensor IC 33C calculates an average of each of the detection levels, detected thereby, of the electrode to be detected 361C provided on the polyester detecting film 351C and the electrode to be detected 362C provided on the polyester detecting film 352C. Then, by using a difference in average between the calculated detection (i.e., the detection level difference), the remaining toner amount is discriminated. In (b) of FIG. 27, it is understood that an average A of the detection level of the polyester detecting film 351C is 195 and an average B of the detection level of the polyester detecting film 352C is 210, and thus the difference in average between the detection levels, i.e., the detection level difference is 15.

Part (c) of FIG. 24 is a table N in which the detection level difference and the remaining toner amount are associated with each other. The remaining toner amount between numerical values in the table T can be obtained by linear interpolation of known remaining toner amounts. Here, the calculated detection level values are values in this embodiment and therefore vary when a measuring condition is changed. This is also true for the numerical values in the table T.

[Flow Chart of Remaining Toner Amount Detection]

Next, a sequence for detecting the remaining toner amount in this embodiment will be described by using a flow chart of FIGS. 28A and 28B. Processing operations of S201C to S205C, S215C and S216C are the same as those of S101C to S105C, S117C and S118C of FIGS. 25A and 25B in Embodiment 7 and therefore will be omitted from description. In S206C, the CPU 40C detects the polyester detecting film 351C or 352C. In S206C, the CPU 40C detects timing when the electrostatic capacity detection level between the electrostatic capacity sensor electrode 321C and the electrode to be detected 361C of the polyester detecting film 351B or the electrode to be detected 362C of the polyester detecting film 352C states a change to the extent that the detection level is not less than the rising threshold. In this embodiment, the rising threshold of the detection level is set at (initial value determined in S205C +30%). The CPU 40C discriminate that this timing when the polyester detecting film 351C or the detection level is not less than the rising threshold is the timing when the polyester detecting film 352C reaches above the detection surface of the electrostatic capacity sensor electrode 321C. In S206C, in the case where the CPU 40C discriminates that the detection level of the electrostatic capacity sensor IC 33C is not less than the rising threshold, the sequence goes to processing of S207C. On the other hand, in S206C, in the case where the CPU 40C discriminates that the detection level of the electrostatic capacity sensor IC 33C is less than the rising threshold, the CPU 40C discriminates in S217C whether or not the error occurs. The processing operations in S217C and S218C are the same as those in S215C and S216C and therefore will be omitted from description.

Next, in S207C and S208C, the CPU 40C calculates the average of the detection level of the polyester detecting film 351C or the polyester detecting film 352C and detects the passing of the polyester detecting film 351C or the polyester detecting film 352C. In S207C, the CPU 40C measures the monitored detection level of the electrostatic capacity sensor IC 33C at plural points and stores the measured detection levels in, e.g., a memory. At this time, the CPU 40C stores also the resultant number of measured data in the memory and calculates the average A from the plurality of the measured data and the number of the measured data. In S208C, the CPU 40C detects timing when the electrostatic capacity detection level between the electrostatic capacity sensor electrode 321C and the electrode to be detected 361C of the polyester detecting film 351C or the electrode to be detected 362C of the polyester detecting film 352C changes to the extent that the detection level is not more than the falling threshold. In this embodiment, the falling threshold of the detection level of the electrostatic capacity sensor IC 33C is (initial value determined in S205C) +20%. The CPU 40C discriminates that the timing when the detection level of the electrostatic capacity sensor IC 33C is not more than the falling threshold is the timing when the polyester detecting film 351C or the polyester detecting film 352C passes through over the detection surface of the electrostatic capacity sensor electrode 321C. In S208C, when the CPU 40C discriminates that the detection level of the electrostatic capacity sensor IC 33C is not more than the falling threshold, the monitoring is ended and the average A is decided, so that the sequence goes to processing of S209C. In S208C, in the case where the CPU 40C discriminates that the detection level of the electrostatic capacity sensor IC 33C is not the falling threshold or less, the CPU 40C discriminates in S219C whether or not the error occurs. The processing operations of S219C and S220C are the same as those of S215C and S216C and therefore will be omitted from description. Incidentally, setting of the rising threshold and the falling threshold is the same as that in Embodiment 7 and will be omitted from description.

In S115C, the CPU 40C compares the timer B and the table T to check the value. The table T is, as shown in (c) of FIG. 24, such a table that pairs of the time differences (msec) and corresponding remaining toner amounts (%) are listed. For example, in the case of (b) of FIG. 24, the time difference is 390 msec, so that it is possible to detect that the remaining toner amount is 60% from the table T. The CPU 40C discriminates, as described above, the remaining toner amount with respect to the value between numerical values in the table by checking the time difference.

Next, in S209C, the CPU 40C detects the polyester detecting film 351C or 352C. If the polyester detecting film 351C is detected in S206C, the polyester detecting film 352C is detected in S209C, and if the polyester detecting film 352C is detected in S206C, the polyester detecting film 351C is detected in S209C. In S209C, the CPU 40C discriminates whether or not the electrostatic capacity detection level between the electrostatic capacity sensor electrode 321C and the electrode to be detected 362C of the polyester detecting film 352B or the electrode to be detected 361C of the polyester detecting film 351C is not less than the rising threshold. In this embodiment, the rising threshold of the detection level is set at (initial value determined in S205C +30%). The CPU 40C discriminate that this timing when the polyester detecting film 352C or the detection level exceeds the rising threshold is the timing when the polyester detecting film 351C reaches above the detection surface of the electrostatic capacity sensor electrode 321C. In S209C, in the case where the CPU 40C discriminates that the detection level of the electrostatic capacity sensor IC 33C is not less than the rising threshold, the sequence goes to processing of S210C. On the other hand, in S209C, in the case where the CPU 40C discriminates that the detection level of the electrostatic capacity sensor IC 33C not the rising threshold or more, the sequence goes to processing of S221C. The processing operations in S221C and S222C are the same as those in S217C and S218C and therefore will be omitted from description.

Next, in S210C and S211C, the CPU 40C calculates the average of the detection level of the polyester detecting film 352C or the polyester detecting film 351C and detects the passing of the polyester detecting film 352C or the polyester detecting film 351C. In S210C, the CPU 40C measures the monitored detection level of the electrostatic capacity sensor IC 33C at plural points and stores the measured detection levels in, e.g., a memory. At this time, the CPU 40C stores also the resultant number of measured data in the memory and calculates the average B from the plurality of the measured data and the number of the measured data. In S218C, the CPU 40C discriminates whether or not the electrostatic capacity detection level between the electrostatic capacity sensor electrode 321C and the electrode to be detected 362C of the polyester detecting film 352C or the electrode to be detected 361C of the polyester detecting film 351C is not more than the falling threshold. In this embodiment, the falling threshold of the detection level of the electrostatic capacity sensor IC 33C is (initial value +20%). The CPU 40C discriminates that the timing when the detection level is less than the falling threshold is the timing when the polyester detecting film 352C or the polyester detecting film 351C passes through over the detection surface of the electrostatic capacity sensor electrode 321C. In S211C, in the case were the CPU 40C discriminates that the detection level of the electrostatic capacity sensor IC 33C is not more than the falling threshold, the monitoring of the detection level of the electrostatic capacity sensor IC 33C is ended and the average B is decided, so that the sequence goes to processing of S212C. In S211C, in the case where the CPU 40C discriminates that the detection level of the electrostatic capacity sensor IC 33C is not the falling threshold or less, the CPU 40C discriminates in S223C whether or not the error occurs. The processing operations of S223C and S224C are the same as those of S215C and S216C and therefore will be omitted from description. Further, setting of the rising threshold and the falling threshold is the same as that in Embodiment 7 and will be omitted from description.

In S212C, the CPU 40C calculates the detection level difference between the polyester detecting films from the average A calculated in S207C and the average B calculated in S210C. In this embodiment, an absolute value of the difference between the average A and the average B is calculated. For example, in the case of (b) of FIG. 27, (average A−average B)=195−210 and thus its absolute value is 15.

In S213C, the CPU 40C checks the detection level difference calculated in S212C against the table N. The table N is such a table that pairs of the detection level difference and corresponding remaining toner amounts are listed, e.g., as shown in (c) of FIG. 27. The CPU 40C discriminates the remaining toner amount by checking the value against the table N. For example, in the case of (b) of FIG. 27, the absolute value of the detection level difference is 15, so that it is understood that the remaining toner amount is 10% from the table N of (c) of FIG. 27. Incidentally, as described above, the value between numerical values in the table N is calculated by performing linear interpolation of the known numerical values in the table N. In S214C, the CPU 40C notifies the video controller 42 of the discriminated remaining toner amount.

Thus, in this embodiment, the remaining toner amount is discriminated on the basis of the detection level difference between the electrostatic capacity between the electrostatic capacity sensor electrode 321C and the electrode to be detected 361C provided on the polyester detecting film 351C and the electrostatic capacity between the electrostatic capacity sensor electrode 321C and the electrode to be detected 362C provided on the polyester detecting film 352C. As a result, it is possible to detect the remaining toner amount in real time from the full state of the toner to the empty state of the toner. Further, the electrostatic capacity sensor IC changes its electrostatic capacity detection level depending on the approach of the polyester detecting film and therefore speed-up of the detection time and the image forming operation can be performed simultaneously. Further, the warpage of the polyester detecting film is stable depending on the remaining toner amount even when the polyester detecting film is rotated at high speed and therefore the remaining toner amount can be detected in real time.

As described above, according to this embodiment, the remaining toner amount can be detected in real time from the full state of the toner to the empty state of the toner, and even when the stirring member is operated at high speed, the remaining toner amount can be detect with high accuracy.

Embodiment 10

In Embodiment 9, the polyester detecting film 351C has flexibility and is warped by the resistance of the toner 28C. In this embodiment, a stirring rod 261C is provided and corresponds to the polyester detecting film 351C. The stirring rod 261C has high rigidity and also has a function of stirring the toner 28C. Incidentally, the constitution of the image forming apparatus in this embodiment is the same as that described in Embodiment 7 except for the process cartridge 5C and therefore will be omitted from detailed description. The constitution in this embodiment uses, the process cartridge of FIG. 26 described in Embodiment 8, and the sequence for detecting the remaining toner amount uses a flow chart shown in FIGS. 28A and 28B. Incidentally, in the description of the flow chart of FIGS. 28A and 28B, the polyester detecting film 351C is read as the stirring rod 261C. Further, the detection characteristic is also the same as that of FIG. 27 described in Embodiment 9. The stirring rod 261C has high rigidity and therefore rotates constantly irrespective of the resistance of the toner 28C. For that reason, the stirring rod 261C constantly rotates irrespective of the remaining toner amount and therefore the detection level detected by the electrostatic capacity sensor IC 33C becomes constant. Therefore, by calculating the difference between the detection level detected by the stirring rod 261C and the detection level detected by the polyester detecting film 352C, the detection level difference due to warpage of the polyester detecting film 352C can be detected with high accuracy and therefore the remaining toner amount can be detected with higher accuracy.

As described above, according to this embodiment, the remaining toner amount can be detected in real time from the full state of the toner to the empty state of the toner, and even when the stirring member is operated at high speed, the remaining toner amount can be detected with high accuracy.

Other Embodiments

In the above-described embodiment, for easy understanding, description such that the reference to the table is made in a single detection is made. However, it is possible to except further enhancement of the detection accuracy by effecting control such that data measured plural times are averaged and thereafter reference to the respective tables is made.

Further, in the above-described embodiments, the constitution in which the two polyester detecting films are disposed in the developing unit was described. However, by disposing three or more polyester detecting films, it is possible to detect the remaining toner amount with higher accuracy.

Further, in the above-described embodiments, an integral constitution of the developing unit was described. However, also in a supply type toner container which is separately provided from the developing roller, the present invention is applicable by providing the electrode to be detected and the polyester detecting film inside the toner container.

As described above, also in other embodiments, the remaining toner amount can be detected in real time from the full state of the toner to the empty state of the toner, and even when the stirring member is operated at high speed, the remaining toner amount can be detected with high accuracy.

INDUSTRIAL APPLICABILITY

As described above, according to the present invention, the remaining toner amount can be detected in real time from the full state of the toner to the empty state of the toner, and even when the stirring member is operated at high speed, the remaining toner amount can be detected with high accuracy.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 072275/2011 filed Mar. 29, 2011; 084508/2011 filed Apr. 6, 2011 and 093147/2011 filed Apr. 19, 2011 which are hereby incorporated by reference.

The invention claimed is:

1. An image forming apparatus comprising:

a developing unit configured to accommodate a developer;

a rotatable member which includes a first electroconductive member and is rotatable about a rotation shaft in a the developing unit and has flexibility so that it is flexed depending on a resistance of the developer;

a second electroconductive member provided in a neighborhood of an outer wall surface of a bottom of said developing unit;

a detecting unit configured to detect an electrostatic capacity between said first electroconductive member and said second electroconductive member and configured to output an electric signal; and a control unit configured to measure a time duration in which the electric signal exceeds a predetermined threshold, wherein said control unit discriminates an amount of the developer on the basis of the time duration measured by said control unit.

2. The image forming apparatus according to claim 1, wherein said control unit is configured to measure a detection level of the electric signal, and wherein when the amount of the developer is less than a predetermined amount, said control unit discriminates the amount of the developer on the basis of the detection level, when the amount of the developer is not less than the predetermined amount, said control unit discriminates the amount of the developer on the basis of the time.

3. The image forming apparatus according to claim 1, wherein said first electroconductive member is provided in a neighborhood of the rotation shaft of said rotatable member and in a neighborhood of an end of said rotatable member.

4. The image forming apparatus according to claim 1, wherein said first electroconductive member is a single member provided in a region ranging from a neighborhood of the rotation shaft of said rotatable member to a neighborhood of an end of said rotatable member.

5. The image forming apparatus according to claim 1, further comprising a stirring member, rotatable about said rotation shaft in the said developing unit, for stirring the developer.

6. An image forming apparatus comprising:

a developing unit configured to accommodate a developer;

a first member which includes a first electrode and is rotatable about a rotation shaft in said developing unit wherein said first member is rotatable by contact with said second member;

a second member which performs a rotating operation about the rotation shaft in said developing unit, wherein said first member is rotatable by contact with said second member;

a second electrode provided on an outer casing of said developing unit; and a control unit configured to detect an electrostatic capacity between said first electrode and said second electrode and configured to output an electric signal regarding the detected electrostatic capacity, wherein said control unit discriminates an amount of the developer in said developing unit on the basis of the electric signal.

7. The image forming apparatus according to claim 6, wherein said first member is rotated by the rotating operation of said second member until the developer falls freely by its own weight.

8. The image forming apparatus according to claim 6, wherein said second member has a function of stirring the developer in said developing unit.

9. The image forming apparatus according to claim 6, wherein said first electrode is provided in a neighborhood of a circumferential end of said first member.

10. The image forming apparatus according to claim 6, wherein said outputting means includes setting means for setting an amplification factor of the data and amplifying means for amplifying the data depending on the amplification factor set by said setting means.

11. The image forming apparatus according to claim 10, wherein said outputting means changes the amplification factor of the data depending on a remaining amount of the developer.

12. The image forming apparatus according to claim 10, wherein said outputting means changes the amplification factor in a state in which rotation of said first member is stopped.

13. The image forming apparatus according to claim 6, wherein in a state in which said second member rotates and the first member is at rest by contact with the developer, said control unit detects the electrostatic capacity.

14. An image forming apparatus comprising:

a developing unit configured to accommodate a developer;

a first member which comprises a first electrode and is rotatable about a rotation shaft in said developing unit;

a second member which comprises a second electrode and is provided at a predetermined angle formed between itself and said first member with respect to the rotation shaft of said first member;

a third electrode provided on an outer casing of said developing unit;

an outputting unit configured to detect an electrostatic capacity between said first electrode and said third electrode or between said second electrode and said third electrode and configured to output information on the detected electrostatic capacity; and a discriminating unit configured to discriminate an amount of the developer in said developing unit on the basis of the information, wherein said discriminating unit discriminates the amount of the developer on the basis of a difference between a time when said outputting unit detects the electrostatic capacity between said first electrode and said third electrode and a time when said outputting unit detects the electrostatic capacity between said second electrode and said third electrode.

15. The image forming apparatus according to claim 14, wherein said first member and said second member have flexibility, and wherein an amount of flexure of said second member is larger than that of said first member.

16. The image forming apparatus according to claim 15, wherein said first electrode is provided at an end of said first member with respect to a circumferential direction perpendicular to the rotation shaft, and said second electrode is provided at an end of said second member with respect to the circumferential direction.

17. The image forming apparatus according to claim 15, wherein said first electrode is provided at a side of the rotation shaft of said first member with respect to a circumferential direction perpendicular to the rotation shaft, and said second electrode is provided at an end of said second member with respect to the circumferential direction.

18. The image forming apparatus according to claim 14, wherein said second member has flexibility, wherein said second electrode is provided at an end of said second member with respect to a circumferential direction perpendicular to the rotation shaft, and wherein said first member is the first electrode and has rigidity higher than that of said second member, and has a function of stirring the developer.

19. An image forming apparatus comprising:

a developing unit configured to accommodate a developer;

a first member which comprises a first electrode and is rotatable about a rotation shaft in said developing unit;

a second member which comprises a second electrode and is provided at a predetermined angle formed between itself and said first member with respect to the rotation shaft of said first member;

a third electrode provided on an outer casing of said developing unit;

an outputting unit configured to detect an electrostatic capacity between said first electrode and said third electrode or between said second electrode and said third electrode and configured to output information on the detected electrostatic capacity; and a discriminating unit configured to discriminate an amount of the developer in said developing unit on the basis of the information, wherein said discriminating unit discriminates the amount of the developer on the basis of a difference between the information on the electrostatic capacity between said first electrode and said third electrode outputted by said outputting unit and the information on the electrostatic capacity between said second electrode and said third electrode outputted by said outputting unit.

* * * * *